US008561702B2

(12) United States Patent
Wylie et al.

(10) Patent No.: US 8,561,702 B2
(45) Date of Patent: Oct. 22, 2013

(54) HOT FLUID RECOVERY OF HEAVY OIL WITH STEAM AND CARBON DIOXIDE

(75) Inventors: Ian Wylie, Naperville, IL (US); L. Allan McGuire, Elkhart, IN (US); David L. Hagen, Goshen, IN (US); Gary D. Ginter, Chicago, IL (US)

(73) Assignee: Vast Power Portfolio, LLC, Elkhart, IN (US)

( * ) Notice: Subject to any disclaimer, the term of this patent is extended or adjusted under 35 U.S.C. 154(b) by 273 days.

(21) Appl. No.: 12/526,392

(22) PCT Filed: Feb. 11, 2008

(86) PCT No.: PCT/US2008/001896

§ 371 (c)(1),
(2), (4) Date: Aug. 7, 2009

(87) PCT Pub. No.: WO2008/097666

PCT Pub. Date: Aug. 14, 2008

(65) Prior Publication Data

US 2010/0276148 A1 Nov. 4, 2010

Related U.S. Application Data

(60) Provisional application No. 60/900,587, filed on Feb. 10, 2007, provisional application No. 60/925,971, filed on Apr. 24, 2007.

(51) Int. Cl.
*E21B 36/00* (2006.01)

(52) U.S. Cl.
USPC ..... 166/303

(58) Field of Classification Search
None
See application file for complete search history.

(56) References Cited

U.S. PATENT DOCUMENTS

| | | | |
|---|---|---|---|
| 2,734,578 | A | 2/1956 | Walter |
| 2,754,098 | A | 7/1956 | Heinze |
| 2,793,497 | A | 5/1957 | Walter |
| 2,823,752 | A | 2/1958 | Walter |
| 2,839,141 | A | 6/1958 | Walter |
| 2,916,877 | A | 12/1959 | Walter |
| 3,620,571 | A | 11/1971 | Billings |

(Continued)

FOREIGN PATENT DOCUMENTS

CA 2451127 12/2003

OTHER PUBLICATIONS

International Search Report dated Jun. 25, 2008, issued in corresponding international application No. PCT/US2008/001896.

(Continued)

*Primary Examiner* — Shane Bomar
*Assistant Examiner* — Silvana Runyan
(74) *Attorney, Agent, or Firm* — Ostrolenk Faber LLP

(57) ABSTRACT

Combustion gases with relatively high levels of carbon dioxide ($CO_2$), steam, and/or hot water, may be used to improve recovery of heavy hydrocarbons from geologic formations and/or from surface mined materials. These gases reduce the viscosity and/or increase hydrocarbon extraction rates through improvements in thermal efficiency and/or higher rates of heat delivery for a given combustor an capital investment. Such high water/$CO_2$ content combustion gases can be formed by adding water to combustion gases formed by burning fuel. The pressure to inject the combustion gases and extract heavy hydrocarbons may be provided by diverting high pressure expanded gases from wet combustion in a gas turbine, or by reducing the pressure drop across a turbine and using the expanded hot gases for extraction.

70 Claims, 15 Drawing Sheets

(56) References Cited

U.S. PATENT DOCUMENTS

| | | | | | |
|---|---|---|---|---|---|
| 3,948,323 | A | | 4/1976 | Sperry | |
| 3,993,135 | A | | 11/1976 | Sperry | |
| 4,118,925 | A | | 10/1978 | Sperry | |
| 4,244,684 | A | * | 1/1981 | Sperry et al. | 431/4 |
| 4,252,191 | A | | 2/1981 | Pusch et al. | |
| 4,282,929 | A | * | 8/1981 | Krajicek | 166/303 |
| 4,327,805 | A | | 5/1982 | Poston | |
| 4,344,485 | A | | 8/1982 | Butler | |
| 4,377,066 | A | | 3/1983 | Dickinson | |
| 4,379,489 | A | | 4/1983 | Rollmann | |
| 4,380,960 | A | | 4/1983 | Dickinson | |
| 4,388,288 | A | | 6/1983 | Dupin et al. | |
| 4,398,604 | A | | 8/1983 | Krajicek | |
| 4,444,258 | A | | 4/1984 | Kalmar | |
| 4,454,917 | A | | 6/1984 | Poston | 166/303 |
| 4,498,542 | A | | 2/1985 | Eisenhawer et al. | 166/303 |
| 4,589,488 | A | * | 5/1986 | Schirmer | 166/257 |
| 4,678,039 | A | * | 7/1987 | Rivas et al. | 166/303 |
| 4,860,827 | A | * | 8/1989 | Lee et al. | 166/261 |
| 5,050,375 | A | * | 9/1991 | Dickinson | 60/39.12 |
| 5,056,596 | A | | 10/1991 | McKay et al. | |
| 5,109,927 | A | | 5/1992 | Supernaw et al. | |
| 5,283,001 | A | * | 2/1994 | Gregoli et al. | 516/67 |
| 5,407,009 | A | | 4/1995 | Butler et al. | |
| 5,607,016 | A | | 3/1997 | Butler | |
| 5,617,719 | A | | 4/1997 | Ginter | |
| 5,663,121 | A | * | 9/1997 | Moody | 507/102 |
| 5,743,080 | A | | 4/1998 | Ginter | |
| 5,980,840 | A | | 11/1999 | Kleefisch et al. | |
| 6,230,814 | B1 | | 5/2001 | Nasr et al. | |
| 6,289,666 | B1 | * | 9/2001 | Ginter | 60/775 |
| 6,644,334 | B2 | * | 11/2003 | Briggeman | 137/13 |
| 7,013,972 | B2 | | 3/2006 | Vinegar et al. | |
| 7,115,847 | B2 | | 10/2006 | Kinzer | |
| 7,299,868 | B2 | | 11/2007 | Zapadinski | |
| 7,341,102 | B2 | | 3/2008 | Kresnyak | |
| 7,699,104 | B2 | | 4/2010 | Tsilevich | 166/272.3 |
| 7,770,640 | B2 | | 8/2010 | Kresnyak | |
| 7,814,867 | B2 | | 10/2010 | Betzer Tsilevich | |
| 2002/0043067 | A1 | | 4/2002 | Maeda et al. | |
| 2003/0037928 | A1 | | 2/2003 | Ramachandran | |
| 2004/0219079 | A1 | | 11/2004 | Hagen et al. | |
| 2004/0238654 | A1 | * | 12/2004 | Hagen et al. | 237/12.1 |
| 2005/0060985 | A1 | * | 3/2005 | Abanades Garcia et al. | 60/274 |
| 2005/0279500 | A1 | * | 12/2005 | Heins | 166/266 |
| 2007/0202452 | A1 | | 8/2007 | Rao | |
| 2007/0215350 | A1 | | 9/2007 | Kresnyak | |

OTHER PUBLICATIONS

International Preliminary Report on Patentability and Written Opinion issued Aug. 11, 2009 in connection with corresponding International Application No. PCT/US2008/001896.

Canadian Examiner's Report dated Feb. 10, 2012.

* cited by examiner

HOT FLUID RECOVERY OF HEAVY OIL WITH STEAM AND CARBON DIOXIDE

CROSS REFERENCE TO RELATED APPLICATIONS

The present application is a 35 U.S.C. §371 National Phase conversion of PCT/US2008/001896, filed Feb. 11, 2008, which claims benefit of U.S. Provisional Application No. 60/900,587, filed Feb. 10, 2007 and of U.S. Provisional Application No. 60/925,971, filed Apr. 24, 2007, the complete disclosure of which are incorporated herein by reference. The PCT International Application was published in the English language.

BACKGROUND OF THE INVENTION

1. Field of the Invention

The present invention relates to methods of using heated gases from thermally diluted combustion to extract and/or process hydrocarbons or carbonaceous materials.

2. Description of Related Art

Global demand for fuel and petroleum products continues to increase. However, discovery of conventional oil reserves has been declining since the mid-1960s. Most remaining hydrocarbon resources are heavier oils or bitumen. This is creating a rapidly growing demand for the recovery and conversion of heavy oil, bitumen, oil sands, and shale oil or kerogen, and for Enhanced Oil Recovery (EOR) of residual higher viscosity oil in conventional reservoirs (herein collectively termed, "heavy hydrocarbons"). Such alternative or heavy hydrocarbon resources have been more difficult, complex, and expensive to convert than conventional petroleum resources.

For example, large deposits of oil sands are found in Alberta Canada, and in the Orinoco region of Venezuela, with total reserves in excess of one trillion barrels of oil equivalent (TBOE) for each. Shallow bitumen deposits are under preliminary development in Alberta. However, most bitumen in place is not considered economical using conventional surface extraction techniques.

The "energy returned on energy invested" (EROEI) strongly influences profitability. EROEI may be as high as 30:1 for conventional petroleum. However, extraction of heavy hydrocarbons is energy intensive, reducing EROEI. Energy use can exceed the energy recovered (i.e., EROEI<1.0) for shale oil recovery. Increasing depletion and maturity of many existing conventional oil fields is generating strong demand for Enhanced Oil Recovery (EOR) and for ways to improve the EROEI for heavy hydrocarbons.

Heavy hydrocarbon extraction commonly uses Steam Assisted Gravity Drainage (hereafter SAGD) to extract bitumen from subsurface oil sands, e.g., as taught by Butler in U.S. Pat. No. 4,344,485, herein incorporated by reference, and subsequent patents such as U.S. Pat. No. 6,230,814, (Nasr, et al.). The Steam Assisted Gas Push (hereinafter SAGP) technique has also been taught, e.g., in U.S. Pat. No. 5,407,009, (Butler, et al.) and U.S. Pat. No. 5,607,016 (Butler, et al.), all herein incorporated by reference. Such methods provide substantial recovery of heavy hydrocarbons.

The SAGD process injects heated steam into buried bitumen formations through horizontally drilled wells. The bitumen is heated by steam to reduce its viscosity and pump a portion of it out of geological formations, e.g., through a second parallel extraction well drilled about 5 m below the first injection well.

Carbon dioxide (hereinafter, $CO_2$) has been used to increase the extraction rate of bitumen and other heavy hydrocarbons as well as other carbonaceous materials such as carbon tetrachloride. The extraction rate can be defined as the rate at which the target material is being removed or delivered in either volume or mass terms. For example, Deo, et al., Industrial Eng. Chem. Res., Vol. 30, No. 3, pp. 532-536 (1991), detailed the specific solubility of $CO_2$ in various bitumens versus temperature and pressure. They reported decreases in viscosity with increasing solvation by $CO_2$. e.g., in Athabasca (Alberta) and Tar Sand Triangle (Utah) bitumens and other heavy hydrocarbons.

In U.S. Pat. No. 5,056,596 (McKay, et al.), herein incorporated by reference, $CO_2$ was dissolved in water at an alkaline pH (e.g., above 10.5) to enhance bitumen recovery rates. However, $CO_2$ is often difficult to obtain near heavy hydrocarbon resources. Long expensive pipelines are typically used to deliver $CO_2$.

The significant decrease in the viscosity of bitumen with increasing solvation by $CO_2$ and/or at increasing temperatures results in higher heavy hydrocarbon extraction efficiencies by delivering $CO_2$. It is desirable to improve delivery of $CO_2$ and steam to enhance the extraction rate of heavy hydrocarbons.

Natural gas is relatively abundant and commonly used to heat heavy hydrocarbons and for power requirements in Western Canada's oil fields and oil sands processing. However, natural gas would be better spent for premium applications requiring very low emissions. A catalytic desulfurization process or "Claus Process", e.g., as described in U.S. Pat. No. 4,388,288, (Dupin), herein incorporated by reference, is used to remove the sulfur from natural gas, e.g., as hydrogen sulfide, $H_2S$.

Heavy hydrocarbons including bitumen are similarly desulfurized during refining to synthetic crude oil. With high transportation costs, the Northern Alberta market for elemental sulfur appears saturated. Millions of tons of sulfur and/or coke are being stockpiled in the open air in Western Canada. A process to utilize sulfur and/or coke with local raw materials to increase heavy hydrocarbon extraction efficiency is therefore desirable.

For example, to improve extraction, radio-frequency, (hereinafter, "RF" including microwave) heating of hydrocarbons in situ is taught by Supernaw, et al. in U.S. Pat. No. 5,109,927, and by Kinzer in U.S. Pat. No. 7,115,847, both herein incorporated by reference.

Currently known solutions present additional inefficiencies. Among these, latent heat in flue gas is commonly lost to the atmosphere. Also, steam boilers typically require purified water. Water cleanup alone may form 80% of SAGD capital costs. Improvements to the SAGD (or SAGP) process are desirable to increase the economic recovery of heavy hydrocarbons, e.g., by accessing deeper formations in an energy efficient manner, by increasing the percentage of bitumen recoverable from a given depth, by reducing capital costs, and/or reducing the energy costs of hydrocarbon extraction processes.

Water has been used to control the combustion temperature and pollutant emissions in gas turbines for power production and other purposes (e.g., clean water production) as described in U.S. Pat. No. 3,651,461 (Ginter), U.S. Pat. No. 5,743,080 (Ginter), U.S. Pat. No. 5,617,719 (Ginter), U.S. Pat. No. 6,289,666 (Ginter), U.S. patent application Ser. No. 10/763,047 (Hagen et al.), and U.S. patent application Ser. No. 10/763,057 (Hagen et al.), all herein incorporated by reference. Some other related art suggests that adding water during combustion reduces nitrogen oxide (NOx) emissions but increases carbon monoxide (hereinafter, CO) emissions. Ginter and/or Hagen et al. teach methods of delivering water and/or steam which can improve both CO and NOx emissions in the above-mentioned descriptions of VAST (Valued Added Steam Technology) combustion and thermodynamic cycle technologies.

The higher heat capacity and improved control of diluent in VAST combustors or thermogenerators enable more precise control of the combustion temperature and other combustion parameters. Combustion of dirty fuel (e.g., crude oil) has been demonstrated in a VAST wet combustor or thermogenerator. VAST technologies can recycle exhaust heat with steam and/or liquid water, giving substantial improvements in efficiency of wet cycle gas turbines. The use of alternative fuels and more efficient energy use to extract heavy hydrocarbons would be desirable.

SUMMARY OF THE INVENTION

The formation and delivery of wet combustion "flue gas" or VASTgas to extract heavy, viscous or difficult to extract hydrocarbons from formations or mined materials containing them is described in this invention. This can potentially improve the efficiency of heat transfer between the combustion system and the heavy hydrocarbons in question, and/or reduce the amount of heat required for a given amount of heavy hydrocarbon extraction. It may provide greater flexibility in the composition of VASTgas delivered in response to changing extraction requirements over the duration of the extraction process. The term VASTgas is used generally herein to refer to products of wet combustion comprising water and/or carbon dioxide as thermal diluent, both for specific examples, and generically referring to one or more gases of various compositions.

BRIEF DESCRIPTION OF THE DRAWING(S)

These and other features and advantages of the present invention will become apparent from the following description of the invention which refers to the accompanying drawings, wherein like reference numerals refer to like structures across the several views, and wherein:

FIG. 1 schematically illustrates a water-cooled thermogenerator delivering pressurized VASTgas;

FIG. 2 schematically illustrates a VAST Diverted Gas Turbine delivering pressurized process VASTgas;

FIG. 3 schematically illustrates a VAST Direct Gas Turbine delivering pressurized process VASTgas;

Figure 9:
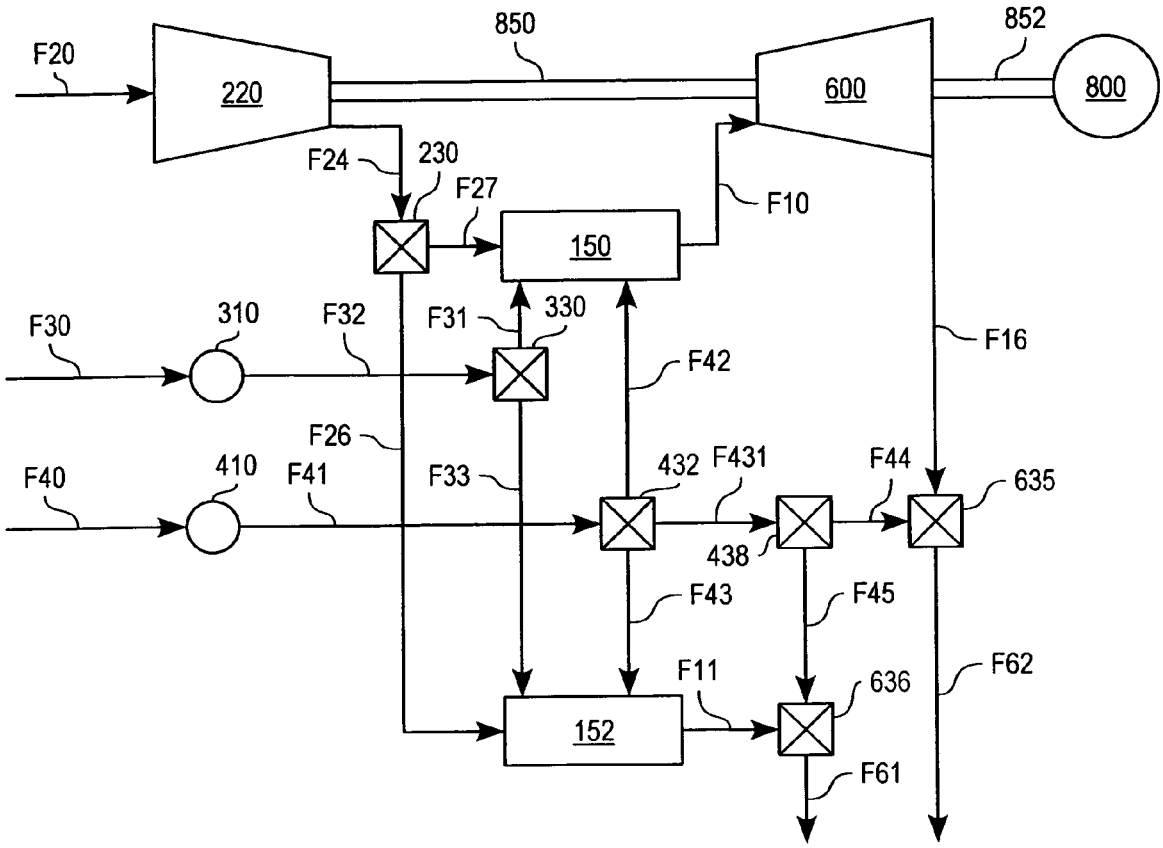
Figure 10:
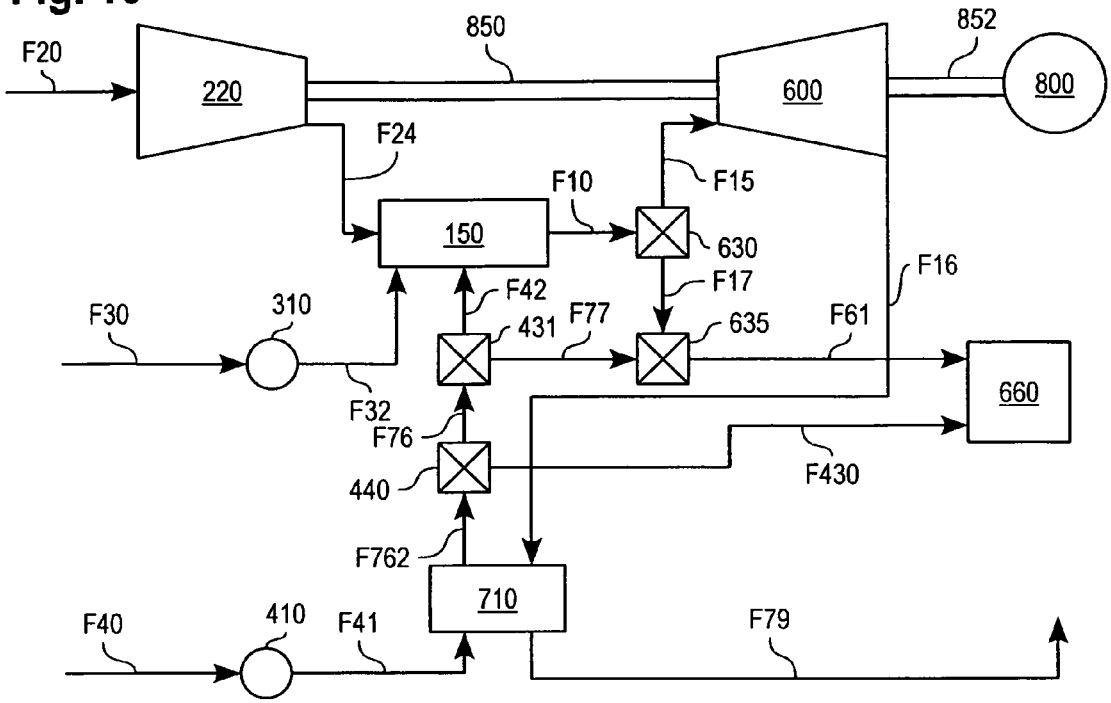
Figure 11:
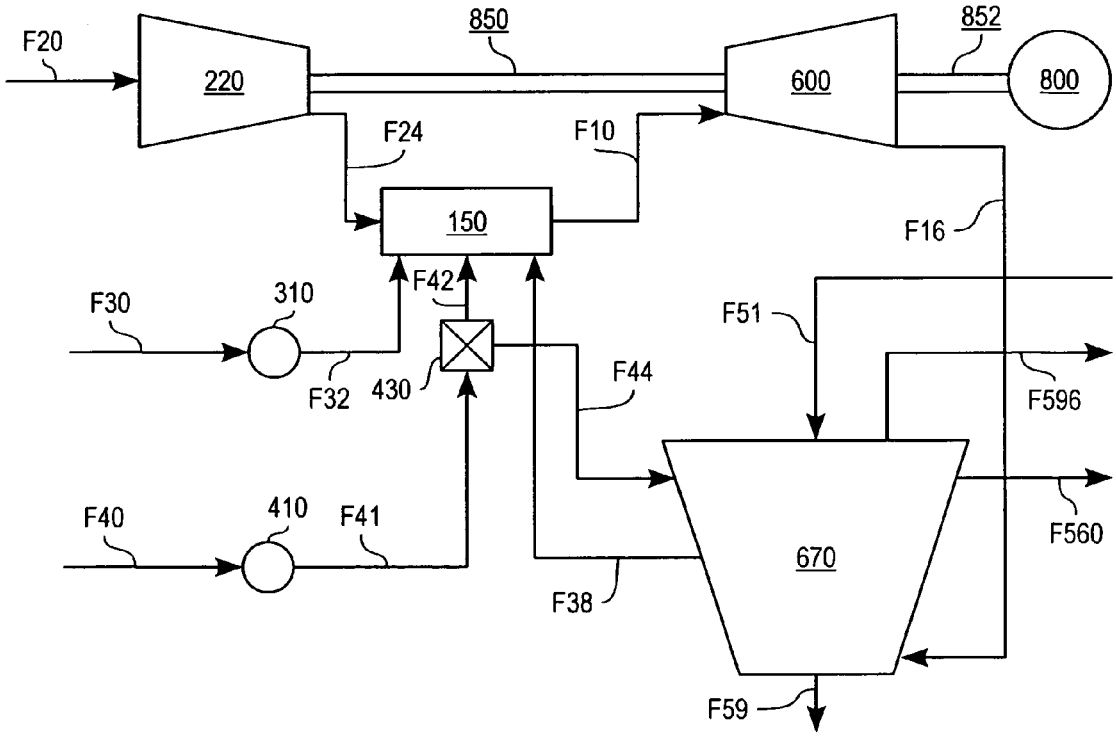
Figure 12:
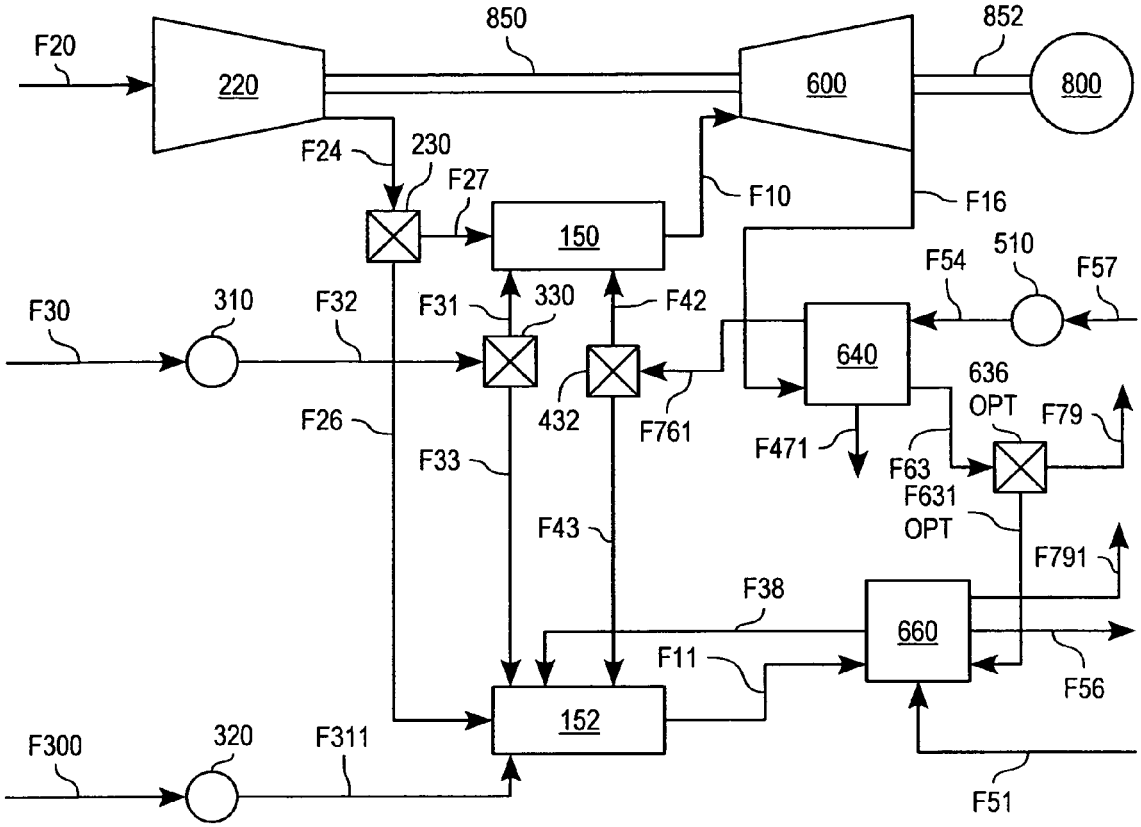
Figure 13:
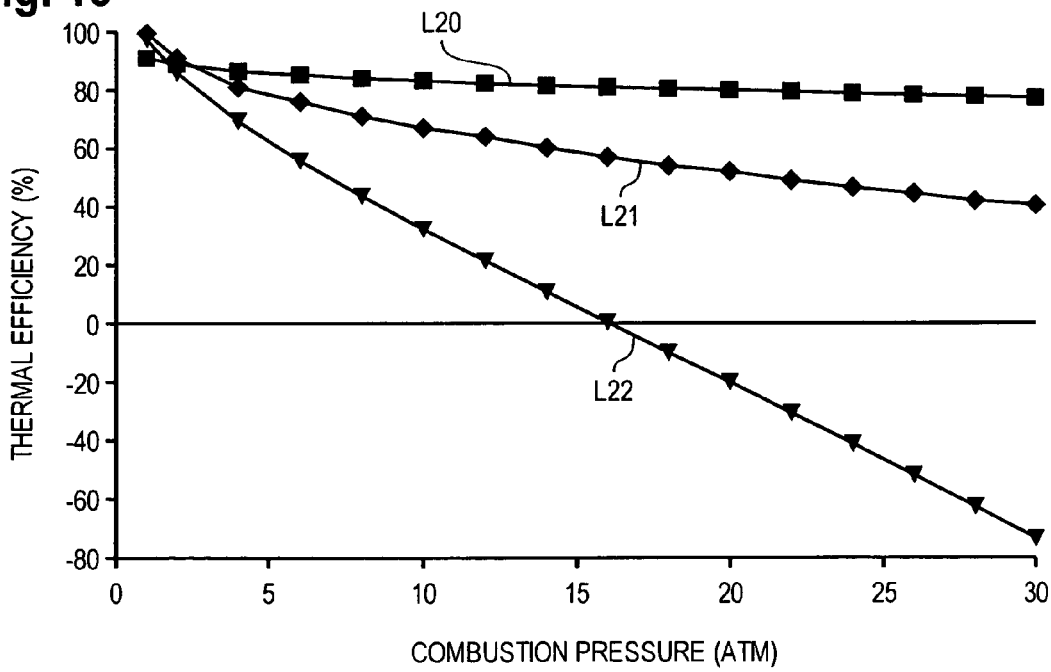
Figure 14:
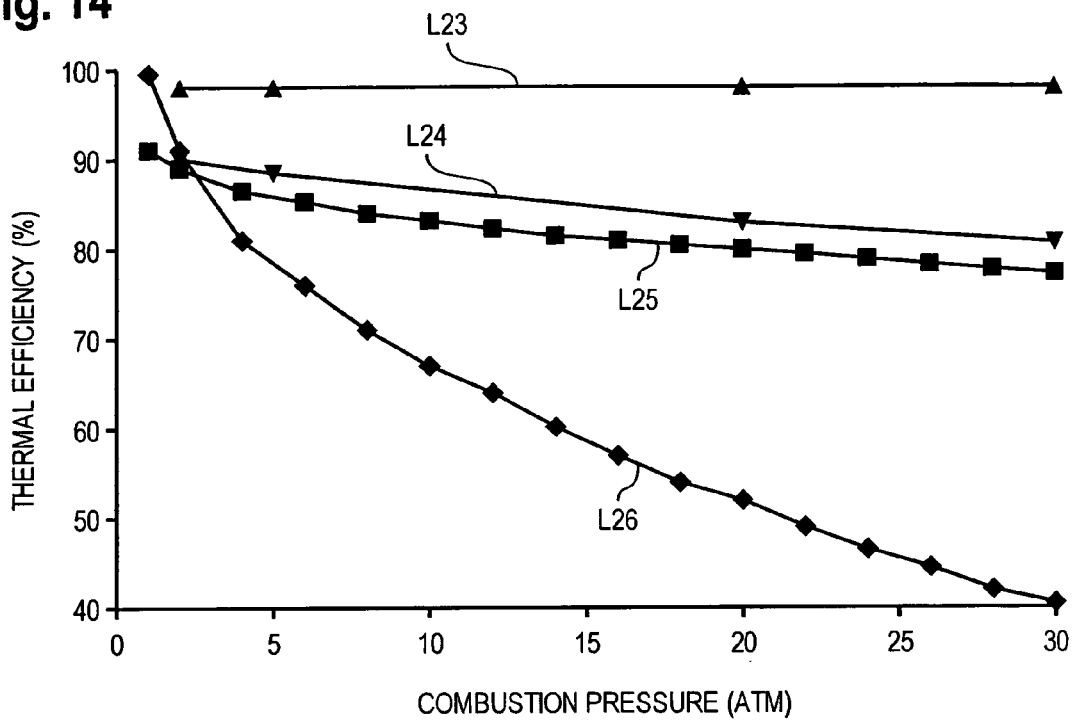
Figure 15:
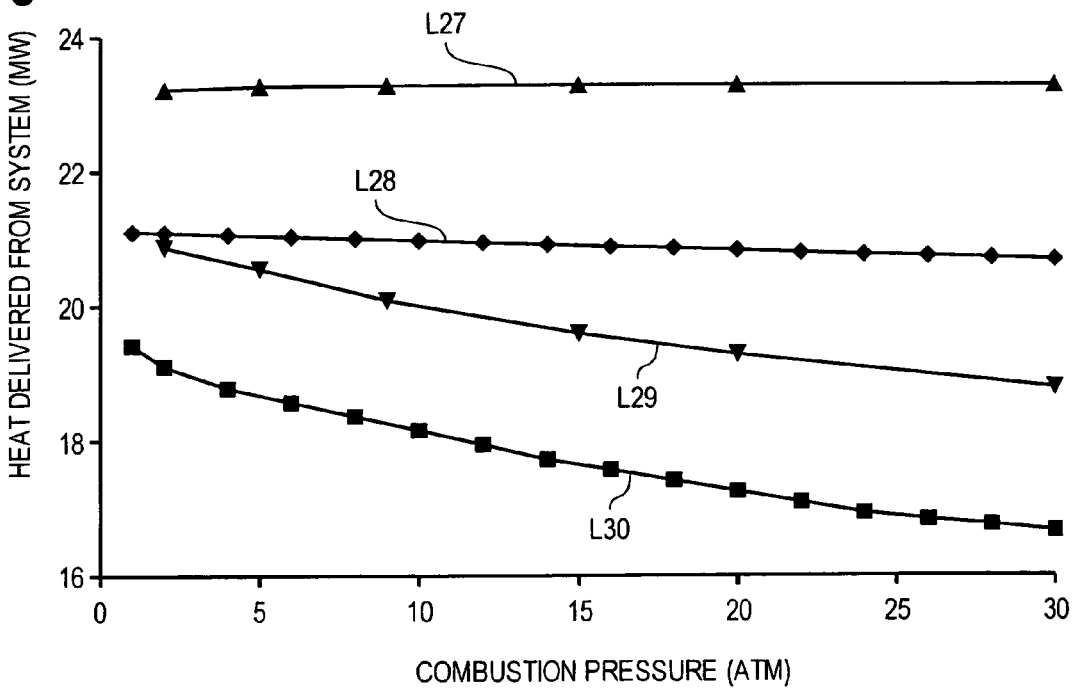
Figure 16:
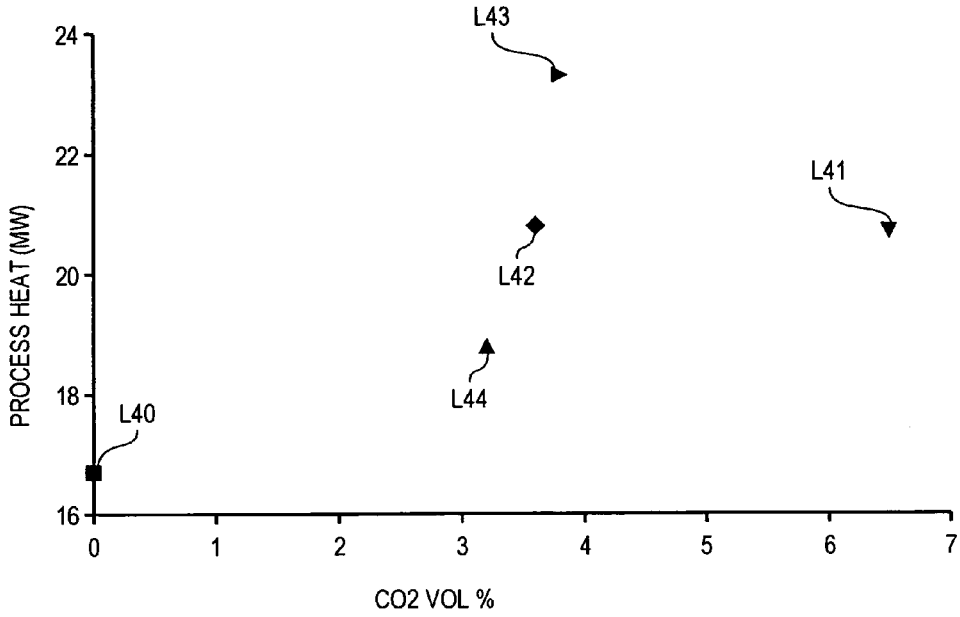
Figure 17:
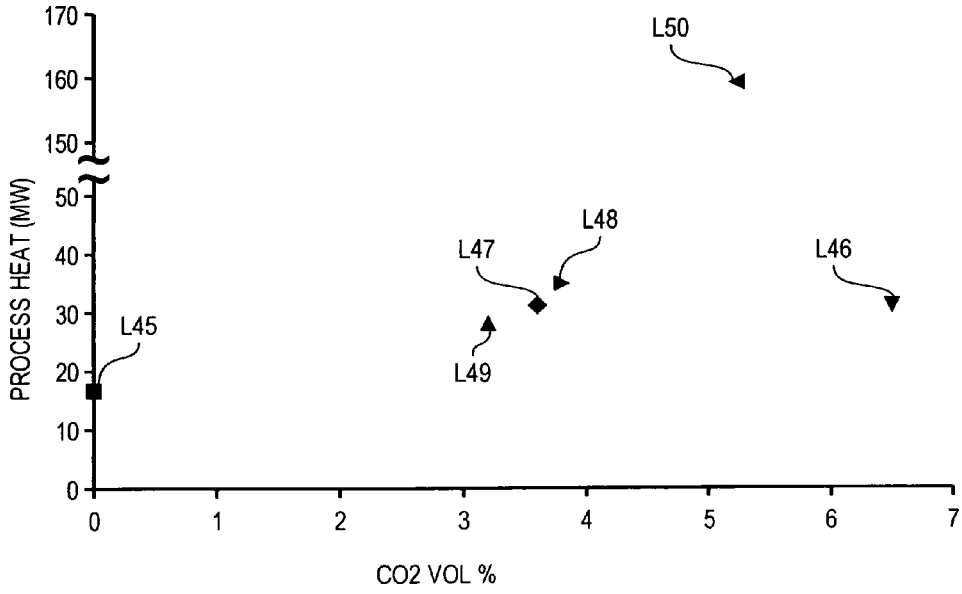
Figure 18:
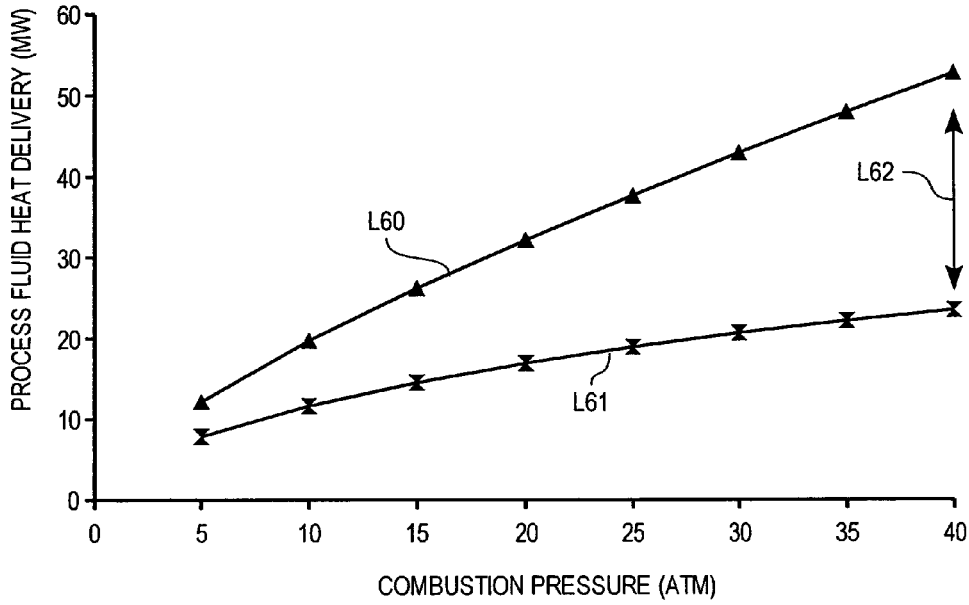
Figure 19:
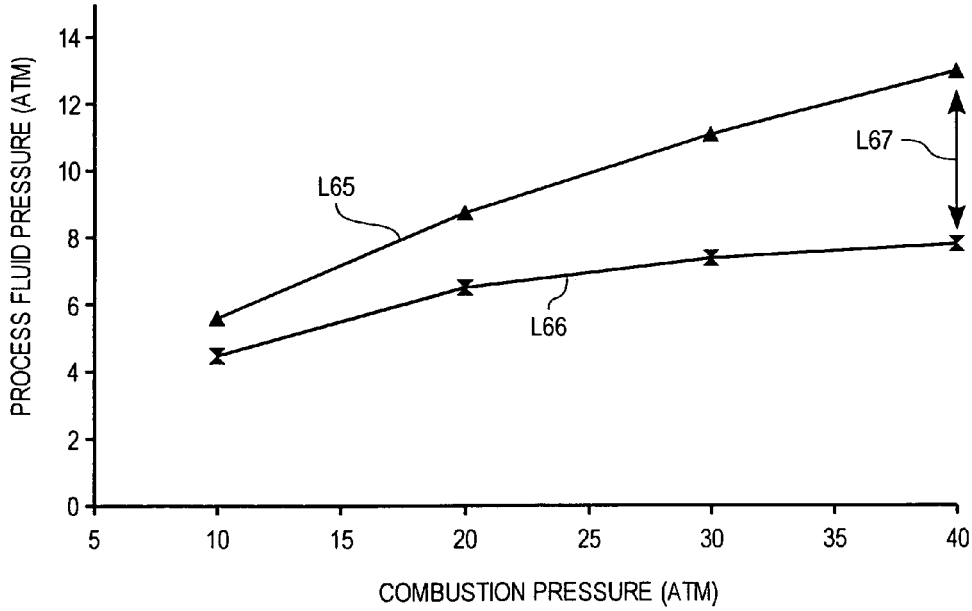
Figure 20:
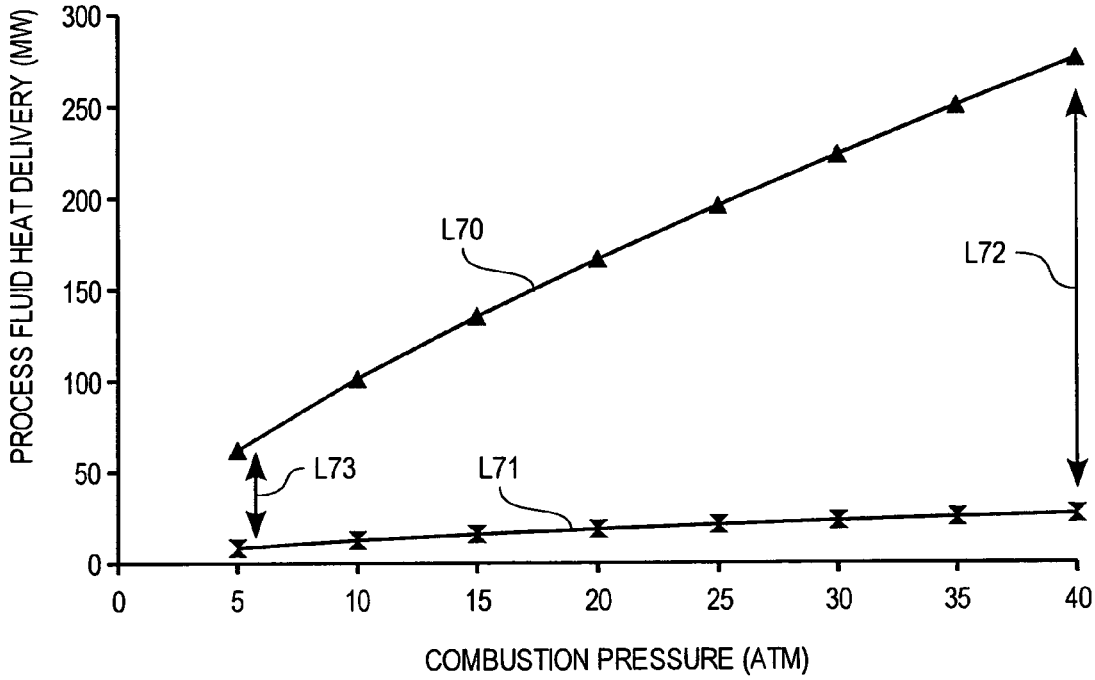
Figure 21:
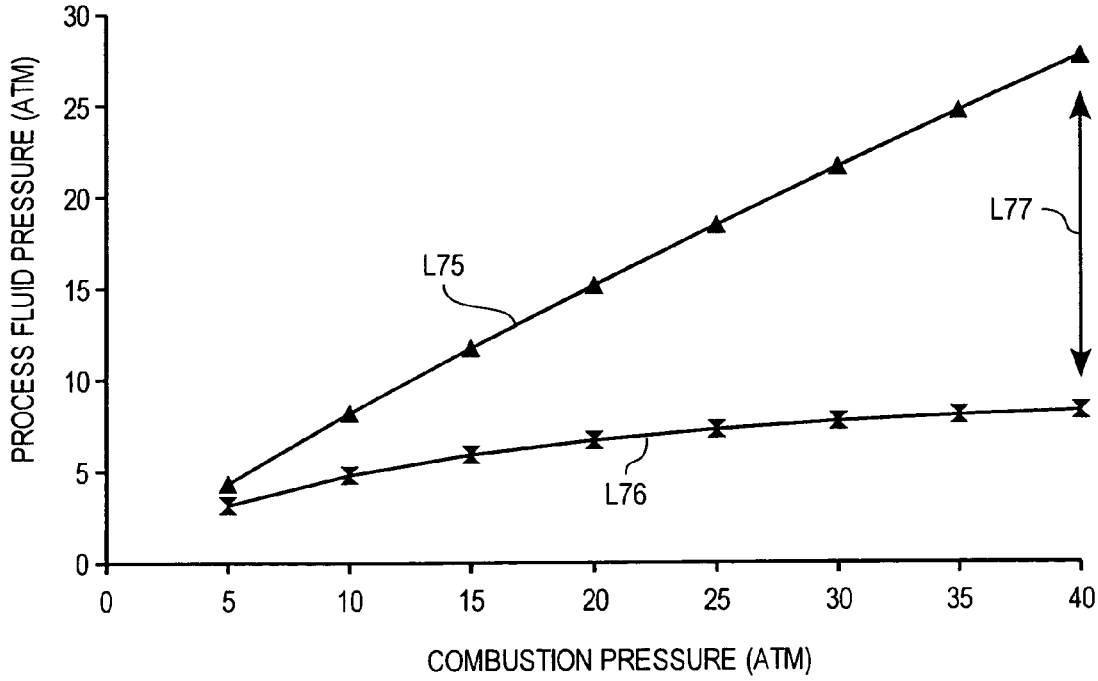
Figure 22:
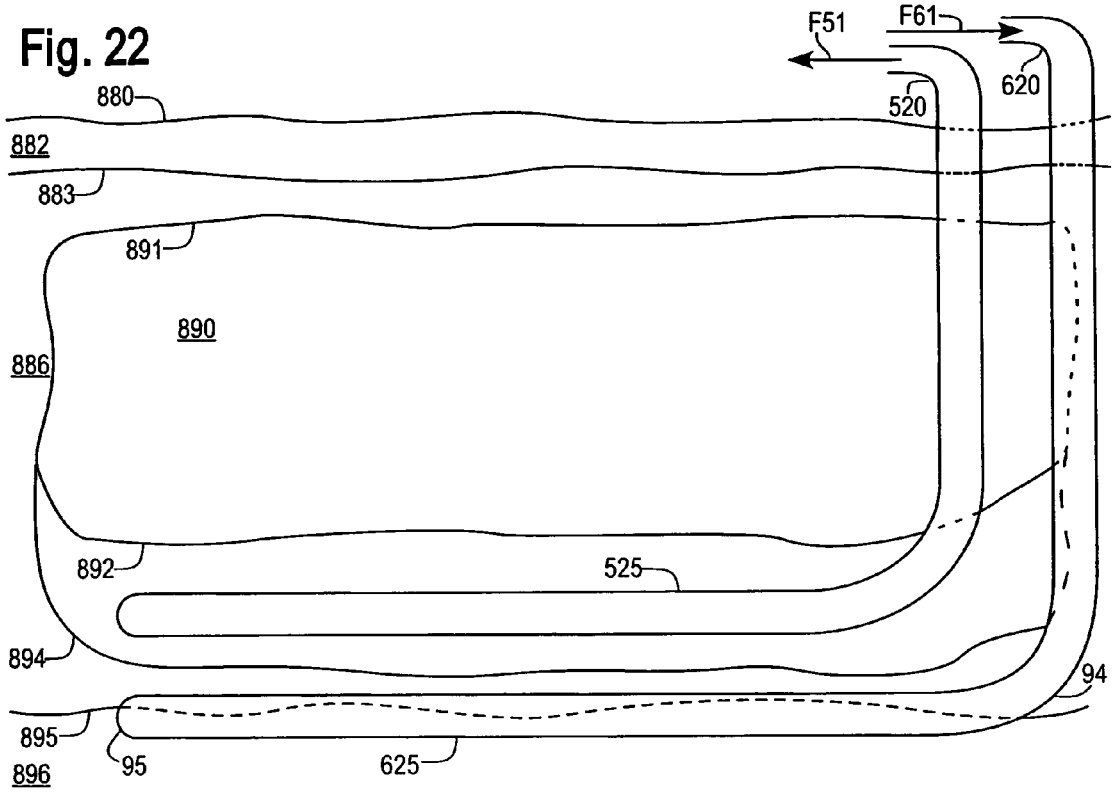
Figure 23:
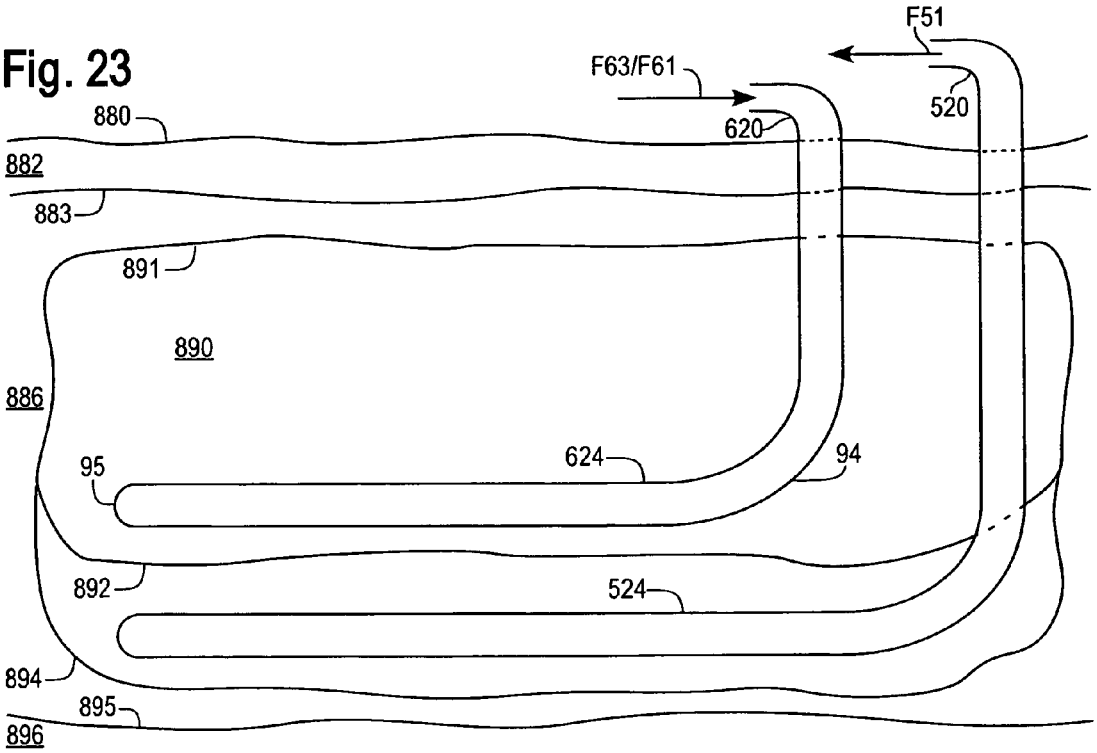
Figure 24:
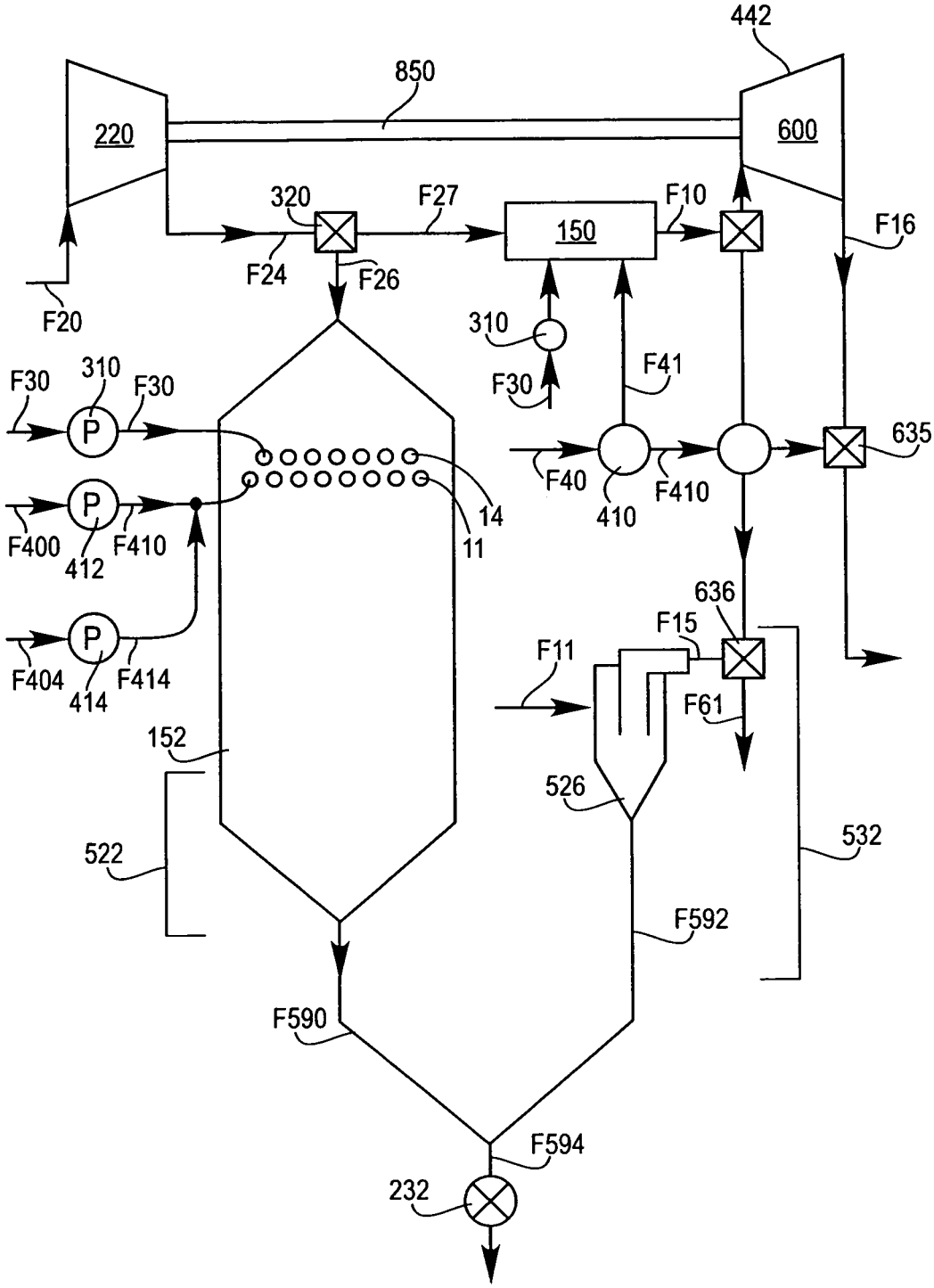
Figure 25:
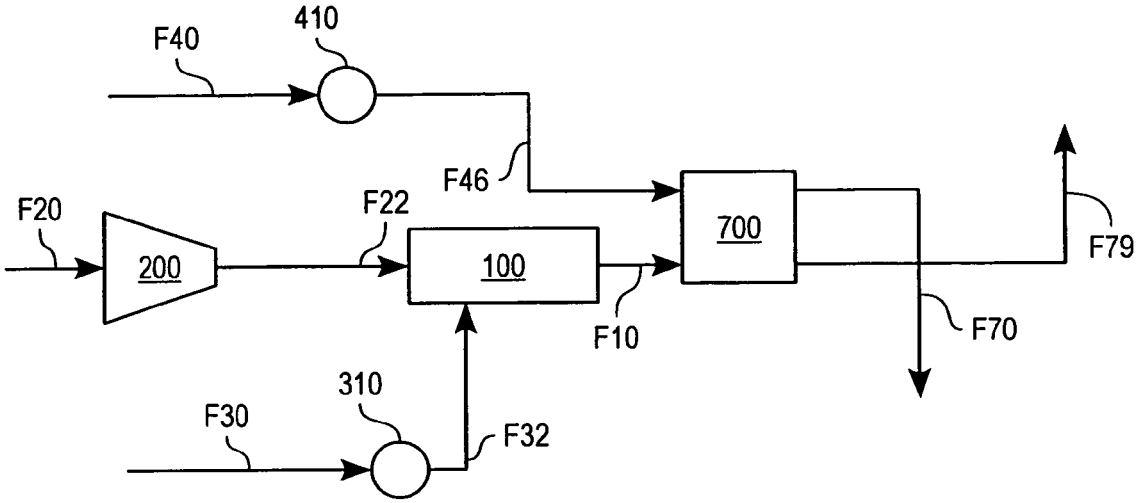

FIG. 9 schematically illustrates a VAST Direct Gas Turbine with a parallel thermogenerator delivering process VASTgas and electricity;

FIG. 10 schematically illustrates a VAST Diverted Gas Turbine delivering process VASTgas and hot water to process heavy hydrocarbon containing materials;

FIG. 11 schematically illustrates a VAST Direct Gas Turbine delivering process VASTgas and electricity to process mined heavy hydrocarbon containing materials;

FIG. 12 schematically illustrates a VAST Direct Gas Turbine delivering low and high pressure process VASTgas and electricity to process and extract heavy hydrocarbon containing materials;

FIG. 13 illustrates the system thermal efficiency of VAST thermogenerator versus a boiler;

FIG. 14 illustrates the system thermal efficiency of process VASTgas from VAST Thermogenerator, Direct Gas Turbine and Diverted Gas Turbine versus a boiler;

FIG. 15 illustrates the total heat delivered from VAST thermogenerator, Diverted Gas Turbine and Direct Gas Turbine versus a boiler;

FIG. 16 illustrates $CO_2$ versus process heat delivery flow for VAST configurations compared with a SAGD boiler at constant fuel flow;

FIG. 17 illustrates $CO_2$ versus process heat delivery for VAST configurations compared with a SAGD boiler at constant combustor mass flow;

FIG. 18 illustrates the process fluid heat delivery for Brayton cycle vs. Diverted VAST gas turbines, varying fuel with air at constant turbine inlet temperature and size;

FIG. 19 illustrates the process fluid heat delivery for Brayton cycle vs. Direct VAST gas turbines, varying fuel with air at constant turbine inlet temperature and size;

FIG. 20 illustrates the process fluid heat delivery for Brayton cycle vs. Direct VAST gas turbines, varying fuel with oxygen at constant turbine inlet temperature and size;

FIG. 21 illustrates the process fluid pressure for Brayton cycle vs. Direct VAST gas turbines, varying fuel with oxygen at constant temperature and size;

FIG. 22 schematically illustrates a Sulfur Oxide Injected into Limestone for Carbon dioxide Assisted Push (SOILCAP) method;

FIG. 23 schematically illustrates a SOILCAP 2-stage process using injected limestone slurry;

FIG. 24 schematically illustrates a VAST Direct GT with a method to separate contaminants from the hot gas stream; and FIG. 25 schematically illustrates a prior art boiler with heat recovery steam generator for heavy hydrocarbon extraction.

DETAILED DESCRIPTION OF EMBODIMENTS OF THE INVENTION

Thermogenerator VASTgas for Heavy Hydrocarbon Extraction

In one embodiment, a VAST thermogenerator or combustor may combust fuel with oxidant fluid, such as air or oxygen, and thermal diluent such as water, to deliver a process fluid by VAST wet combustion VAST gases (hereinafter "VASTgas"). Following are examples of using high water to fuel ratios to produce VAST wet combustion VAST gases (hereinafter, "VASTgas") for heavy hydrocarbon extraction and/or processing. Such VASTgas has beneficially high water and/or carbon dioxide content.

EXAMPLE 1

100° C. Atmospheric VASTgas from Burning Natural Gas with Air (W/F=Omega, $\omega$=10.6)

Figure 1:
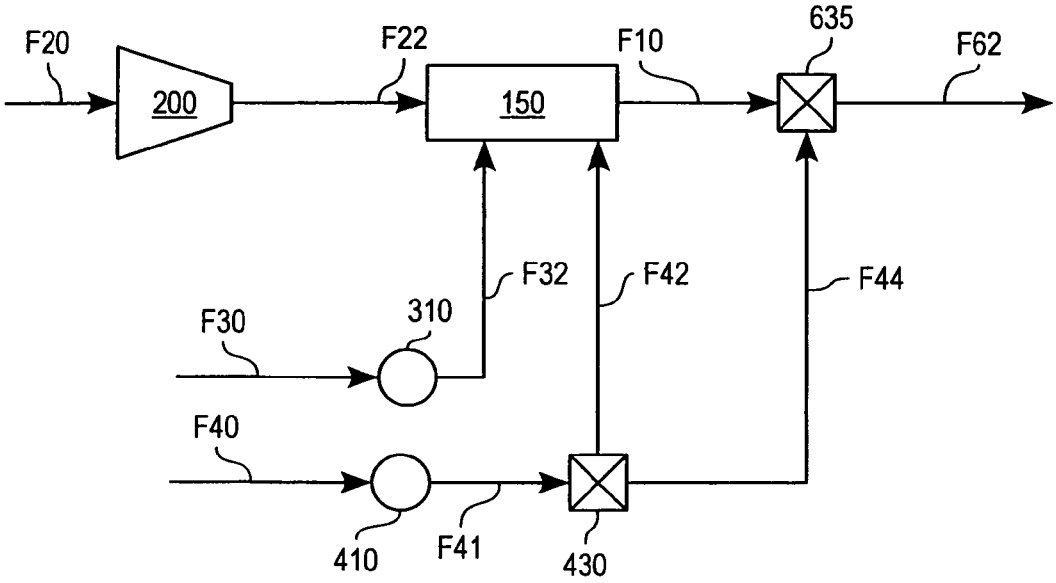

Referring to FIG. 1, in one embodiment, a reactant or fuel F30 is pressurized by a suitable reactant pressurizer, compressor or pump 310 to form a pressurized reactant F32 that is delivered to a VAST combustor or thermogenerator 150. Fuel F30 may comprise a gaseous fuel such as natural gas, producer gas, syngas, and/or a liquid fuel such as diesel fuel, propane, "dilbit" crude oil, kerogen, bitumen, powdered coke, or other fuel. In some configurations, Fuel F30 may be a fuel fluid comprising a thermal diluent, e.g. a water as a mist with gaseous fuel, a slurry with powdered fuel, or an emulsion with liquid fuel. In particular, emulsions may reduce the viscosity of heavy oil. Oxidant containing fluid F20 may be pressurized by a oxidant pressurizer, blower, or compressor 200 to deliver pressurized oxidant containing fluid F22 to thermogenerator 150. The oxidant containing fluid comprises oxygen, typically air, and/or oxygen enriched air or it may be oxygen. Thermal diluent F40 is correspondingly pressurized by diluent pressurizer 410 to form pressurized diluent F41. Thermal diluent F40 may comprise water.

A first portion of pressurized diluent, F42, may be delivered upstream of the outlet of combustor 150 to control the temperature within the combustor and of the hot combustor VASTgas F10 exiting the outlet of combustor 150, comprising products of combustion and thermal diluent (e.g., Carbon dioxide and steam, with portions of nitrogen and argon from the inlet oxidant F22). A second portion of pressurized diluent, F44, may be mixed with the combustor VASTgas F10, in a mixer or direct contact heat exchanger 635 to form a process VASTgas F62. Process VASTgas 62 may also be used to facilitate processing mined heavy material to separate heavy hydrocarbons. Referring to FIG. 23, one or both of high pressure VASTgas F61 and low pressure VASTgas F62 may be delivered to wellhead 620 penetrating through ground surface 882 into a heavy hydrocarbon resource 886 via downhole injection well 624 from "heel" 94 to "toe" 95, to help mobilize and extract heavy hydrocarbons from underground resource 886.

In some configurations, fuel F32 may be combusted in a VAST combustor or thermogenerator 150 with a modest amount of air or oxidant F22, e.g., in excess of stoichiometric requirements. Water F42 is delivered upstream of the combustion system outlet to form VASTgas comprising products of combustion and steam. In one configuration, the flow of water is controlled to deliver low pressure process VASTgas F62 with a temperature of about 100° C. The VASTgas may be delivered to heat and extract heavy hydrocarbons from surface mined oil sands.

In one configuration, an atmospheric VAST thermogenerator 150 may be operated to burn natural gas and to deliver VASTgas F10, and/or cooled VASTgas F62 at a prescribed temperature between about 100° C. (212° F.) and 1500° C. (2732° F.). For example, utilizing some ratio of thermal diluent to fuel while adjusting for the ratio of oxidant fluid to fuel, e.g., the ratio water and/or steam to fuel. The portion of excess oxidant (or air) may be selected as desired while adjusting the VASTgas temperature with diluent. The combustion temperature may be selected to achieve desired degree of combustion and low emissions while separately controlling the temperature of the delivered VASTgas F62. For example, stable combustion in a VAST progressive thermogenerator has been demonstrated down to about 600° C. (1,112° F.).

TABLE 1

| Thermogenerator performance at 1, 30 atm on air & $O_2$ vs. boiler on air | | | | | | |
|---|---|---|---|---|---|---|
| | Boiler Varying process fluid pressure | | | VAST Thermogenerator Varying oxidant type and Process fluid pressure | | |
| Oxidant at 15° C. (59° F.) and 1 atm (14.7 psi) | | | | | | |
| Type | Air | Air | Air | Air | $O_2$ | $O_2$ |
| Mass Flow kg/s (lb/s) | 17.2 (38.0) | 17.2 (38.0) | 8.2 (18) | 8.2 (18) | 8.2 (18) | 8.2 (18) |
| Fuel at 25° C. (77° F.) and 1 atm (14.7 psi) | | | | | | |
| Mass Flow kg/s (lb/s) | 0.45 (1.0) | 0.45 (1.0) | 0.45 (1.0) | 0.45 (1.0) | 2.07 (4.7) | 2.07 (4.7) |
| Diluent at 15° C. (59° F.) and 1 atm (14.7 psi) | | | | | | |
| Mass Flow kg/s (lb/s) | 7.3 (16.1) | 6.0 (13.3) | 7.7 (17.0) | 8.5 (18.7) | 36.2 (79.7) | 40.5 (89.3) |
| Process Fluid | | | | | | |
| Temperature ° C. (° F.) | 100 (212) | 234 (453) | 100 (212) | 234 (453) | 100 (212) | 234 (453) |
| Pressure atm (psi) | 1 (14.7) | 30 (441) | 1 (14.7) | 30 (441) | 1 (14.7) | 30 (441) |
| Mass Flow kg/s (lb/s) | 7.2 (15.9) | 6.0 (13.2) | 16.3 (36.0) | 17.1 (37.7) | 46.4 (102) | 50.7 (112) |
| Heat Flow MW (kBtu/s) | 18.9 (17.9) | 16.3 (15.5) | 23.2 (22.0) | 28.7 (26.6) | 105.9 (100.4) | 110.5 (104.8) |
| $CO_2$ mol % | 0 | 0 | 3.6 | 3.4 | 5.1 | 4.6 |
| $H_2O$ mol % | 100 | 100 | 65.3 | 67.2 | 94.0 | 94.6 |
| Other | | | | | | |
| System Efficiency | 89% | 76% | 99% | 41% | 99% | 89% |
| Auxiliary Power kW | 79.7 | 110.1 | 37.5 | 4,936.8 | 51.7 | 4,901.0 |
| Combustion Temperature | 1035° C. (1895° F.) | | | | | |

For example, in one configuration of the embodiment of FIG. 1 detailed in Table 2, fuel may be combusted with a small amount of excess air at about 1035° C. (1895° F.) to form combustor VASTgas F10. More specifically, at about 5% over the oxidant required for stoichiometric combustion of the natural gas fuel, i.e., at a "ratio to stoichiometric combustion" or relative oxidant ratio of 105% (hereinafter lambda (λ)) =1.05. The process VASTgas F62 may be delivered down to about 100° C. and nominally at about one atmosphere. In a second configuration documented in Table 2, process VASTgas F62 may be delivered at about 482.2° C. (900° F.) using small amount of excess air and suitable portions of water.

The resulting mole or volume percent compositions (hereinafter, v %) of input gases/fuel and VASTgas or conventional dry combustion "flue gas" outputs are shown in Table 1. The input flow rate of fuel, was nominally set at about 0.45 kg/s (1 lb/s) of natural gas. Air was delivered at about 8.18 kg/s (e.g., for Lambda=1.05). The total water delivered was about 4.82 kg/s in these configurations, producing a water to fuel ratio (W/F, hereinafter, omega ω) of about 10.6 by mass. The input fluid flow temperatures were nominally set to about 15° C. for air F20, and water F40, and 25° C. for fuel F30. The relative humidity of the input air F20 was assumed about 60%. The pressure of the delivered water F42 and fuel F32 in this and subsequent examples described in this invention is delivered at a pressure somewhat higher than the combustion chamber pressure in order to enable injection into the chamber and delivery of VASTgas to the outlet.

In the second configuration, about 5.5 kg/s of additional water F44 at 15° C. was added to the combustion VASTgas F10 after exiting the combustor with a direct contact heat exchanger 635 to reduce their temperature nominally from a combustion temperature of about 1035° C. down to a process VASTgas F62 delivery temperature of about 100° C. (giving a total water flow of about 7.73 kg/s). This provided a high amount of steam in the VASTgas and a near minimum temperature of the process VASTgas F62 without causing condensation. The total water delivered to the combustor and/or added downstream to form the VASTgas may be controlled according to prescribed temperature requirements or limits for heavy hydrocarbon processing and/or extraction. Within such prescribed extraction temperature limits, and desired combustion temperatures, the VASTgas F62 temperature is fully adjustable by the amount of water added.

In another configuration, thermal diluent or water flows may be controlled relative to fuel to provide a combustion temperature of about 1035° C. (1895° F.). The same process fluid flow, process fluid composition, and process heat may be produced with a similar system thermal efficiency was the same as the case of 482.2° C. combustion (same amount of fuel and same fuel/air ratio). For the case of 1035° C. combustion, the water flow F32 to the combustor was about 2.18 kg/s (ω=4.8). Then about 5.55 kg/s (total water flow=7.73 kg/s) of water may be added to the hot fluid F44 to provide a process VASTgas F62 of about 100° C.

Referring further to the VAST combustor shown schematically in FIG. 1, another configuration may produce VASTgas at about 30 atm with a combustion nominally at about 1035° C. More specifically, a thermoeconomic model with 30 atm combustion at 0.45 kg/s (1 lb/s) natural gas fuel produces about 15.9 kg/s of process fluid flow with a process heat flow of 20.7 MW and a system thermal efficiency to the wellhead of 41%. For the configuration of FIG. 1, pressurized air may be provided by a typical air compressor operated by externally sourced electricity. This electricity is assumed to be provided by combustion of additional fuel at a thermal efficiency of 40%. The resulting energy consumption to compress air is the principal reason for the lower total system thermal efficiency, i.e., 99% thermal efficiency to the wellhead for 1 atm combustion vs. 41% for 30 atm combustion, respectively. Referring to FIG. 1, parameters for some VAST Thermogenerator configurations are shown in Table 1 for 1 and 30 atm on air and oxygen, compared to a relevant art steam boiler heated by air combustion of natural gas.

Herein, the system thermal efficiency is defined as the difference in enthalpy of the process fluid delivered, and the enthalpy of process fluid at ambient conditions (1 atmosphere and 15° C.) divided by the heat of combustion of fuel relative to ambient conditions (higher heating value at 1 atmosphere and 15° C.). The process fluid enthalpy is measured at the outlet of the system producing the process fluid just prior to the wellhead or the process fluid distribution system.

EXAMPLE 2

1 Atm VAST Cycle Burning Coke Fuel (Water/Fuel Omega ω=7.1)

Further referring to FIG. 1, some configurations may use coke as fuel F30 in an atmospheric VAST cycle burner, with the same input fluid flows F20 and F30 as before. Diluent flows F42 and F44 may be adjusted to provide a nominal combustion temperature of 1035° C. and to give process VASTgas fluid F62, process heat flow and process fluid composition at about 482.2° C. The input gas and process VASTgas F62 compositions for configurations using coke versus natural gas (NG) are shown in Table 2.

In these configurations, the coke composition was assumed to be 79.7% C, 4.47% S, 2.3% H, 10.6% H2O, 0.27% ash. Water diluent was used with a small amount of excess air, e.g., about 5% over the amount required for stoichiometric combustion of the natural gas fuel, or lambda λ=1.05. The corresponding mole fraction compositions of input gases/fuel and VASTgas outputs are shown in Table 2. For this example, the input flow rates of fuel, air and water were 0.45 kg/s, 5.32 kg/s, and 3.20 kg/s, respectively, giving a water/fuel ratio omega ω of 7.1. The input fluid flow temperatures were 15° C. for air and water and 25° C. for the fuel.

In a further configuration, the process fluid (VASTgas) temperature is adjusted to about 100° C. by adding 1.86 kg/s of water (total water flow=5.07 kg/s) to the combustion gases to reduce their temperature from about 482.2° C. (900° F.) to 100° C. e.g., to increase the amount of steam in the VASTgas and to reduce the exhaust temperature without causing condensation. The $CO_2$ content of the process VASTgas F62 using coke fuel is about 8.37 v % at about 482° C. (900° F.) and about 6.50 v % after adjusting water to about 100° C. This compares with about 4.64 v % $CO_2$ for burning natural gas (hereinafter, NG) fuel to form process VASTgas F62 at 482° C. (900° F.) or 3.63 v % after water to reduce the VASTgas F62 temperature to 100° C. By contrast, burning natural gas and air diluting to about 482.2° C. has about 1.83 v % $CO_2$, and diluted to 100° C. has about 0.33 v % $CO_2$. Dry combustion of coke has 0.55 v % and 3.15 v % $CO_2$ respectively at 100° C. and 482.2° C. (Dry NG combustion at 1035° C. has about 4.3 v % $CO_2$.) VASTgas (with relative oxidant at about Lambda 1.05) over this temperature range has greater than about 3.16 v % $CO_2$, as does process VASTgas. In other configurations, VASTgas will have more than 4.4 v %, or 6.0 v % for a range of fuels and temperatures.

Other configurations may use diesel fuel or other hydrocarbon fuel to deliver process VASTgas F62 with a $CO_2$ content somewhere between the two extremes of natural gas (NG with very high hydrogen content, i.e. ~4:1 H:C, containing about 25% H by mass) and coke (with very low hydrogen content. e.g., less than about 3% by mass). Such configurations may be adapted to use variable fuel mixtures to adjust the concentration of $CO_2$ in process VASTgas F62 across a range of a factor of about 2. Higher concentrations may be obtained by injecting additional $CO_2$ from other sources. Coke is a relatively inexpensive fuel formed as a byproduct of the refining of bitumen to synthetic crude in Alberta. The burning of such a high carbon fuel in a VAST cycle produces a relatively high fraction of $CO_2$ in the VASTgas. This may correspondingly increase the recovery rate of heavy hydrocarbons by delivering such process VASTgas F62. While high $CO_2$ production is conventionally considered a disadvantage for coke, its use in a VAST cycle changes this perceived disadvantage into an advantage by enhancing heavy hydrocarbon extraction efficiency as compared to the "cleaner burning" natural gas.

Bitumen or other heavy hydrocarbons extracted from a well (or other source such as a mine) may be used directly as fuel F30 to produce more process VASTgas F62. Where heavy hydrocarbon is being extracted from a well using VASTgas F62 to perform the extraction, a portion of the heavy hydrocarbon extracted may be used as fuel F30 for the extraction. Bitumen and many other heavy hydrocarbons have a higher carbon content than natural gas. The heavy hydrocarbon residue left-over in wells after conventional primary extraction, is sometimes called "bitumen". Correspondingly the $CO_2$ fraction of the VASTgas formed by combusting such intermediate fuels would be higher than that listed in Table 1 for NG but lower than that listed for coke. Using recovered heavy hydrocarbons so extracted as fuel F30 for further heavy hydrocarbon extraction, may contain residual dissolved $CO_2$ which would provide additional $CO_2$ in the combustion chamber when burned. This would further increase the amount of $CO_2$ in the VASTgas and the resulting extraction efficiency.

Table 2, below, reflects diluted "wet combustion" to VASTgas vs. dry combustion to "flue gas" at 1 atm. More specifically, VAST cycle atmospheric combustion of NG or coke with input and output fluid flow compositions delivering VASTgas at 482° C. or 100° C. (coke $\lambda$=1.05, $\omega$=7.1; NG $\lambda$=1.05, $\omega$=10.6) is compared with dry combustion forming flue gas at 1035° C. or 100° C. The water concentration with dry combustion of NG in air (60% RH) diluted to 482.2C (900F) results in about 4.45 v % water, while cry combustion of coke in air is about 2.1 v %.

| | INPUT GASES/FUEL | | | OUTPUT GASES | | | | | |
|---|---|---|---|---|---|---|---|---|---|
| | | | | VAST | VAST | VAST | VAST | Flue Gas | Flue Gas |
| Atom or Molecule | Coke v % at 25° C. | NG Fuel v % at 25° C. | Air v % at 15° C. RH60% | Gas v % at 482° C. (coke) | Gas v % at 100° C. (coke) | Gas v % at 482° C. (NG) | Gas v % at 100° C. (NG) | v % at 482° C. (NG) | v % at 100° C. (NG) |
| $O_2$ | | 0.07% | 20.7% | 1.0% | 0.8% | 1.1% | 0.9% | 16.8% | 20.1% |
| $N_2$/Ar | | 3.6% | 78.2% | 39.2% | 30.6% | 38.5% | 30.2% | 76.9% | 78.0% |
| $CO_2$ | | 0.3% | 0.03% | 8.4% | 6.5% | 4.6% | 3.6% | 1.83% | 0.33% |
| S | 4.5% | | | | | | | | |
| $H_2O$ | 10.6% | | 1.0% | 51.5% | 62.1% | 55.7% | 65.3% | 4.45% | 1.58% |
| $CH_4$ | | 87.0% | | | | | | | |
| $C_2H_6$ | | 8.5% | | | | | | | |
| $C_2H_4$ | | 0.03% | | | | | | | |
| H | 2.3% | 0.4% | | | | | | | |
| C | 79.7% | | | | | | | | |
| System Thermal Efficiency | | | | ~99% | ~99% | ~99% | ~99% | 98% | 88% |
| Heat flow MW | | | | | | | 21.1 | 22.0 | 22.0 |

Table 3, below, reflects VASTgas from VAST combustor with a Diverted VAST Gas

Turbine (GT) for natural gas (Lambda $\lambda$=1.05, omega $\omega$=10.6).

| | INPUT GASES/FUEL | | | OUTPUT GASES | | | | |
|---|---|---|---|---|---|---|---|---|
| Atom or Molecule | Nat. Gas Fuel v % at 25° C. | Air v % at 15° C. 60% RH | VAST Gas v % at 482° C. 1 atm (NG) | VAST Gas v % at 100° C. 1 atm (NG) | VAST cycle GT v % at 2 atm 113° C. (NG) | VAST cycle GT v % at 9 atm 158° C. (NG) | VAST cycle GT v % at 20 atm 196° C. (NG) | VAST cycle GT v % at 30 atm 217° C. (NG) |
| $O_2$ | 0.07% | 20.7% | 1.1% | 0.9% | 0.8% | 0.8% | 0.8% | 0.8% |
| $N_2$/Ar | 3.6% | 78.2% | 38.5% | 30.2% | 27.0% | 26.9% | 26.5% | 26.3% |
| $CO_2$ | 0.3% | 0.03% | 4.6% | 3.6% | 3.3% | 3.2% | 3.2% | 3.2% |
| $H_2O$ | | 1.0% | 55.7% | 65.3% | 69.0% | 69.1% | 69.5% | 69.8% |
| $CH_4$ | 87.0% | | | | | | | |
| $C_2H_6$ | 8.5% | | | | | | | |
| $C_2H_4$ | 0.03% | | | | | | | |
| $H_2$ | 0.4% | | | | | | | |
| System thermal efficiency | | | | | 90.0% | 86.4% | 83.0% | 80.7% |

In various configurations, the delivered process VASTgas composition has higher than about 33 v % water over the range of about 482.2° C. (900° F.) to 100° C. (212° F.). In other configurations, the water content in VASTgas may vary from greater than 5 v %, 10 v % or 20 v %, to greater than 50 v %, or 60 v %, or more depending on fuel and temperature. Table 2, the work pumping air reduces the system efficiency for flue gas from burning natural gas, while the pumping work increases the process heat flow, compared to VASTgas.

EXAMPLE 3

Diversion of Pressurized VAST Cycle Gas Turbine Combustion Gases ("Diverted VAST GT")

Gas turbines efficiently produce both electricity and/or mechanical energy at high specific power levels from various fuels. The use of high water (liquid water or steam) injection levels to increase the specific power of such systems is described in, e.g., U.S. patent application Ser. No. 10/763,057 (Hagen, et al.). Using water as diluent provides higher power and efficiency compared to excess air.

In another embodiment, a "wet" VAST cycle gas turbine (hereinafter "GT") is used to produce VASTgas with high water and $CO_2$ content is shown schematically in FIG. 2. Inlet oxidant containing fluid F20 is pressurized by a pressurizer or compressor 220 to deliver pressurized oxidant fluid F24 to the combustor or thermogenerator 150. Air, oxygen enriched air, or oxygen F20 is compressed by compressor 220 selected for the desired pressure ratio. Reactant or fuel F30 is pressurized by the reactant or fuel pump 310 to deliver pressurized reactant/fuel F32 to combustor 150. In one configuration, the input fluid flows rates and compositions air to fuel ratios and a combustion temperature may be selected similar to those used for the VAST combustion configuration shown in FIG. 1 as used in example 1, i.e., about 0.45 kg/s (1 lb/s) of NG fuel at 25° C., with 15° C. air at relative air lambda about 1.05, and water to control combustion to about 1035° C.

Figure 2:
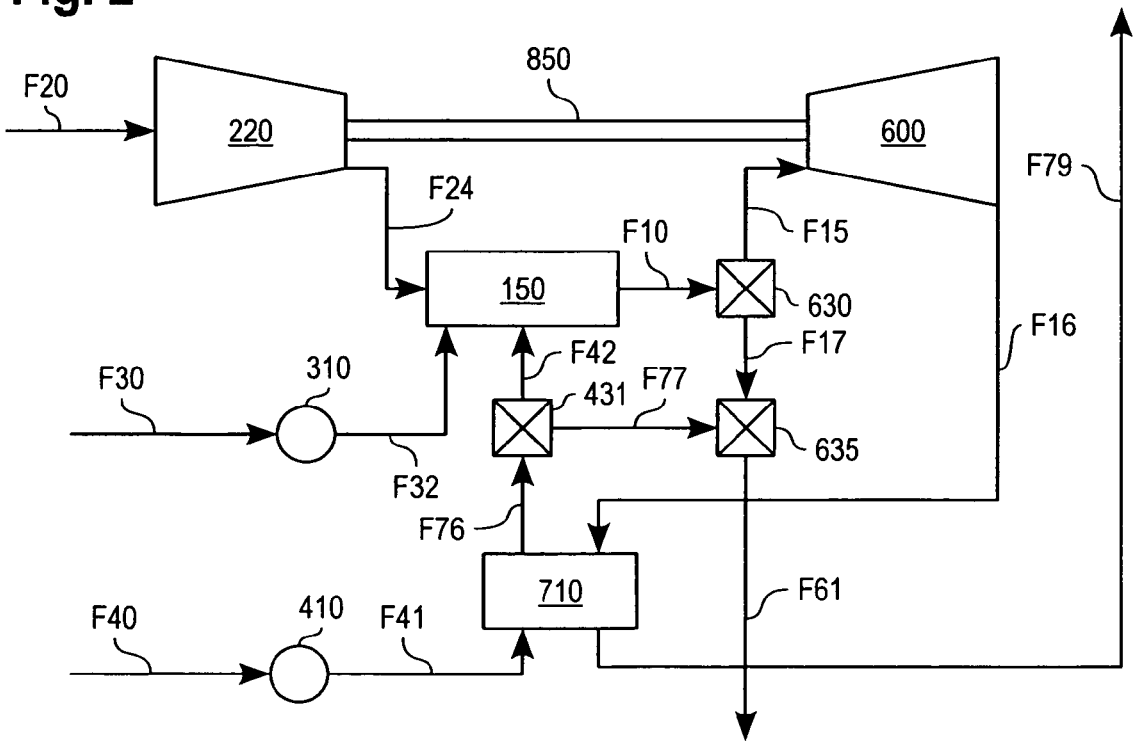

For the configuration shown in FIG. 2, hot reacted fluid or combustion VASTgas F10 exiting the combustor 150 is split by a splitter 630 suitable for hot reacted gas, into two hot fluid portions F15 and F17. A first portion F15 of the hot reacted fluid is directed through an expander 600 to produce mechanical energy as in the known art. A second portion F17 of hot reacted fluid is diverted to provide hot process fluid or VASTgas which can be used to extract or process heavy hydrocarbons. The first hot fluid portion F15 is nominally configured to provide enough mechanical energy to operate the compressor 220 via drive 850. In some configurations, it may also be configured to provide enough power to drive a generator, not shown. The second hot fluid portion F17, may be mixed with additional thermal diluent F77 using a mixer or direct contact heat exchanger 635 to form VASTgas F61. For example, water is added to the VASTgas to lower its temperature and increase its steam content as desired. This may use a direct contact heat exchanger such as taught in the related art of U.S. Pat. No. 5,925,291 (Bharathan) or U.S. Published Patent Application No. 2007/0234702 (Hagen et al.).

An economizer 710 may be used to transfer some of the heat from the exhaust gases F16 exiting the expander 600 to heat the thermal diluent or water F76 that is injected into the combustor 150. In some configurations, a first portion of heated diluent F76 is directed by valve 431 to form heated fluid F42 to the combustor 150. Another portion of thermal diluent F77 may be directed to mixer or direct contact heat exchanger 635 to mix with the hot gases F17 downstream of the combustor 150. Injecting diluent or water F77 downstream of the combustor 150 cools and increases the water content of the VASTgas F10 to form cooler VASTgas F61. The economizer heat recovery reduces the heat loss via the exhaust F79, increasing the overall thermal efficiency of the system.

This embodiment may be configured for a variety of output pressures, e.g., 2 atm, 9.2 atm, 15 atm and 20 atm. The amount of water F42 and F44 added to the combustion gases and the amount of heat diverted from the exhaust gases in the economizer may be configured to control the combustion temperature within the combustor, and the desired outlet temperature. More specifically, the diluent flow may be controlled to provide a near maximum (but realistic) amount of heat transfer and cooling of both the combustion stream VASTgas F10 and the exhaust gas F16 without causing condensation of water vapor in the exhaust stream.

Referring to FIG. 2, in some configurations the economiser 710 may be configured to cool the exhaust gas F16 while avoiding condensation and corrosion, more specifically, down to about 100° C. Table 3 shows a summary of the corresponding process gas compositions and system thermal efficiencies resulting from various pressure ratio VAST GTs configured as in FIG. 2 and modeled by Thermoflex. In these configurations, the mol % or v % of $CO_2$ in the resulting process VASTgas is somewhat lower than that found for a VAST thermogenerator 150 (3.17 v % for the VAST GT and 3.6 v % for a VAST combustor 150) but the water content is higher (~69 v % instead of ~65 v % respectively).

The amount of enthalpy or heat flow contained in the VASTgas from the 30 atm VAST GT configuration of FIG. 2 is somewhat lower than the enthalpy in the VAST combustor example of FIG. 1 (18.8 MW instead of 20.7 MW) because of the significant fraction of heat lost to the exhaust gas F79. The amount of heat lost to the exhaust gas is higher in the case of higher pressure ratio GT configurations because the temperature of the exhaust is higher at higher pressure when it is constrained to avoid condensation and potential corrosion problems.

However, the total thermal efficiency may be significantly higher when using the GT configuration as shown in FIG. 2 (81% instead of 41% for a VAST combustor of FIG. 1), because the compression of the incoming air (or oxidant) is provided directly by the GT used to produce the VASTgas, and some of the "waste heat" from the exhaust is diverted into the incoming water stream for process use by the economizer. The efficiency gain using this configuration at 30 atm exceeds that of a conventional boiler for the configuration shown in FIG. 25 (77% system thermal efficiency) simulated using the same input parameters and outlet gas temperature.

Furthermore, a VAST GT process gas contains significant quantities of $CO_2$ (3.2 v % in this example). This $CO_2$ is projected to provide a significant advantage by increasing the amount of heavy hydrocarbon that can be mobilized and extracted for a given quantity of heat injection into heavy hydrocarbon material.

Referring to FIG. 2, in further diverted VAST GT configurations the economizer may be configured to further cool the exhaust gas nearer to ambient conditions when designed for condensing conditions, e.g., with corrosion resistant materials. The condensate may be recovered and used.

TABLE 4

| Diverted VAST GT at 1 & 30 atm, on air & $O_2$ vs. boiler on air | | | | | | |
|---|---|---|---|---|---|---|
| | Boiler Varying process fluid pressure | | VAST Diverted GT Varying oxidant type and process fluid pressure | | | |
| Oxidant at 15° C. (59° F.) and 1 atm (14.7 psi) | | | | | | |
| Type | Air | Air | Air | Air | O2 | O2 |
| Mass Flow kg/s (lb/s) | 17.2 (38.0) | 17.2 (38.0) | 8.2 (18) | 8.2 (18) | 8.2 (18) | 8.2 (18) |
| Compressor Press. Ratio | n/a | n/a | 2 | 30 | 2 | 30 |
| Fuel at 25° C. (77° F.) and 1 atm (14.7 psi) | | | | | | |
| Mass Flow kg/s (lb/s) | 0.45 (1.0) | 0.45 (1.0) | 0.45 (1.0) | 0.45 (1.0) | 2.07 (4.7) | 2.07 (4.7) |
| Diluent at 15° C. (59° F.) and 1 atm (14.7 psi) | | | | | | |
| Mass Flow kg/s (lb/s) | 7.1 (15.6) | 6.0 (13.3) | 7.6 (16.8) | 7.2 (15.9) | 35.8 (78.9) | 34.3 (75.6) |
| Process Fluid | | | | | | |
| Temperature ° C. (° F.) | 121 (249) | 234 (453) | 112 (234) | 217 (422) | 117 (244) | 229 (445) |
| Pressure atm (psi) | 2 (29.4) | 441 (30) | 2 (29.4) | 28 (423.9) | (28.26) | (423.9) |
| Mass Flow kg/s (lb/s) | 7.0 (15.4) | 13.2 (6.0) | 13.5 (29.8) | 11.2 (24.6) | 43.0 (94.9) | 40.9 (90.2) |
| Heat Flow MW (kBtu/s) | 18.5 (17.5) | 16.3 (15.5) | 23.1 (21.9) | 44.8 (42.5) | 99.5 (94.3) | 98.6 (93.5) |
| $CO_2$ mol % | 0 | 0 | 3.3 | 3.2 | 4.9 | 5.1 |
| $H_2O$ mol % | 100 | 100 | 69.0 | 69.8 | 94.3 | 94.1 |
| Other | | | | | | |
| System Efficiency | 88% | 76% | 88% | 81% | 91% | 90% |
| Auxiliary Power kW | 81.3 | 110.1 | 0 | 0 | 0 | 0 |
| Combustion Temperature | 1035° C. (1895° F.) | | | | | |

EXAMPLE 4

"Diverted VAST GT" Configuration with 99% $O_2$ Combustion

The use of enhanced $O_2$ concentrations in order to increase combustion power density for a given overall system size and in order to reduce NOx emissions and sequester $CO_2$ is known in the art, e.g., U.S. Pat. No. 7,021,063 (Viteri). However, the use of such enhanced $O_2$ concentrations to generate VASTgas F61 to extract heavy hydrocarbon delivers substantial additional advantages, among them higher power densities and higher $CO_2$ concentration in the resulting VASTgas, higher hydrocarbon extraction efficiencies, and the potential to use much smaller, more modular systems in the extraction process.

Referring further to FIG. 2, some VAST Diverted GT configurations may use 99% $O_2$ and 1% $H_2O$ as the oxidant fluid F20 instead of air (20.7% $0_2$) at various pressures, e.g., at 2 atm and 30 atm, with natural gas fuel. For configurations with similar sized equipment, higher oxygen flows give greater power, e.g., with 99% $O_2$ (almost 5 times higher than air), higher amounts of fuel can be combusted in the combustor with near stoichiometric combustion, e.g., 2.1 kg/s instead of 0.45 kg/s fuel, both at lambda $\lambda$=1.05. In such configurations, more diluent fluid F40 (e.g. water) may be injected to maintain a prescribed combustion temperature, e.g., 35.9 kg/s of water for 2 atm $O_2$ combustion to maintain about 1035° C. combustion compared with 7.6 kg/s for 2 atm air combustion. Similarly, 33.5 kg/s of water for 30 atm $O_2$ combustion to maintain of 1035° C. combustion compared with 7.2 kg/s for 30 atm air combustion.

When delivering 33.5 kg/s of total water with 30 atm $O_2$ combustion, F42 of about 15.5 kg/s may be injected directly into the combustor 150 and the remaining F77 of about 18.1 kg/s may be injected into the VASTgas mixer 635 after diversion of the flow from the turbine in order to reduce its temperature and increase its water content. The increased fuel and water flows may require a larger combustor 150 for the larger flows. These configurations were modeled with the same input temperatures for water F40, oxidant fluid F20, and fuel flows F30 as that used in the configurations of FIG. 1 (15° C., 15° C., and 25° C., respectively) with the combustion temperature set to about 1035° C.

In these low and high pressure high oxygen configurations of FIG. 2 sufficient combustion gases F15 are directed to the expander 600 to operate the compressor 220 (as was the case for air combustion). A portion F17 of combustion gas F10 may be diverted to form VASTgas process fluid F61. e.g., after additional water F77 is added to increase the water content and reduce the temperature of the gases to within a prescribed temperature range. The increased fuel flow F30 (4.58 times, i.e. +358%) being burned in the combuster 150 delivers 5.25 times (i.e. +425%) the process fluid heat for $O_2$ combustion as compared to air combustion for the same configuration of FIG. 2, compressor 220 and expander 600 capacities.

The increased overall efficiency of the process and the higher percentage of heat delivered to the VASTgas process fluid F61 is because heat provided by the additional fuel is being delivered to diverted process fluid. No additional energy is required for compression in these configurations where the same amount of gas flow F20 into the compressor (air or 99% $O_2$ as the case may be) is being compressed in both cases. Typical parameters for some diverted GT configurations are shown in Table 4.

Referring to FIG. 2, in further diverted VAST GT configurations, the fuel flow F30 may be maintained (e.g., NG at 0.45 kg/s or 1 lb/s) and the compressor 220, combustor 150, and expander 600 size adjusted as needed. Normalized modeled values for the near-stoichiometric combustion of the same quantity of fuel (e.g., 0.45 kg/s) are shown in Table 4 for air and 99% oxygen, and for pressures of about 2 atm and 30 atm. To compress oxygen, the compressor 220 could be reduced to 21% of the size as that used to compress air (i.e., less oxidant F20 is necessary for near stoichiometric combustion).

The use of enhanced $O_2$ combustion increases the specific power and the enthalpy of the VASTgas produced by the diverted VAST GT by up to 5 times or more and significantly increases the overall system thermal efficiency for the production of VASTgas. In some configuration, the oxidant fluid with enhanced $O_2$ may comprise greater than 21 v % $O_2$, 50 v % $O_2$, 67 v % $O_2$, 85 v % $O_2$, 95 v % $O_2$, or 99 v % $O_2$. In addition, there is a substantial increase in the percentage of both $H_2O$ and $CO_2$ in the VASTgas, e.g., the concentration of $CO_2$ is 5.1 v % for 99% $O_2$ combustion of NG versus 3.2% for air combustion of NG. With enhanced $O_2$ combustion, $H_{h2}O$ as diluent F41 replaces the $N_2$ as diluent in F20 in air combustion. The concentration of $CO_2$ may be further enhanced by using higher carbon content fuels such as coal or coke.

Given the high solubility of $CO_2$ in heavy hydrocarbons, some configurations provide VASTgas with higher carbon fuels and/or combusting with enhanced oxygen, to extract or process heavy hydrocarbons. It is expected that delivering VASTgas with higher $CO_2$ concentrations will substantially increase the rate of extraction and/or the fraction of heavy hydrocarbon that would ultimately be extracted from a given formation or amount of mined material.

The increase in power density for a given system (e.g., 5.25 times for 30 atm $O_2$ combustion as compared to air combustion) is expected to increase the rate of extraction by a similar amount for a given system size or capital investment. This would increase the profitability and reduce the time to profit for a given GT system. Increasing the delivered power density of such systems may substantially reduce size improving both portability, modularity and cost. This enables small localized or modular extraction facilities.

In some configurations, enhanced oxygen with concentrations between those of air and 99% oxygen may be used, e.g., to reduce the cost of the oxidant and/or to use more compact portable methods of oxygen purification from air. In one example, pressure swing may provide 85-95% $O_2$ concentrations. Pressure swing separation methods reportedly produce $O_2$ at a cost of $20-50 per metric ton in volumes of >100 t/day (2005 prices). See, Kobayashi & Hassel, "$CO_2$ Reduction by Oxy-Fuel Combustion: Economics and Opportunities", GCEP Advanced Coal Workshop, Provo, Utah, Mar. 15, 2005. Diverted VAST GT configurations shown in Table 4 use about 8.2 kg/s (700 tons/day) of $O_2$. In such configurations, oxygen may cost about $1.80-$4.50/GJ NG fuel and about $1.18-$2.99/GJ of coke fuel. Prices may drop with higher volumes.

Some VAST wet combustion systems may be configured for fuel flexibility to use one or more cheaper fuels such as high sulfur "sour gas", bitumen, or coke. Even using NG fuel, the cost of $O_2$ may be less than the higher profit from increased heavy hydrocarbon extraction efficiency and/or rate.

The residual nitrogen in oxygen enriched air may produce an insulating layer above a hydrocarbon formation being heated, in a similar manner to SAGP technology. However, the very high $O_2$ concentrations described above provide other advantages (such as higher power density and higher $CO_2$ concentrations).

In some configurations, VAST GT using $O_2$ enriched air may vary the $O_2$ concentration, e.g., ranging from air through to 99% $O_2$ and between. In some configurations, the $O_2$ concentration may be varied during operation to improve or optimize the overall extraction process. For example, a lower $O_2$ concentration or air may be used during the initial phases of extraction in order to build up an insulating cap of N2 over the formation in question. After the insulating cap is in place the $O_2$ concentration may be increased (and decrease the $N_2$ concentration), e.g., to increase the $CO_2$ concentration, etc.

Figure 4:
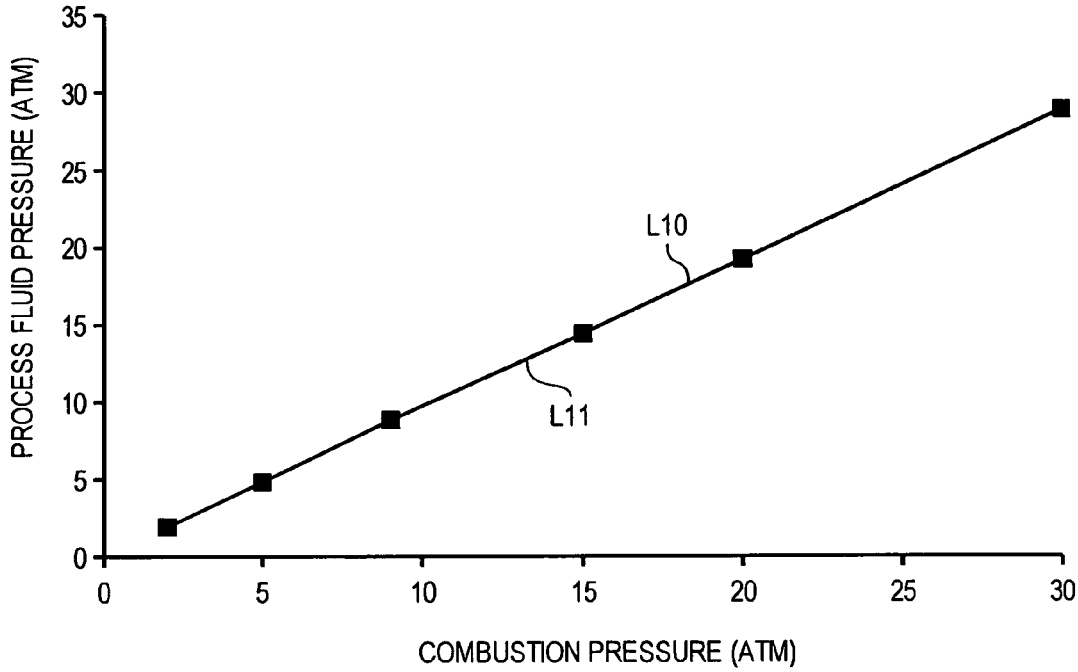
FIG. 4 illustrates the functional dependence of process VASTgas pressure for low and high pressures of a VAST Diverted Gas Turbine.

Referring to FIG. 2, the pressure of process VASTgas F61 is shown in FIG. 4 as line L10 for configurations using air (20.7% $O_2$) for oxidant fluid F20 for combustion ranging in pressure from 2 atm to 30 atm. Similarly, the pressure of process VASTgas F61 is shown as line L11 in FIG. 4 for oxidant fluid F20 of enhanced (99%) $O_2$ combustion to produce VASTgas as a function of combustion pressure from 2-30 atm. The delivered VASTgas pressure for L10 and L11 is very close to the combustion pressure since nearly all of the small pressure drop (0.2-1.2 atm) occurs across the combustor 150. In such configurations, the high pressure exhaust VASTgas may be diverted via diverter 630 directly to become process fluid F61 after addition of water F77 in the direct contact heat exchanger 635. Thus the delivered VASTgas pressure is very close to the pressure exiting the compressor for air or oxygen combustion.

Figure 6:
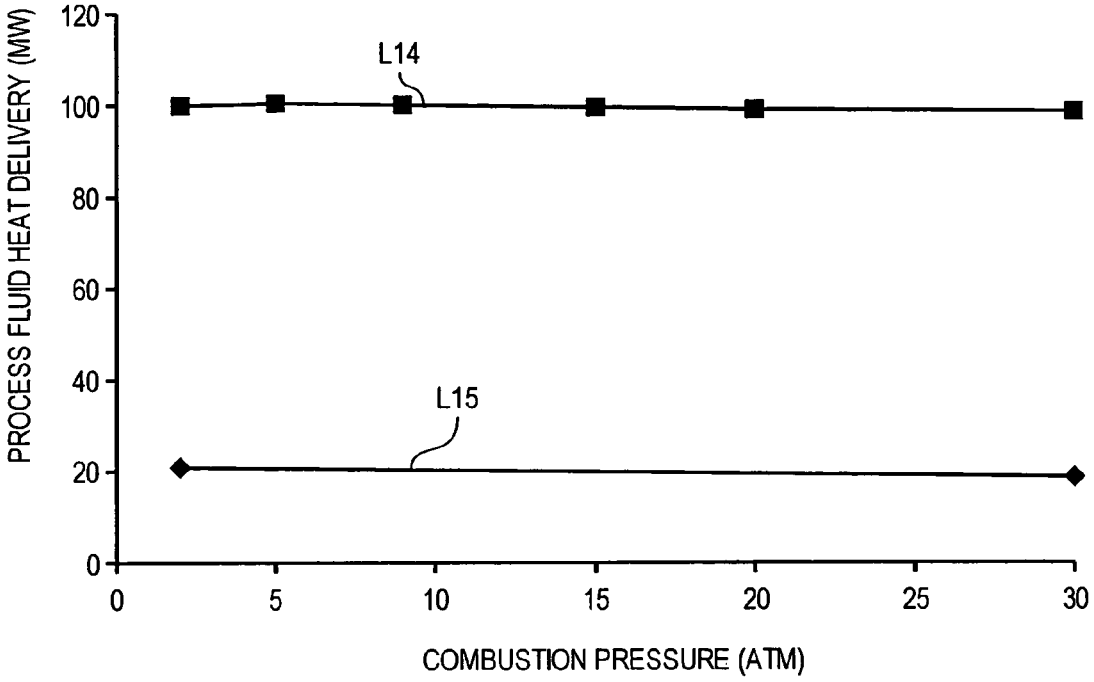
FIG. 6 illustrates the process VASTgas heat delivery for constant size VAST Diverted Gas Turbine for natural gas combustion with Air or 99% $O_2$.
Figure 7:
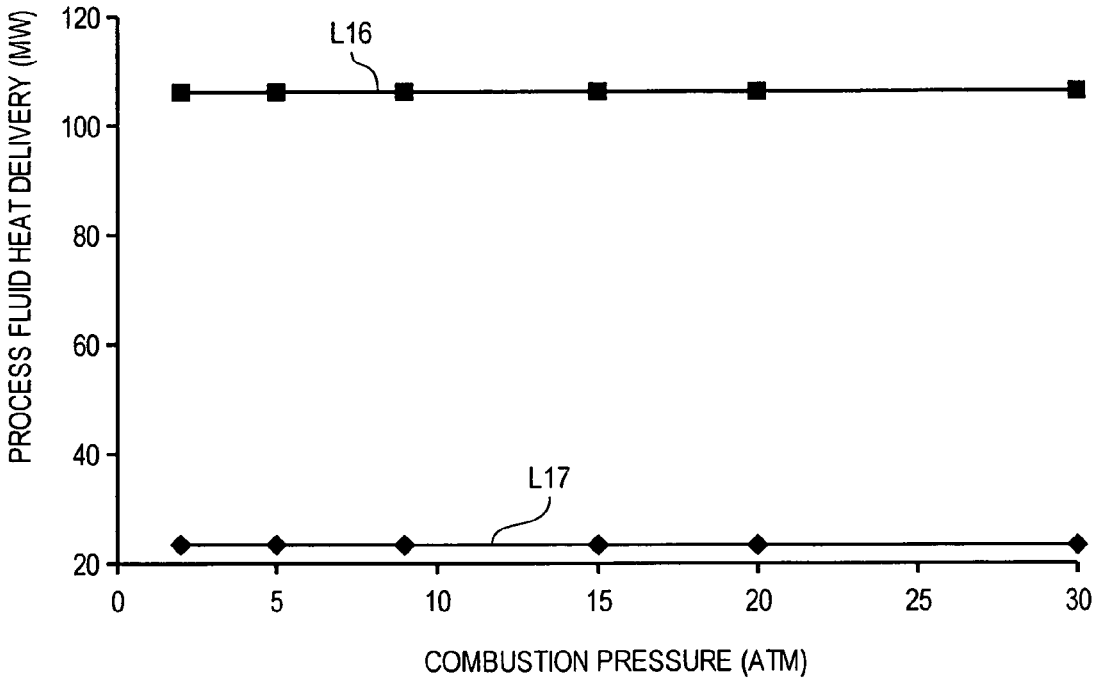
FIG. 7 illustrates the process VASTgas heat delivery for constant size VAST Direct Gas Turbine for natural gas combustion with Air or 99% $O_2$ FIG. 8 schematically illustrates a VAST Direct Gas Turbine with dual combustors and expanders delivering process VASTgas and electricity.

The VASTgas process fluid heat delivered is shown in FIG. 6 for a VAST diverted GT configurations for both air and 99% $O_2$ combustion across the modeled combustion pressure range of 2-30 atm. Given the large increase in the amount of fuel that is combusted (4.8 times) in the case of enhanced $O_2$ combustion as compared to air combustion, the amount of delivered VASTgas heat is about proportional to the amount of fuel that is being combusted across the whole range of pressures. Approximately 100 MW of process heat is delivered by VASTgas for heavy hydrocarbon extraction for the case of 99% $O_2$ combustion of NG as compared to approximately 20 MW for air combustion. Given that this increase (>5 times) can be achieved with approximately the same system size, this implies an approximate improvement in power density and the rate of return on capital of about 5 times (+400%).

EXAMPLE 5

VAST Cycle Gas Turbine VASTgas Generated at High Efficiency Using Air Combustion ("Direct VAST GT")

Figure 3:
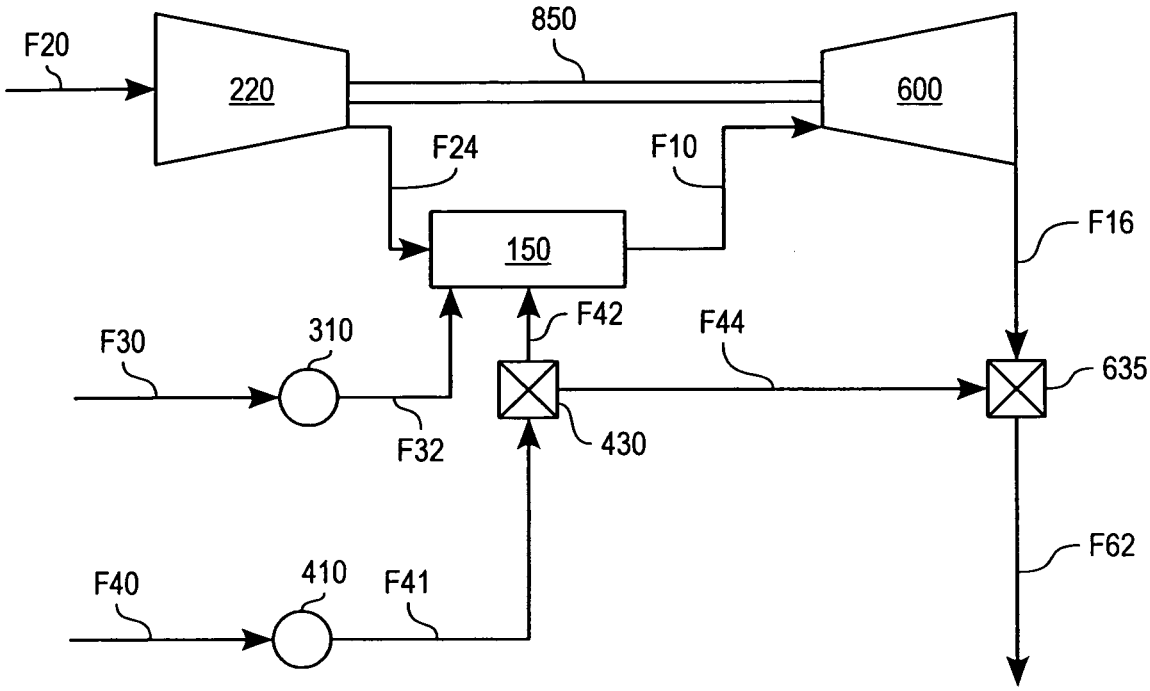

In one embodiment, exhaust from a wet combustion gas turbine may be used directly as process fluid, herein called a Direct VAST GT. Such Direct VAST GT configurations may provide the highest overall system thermal efficiency and the highest VASTgas flow rates for heavy hydrocarbon extraction. In some configurations, all the turbine exhaust may be used as process fluid without diversion of combustion gases into another process stream. FIG. 3 Shows a Direct VAST GT configuration. Thermoeconomic (Thermoflex) heat flow simulation results for several Direct VAST GT configurations are shown in Table 5. To inject process gases, some overpressure is usually required. Higher pressures may be used to provide higher $CO_2$ dissolution and greater penetration into heavy hydrocarbons. This may increase the extraction efficiency by reducing heavy hydrocarbon viscosity.

Extraction efficiency has been shown to increase with pressure with pure steam depending on reservoir permeability, well depth and other variables. Higher pressures generally increase steam losses and increase the total enthalpy required (e.g., higher steam and Steam to Oil Ratio). See, Collins, "Injection Pressures for Geomechanical Enhancement of Recovery Processes in the Athabaska Oil Sands", SPE Int'l Thermal Operations and Heavy Oil Symp. and International Horizontal Well Technology Conference, Calgary, Alberta (2002). Pressures of ~25-30 atm have been shown to be an effective trade-off between these two extremes for steam heating in some reservoirs. However, the extraction efficiency peak with pressure for $CO_2$-containing gases may be considerably lower because of the high solubility of $CO_2$ in heavy oil and the liquefaction of $CO_2$ at approximately 5-10 atm (this is also variable with temperature).

Referring to FIG. 3, some configurations may provide both an elevated pressure for improved extraction efficiency and the possibility of a direct VAST cycle or retrofit option. A turbine may be retrofit by reducing the number of turbine stages and decreasing the air to fuel ratio as compared to a Brayton cycle (with a corresponding increase in the specific power provided by the combustor). This provides an increase in temperature and exhaust enthalpy of the VASTgas exiting the turbine. The retrofit effort includes providing water injectors into the combustor, removing some of the turbine stages, providing thrust bearings, and adding a direct contact heat exchanger (e.g., a water spray into the exhaust).

One configuration of FIG. 3, indicates more than 98% overall system thermal efficiency and the highest overall process enthalpy flow (i.e., 23.4 MW and 23.3 MW respectively for the 9.2 atm and the 30 atm compression ratio models) of any of the air combustion VASTgas configuration options. The system efficiency of this configuration is also superior to any boiler. The VASTgas efficiency and high heat flow is accompanied by a reduction in the process fluid injection pressure as compared to VAST diversion configurations (Diverted VAST GT) as described in example 3 and FIG. 2.

(15° C., 15° C., and 25° C. respectively). The combustion temperature was set at 1035° C. in these models. The air to fuel ratio of these configurations was also modeled at lambda $\lambda$=1.05 (i.e., a small increase over stoichiometric combustion).

EXAMPLE 6

Direct VAST GT VASTgas Burning NG in Enhanced $O_2$

Further referring to FIG. 3 some configurations may use enhanced O2 oxidant fluid. These may provide high overall system thermal efficiency of the Direct VAST GT configuration described above. They may provide a major increase in the process VASTgas enthalpy delivered, the process VASTgas heat content, and a higher delivery pressure for the process VASTgas for a given combustion pressure.

FIG. 3 schematically shows delivering the process VASTgas ("exhaust") exiting a Direct VAST cycle modified GT using enhanced $O_2$ combustion. Table 3 documents modeled gas compositions for some VAST combustor and Direct VAST Gas Turbine configurations. Table 5 shows mass and heat flow simulations for such configurations. In these configurations, the pressurized oxidant fluid F24 of 99% $O_2$, 1% water was selected at the same mass flow using air (as used in configurations referring to FIG. 1 and FIG. 2). Correspondingly, the fuel flow F30 may be increased to provide near stoichiometric combustion (lambda $\lambda$=1.05) for the same

TABLE 5

| VAST Direct Injection GT at 5, 10 atm on air & $O_2$ vs. boiler on air | | | | | | |
|---|---|---|---|---|---|---|
| | Boiler Varying process fluid pressure | | | VAST Direct Inject Varying oxidant type and process fluid pressure | | |
| Oxidant at 15° C. (59° F.) and 1 atm (14.7 psi) | | | | | | |
| Type | Air | Air | Air | Air | $O_2$ | $O_2$ |
| Mass Flow kg/s (lb/s) | 17.2 (38.0) | 17.2 (38.0) | 8.2 (18) | 8.2 (18) | 8.2 (18) | 8.2 (18) |
| Pressure Ratio | n/a | N/a | 9.25 | 31.52 | 5.91 | 12.84 |
| Fuel at 25° C. (77° F.) and 1 atm (14.7 psi) | | | | | | |
| Mass Flow kg/s (lb/s) | 0.45 (1.0) | 0.45 (1.0) | 0.45 (1.0) | 0.45 (1.0) | 2.07 (4.7) | 2.07 (4.7) |
| Diluent at 15° C. (59° F.) and 1 atm (14.7 psi) | | | | | | |
| Mass Flow kg/s (lb/s) | 6.7 (14.8) | 6.5 (14.3) | 7.3 (16.0) | 7.09 (15.5) | 35.0 (77.1) | 34.5 (76.0) |
| Process Fluid | | | | | | |
| Temperature ° C. (° F.) | 306 (152) | 180 (357) | 306 (152) | 180 (357) | 306 (152) | 180 (357) |
| Pressure atm (psi) | 5 (73.5) | 10 (147) | 5 (73.5) | 10 (147) | 5 (73.5) | 10 (147) |
| Mass Flow kg/s (lb/s) | 6.7 (14.7) | 6.4 (14.1) | 15.9 (35.0) | 15.7 (34.6) | 45.2 (99.6) | 44.7 (98.5) |
| Heat Flow MW (kBtu/s) | 17.9 (17.0) | 17.4 (16.5) | 23.3 (22.1) | 23.4 (22.1) | 106.1 (100.5) | 106.0 (100.5) |
| $CO_2$ mol % | 0 | 0 | 3.8 | 3.8 | 5.3 | 5.3 |
| $H_2O$ mol % | 100 | 100 | 64.2 | 63.7 | 93.9 | 93.8 |
| Other | | | | | | |
| System Efficiency | 85% | 82% | 98% | 98% | 98% | 98% |
| Auxiliary Power kW | 84.8 | 100.5 | 0 | 0 | 0 | 0 |

Combustion Temperature 1035° C. (1895° F.)

The 30 atm configuration for the example of FIG. 2) provides VASTgas at approximately 29 atm with a system thermal efficiency of 81% as compared to 10 atm and a thermal efficiency of about 98%. The input fuel flow and combustion temperature for both examples is about 0.45 kg/s of NG at 25° C. as before. The input temperatures for water, air and fuel flows are also the same as that used in the previous examples total oxidant flow. With this higher flow rate of $O_2$, the fuel combusted is increased (to 2.1 kg/s from 0.45 kg/s). Correspondingly, the water diluent added may be increased to a total of about 34.4 kg/s to maintain the combustion temperature at about 1035° C. The input temperatures for water and air flows were kept the same as in previous examples (15° C.) while the fuel was input at 25° C.

Several configurations of FIG. 3, indicate more than 98% overall system thermal efficiency for the delivered VASTgas. They show the highest overall delivered process flow enthalpy of any of the VASTgas configuration options, 106 MW for both the 9.2 atm and the 30 atm compression ratio models.

Figure 5:
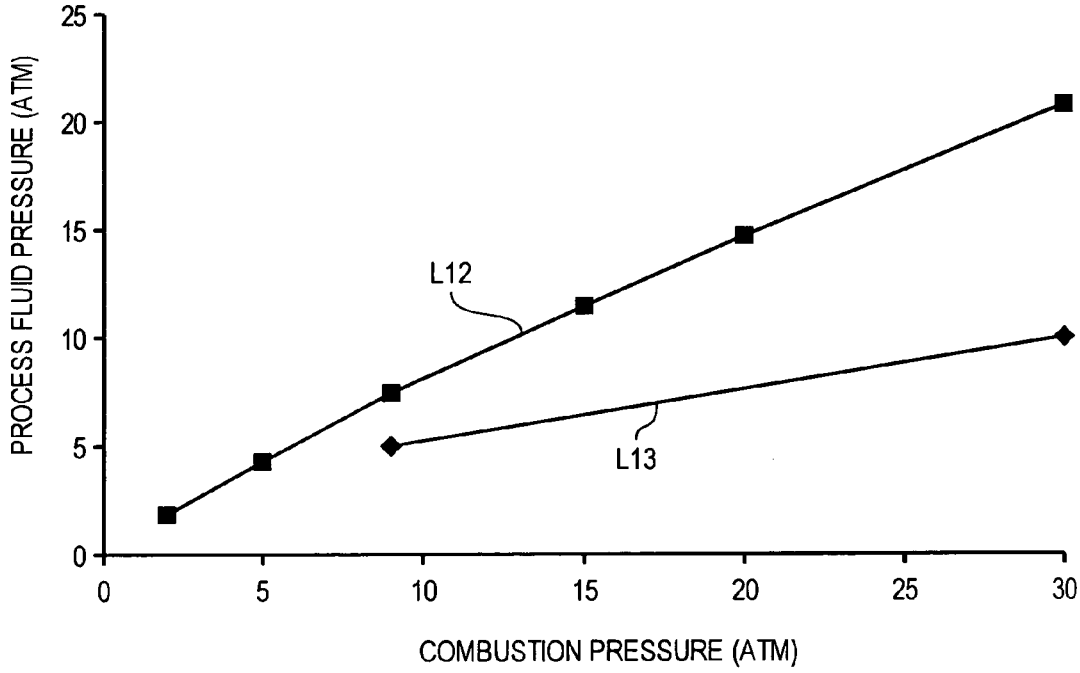
FIG. 5 illustrates the functional dependence of process VASTgas pressure for air and 99% $O_2$ natural gas combustion in VAST Direct Gas Turbine normalized to fuel flow.

The high delivered VASTgas system thermal efficiency and heat flow are accompanied by lower process fluid delivery pressure compared to Diverted VAST GT configurations as described in examples 3 and 4. The 30 atm enhanced $O_2$ combustion model provides VASTgas at approximately 20.8 atm compared to 10 atm for the case of air combustion. The 9.2 atm enhanced $O_2$ combustion model provides VASTgas at 7.4 atm compared to 5.0 atm for air combustion. FIG. 5 shows the functional dependence of delivered VASTgas pressure from a VAST Direct GT for enhanced $O_2$ combustion as line L12, as a function of combustion pressure across a range of pressures from 2-30 atm. Line L12 shows higher pressure than a VAST Direct GT operating on air, represented as line L13 over the same pressure range.

This difference in delivered process fluid pressure (L12 higher than L13) increases with pressure because the work required to compress the oxidant fluid increases with pressure. This difference is enhanced by higher solubility of $CO_2$ in heavy hydrocarbons with increasing pressure and the improved penetration capability for VASTgas in heavy hydrocarbons at higher pressure.

In some configurations, the range of delivered pressures may be adjusted during the extraction process to improve overall extraction efficiency. This may depend on depth or distance from the GT to the material being extracted, and losses in delivering heat to the heavy hydrocarbons due to geochemical or process flow conditions. For example, a higher pressure may be used during initial extraction stages to "charge" the heavy hydrocarbons with VASTgas within the limits of fracture design pressure. At another time a more moderate pressure may be used to sustain extraction of the heavy hydrocarbons.

EXAMPLE 7

VAST Cycle GT Retrofitted with 2nd Turbine

Figure 8:
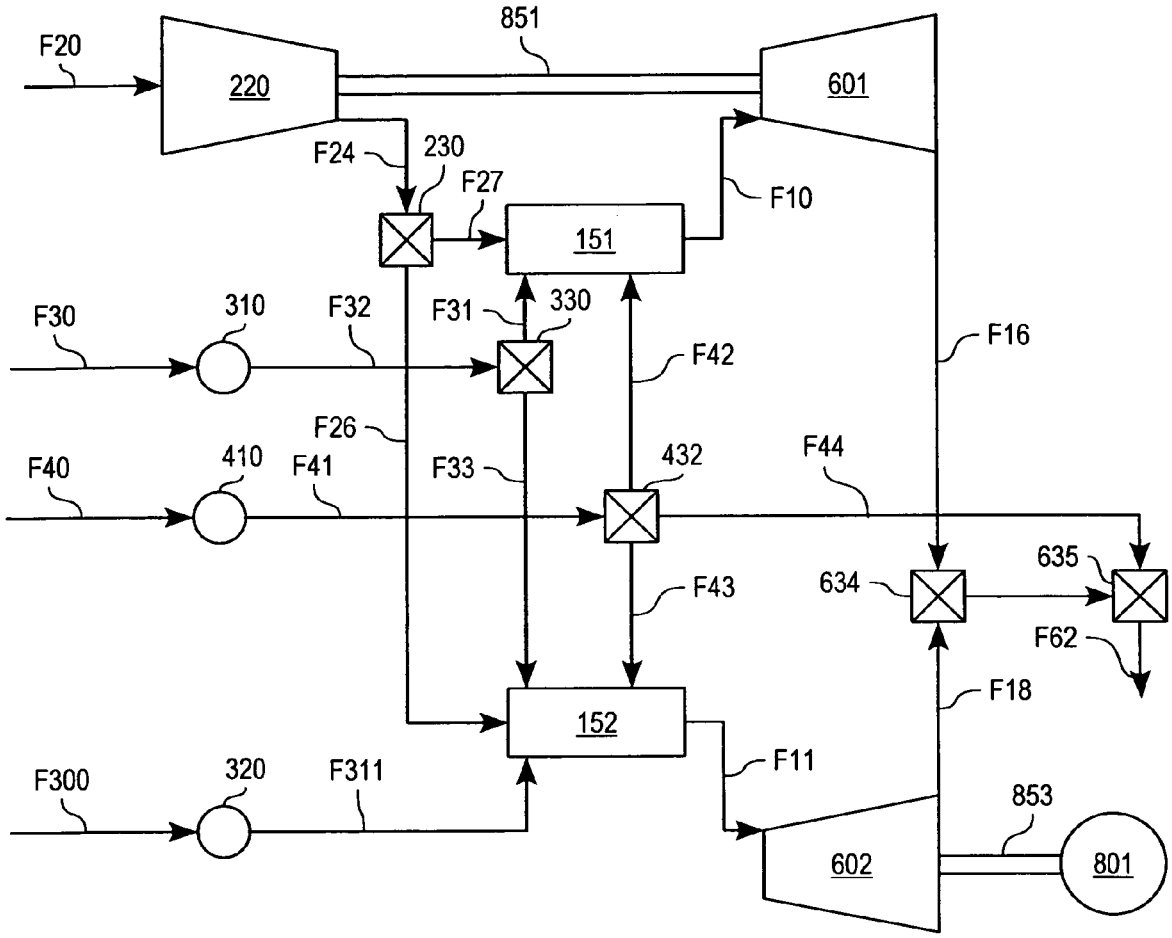

A parallel wet combustion Direct VAST gas turbine configuration is shown schematically in FIG. 8. In this configuration a portion of pressurized oxidant fluid F24 is delivered to a second combustor 152. In conventional configurations, the excess air would cool a Brayton cycle, at a typical lambda $\lambda$ of 3.0 to 5.0. The configuration of FIG. 8 may be adapted from FIG. 3, for example by providing a parallel or second combustor 152 and expander 602. In the configuration of FIG. 8, a first portion F27 of the pressurized oxidant fluid F24 is directed by valve or splitter 230 to a first combustor 151. A second portion F26 of pressurized oxidant fluid F24 is directed to a second combustor 152.

Similarly, fuel flow F30 may be pressurized with pressurizer 310, from which pressurized flow F32 a first portion of fuel F31 may be directed by valve or splitter 330 into first combustor 151 and a second fuel portion F33 directed into the second combustor 152. Similarly, thermal diluent fluid F40 is pressurized by pressurizer 410 to form compressed diluent F41 of which a portion F42 is directed by a valve or splitter 432 into combustor 151 upstream of the combustor outlet, while portion F43 is directed by valve 432 to the second combustor 152. Fuel flow F31 and oxidant flow F27 are combusted and mixed with diluent F42 to form energetic VASTgas fluid F10 that is delivered to expander 601.

In configurations schematically shown by FIG. 8, the expansion ratio of expander 601 and/or expander 602 may be configured to be less than that of compressor 220 sufficient to provide process VASTgas F62 at a desired pressure to an underground heavy hydrocarbon resource and/or to processing mined heavy hydrocarbon resource.

The expander 601 may be used to drive compressor 220 by a drive shaft 851. Similarly, expander 602 may use a drive shaft or coupling 853 to drive generator 801. The electrical power generated may be used to operate heavy hydrocarbon extraction pumps or other equipment, or be delivered to the grid. In similar configurations (see, FIG. 8) expander 601 may drive a generator 800 via shaft 852. In this configuration the ratio of oxidant fluid portion F27, to oxidant fluid portion F26 may be controlled by regulating the power expander 601 generates relative to the power generated by expander 602, e.g., by controlling the load on generator 800 relative to that on generator 801.

Referring further to FIG. 8, The fuel flow into the two combustors may be adjusted to deliver near stoichiometric combustion (e.g., lambda $\lambda$~1.05) which provides for near maximum power of any air combustion configuration. This configuration may be used to further increase the power by using enhanced $O_2$ oxidant for combustion. The second turbine may not require an air compressor. Typically the first expander 601 may compress the oxidant F20 (e.g., air) required both for its combustion chamber 151, and for the second combustion chamber 152. Each combustor may be configured to meet specific or changing process demands (e.g., electricity demand). Such control may be achieved with the second turbine with high VASTgas flows.

Referring to FIG. 8, in some configurations, a portion of combustor VASTgas F10 may be diverted from the first combustor 151 to the second combustor 152 to provide additional VASTgas and generate additional electrical power. In some configurations the process VASTgas F18 from the second turbine may be combined with the process VASTgas F16 from the first expander. Thermal diluent or water F44 may be mixed with one or both of flows F16 and F18 to control the temperature and/or composition of process VASTgas delivered F61.

Some and/or all of the process VASTgas F16 and F18 from expanders 601 and/or 602 may be delivered separately and/or together. A portion of the second process flow F18 may be used in a second heavy hydrocarbon extraction operation or other process application. A third (or more) combustor/turbine may be added to this configuration to create additional VASTgas and/or electrical power.

Related art simple or Brayton cycle turbine typically use substantial excess air to cool the flow into the turbine, e.g., 3, 5 or 8 times stoichiometric depending on the desired temperature. Such a Brayton turbine may be converted to a diverted VAST cycle by directing the excess air to two or more combustors and adding another thermal diluent such as water and/or steam to cool the combustion. The surplus compressed air that is provided by a typical Brayton cycle may be sufficient for three or more combustors/turbines of approximately the same specific power as the original Brayton cycle combustor. The additional process fluid and heat could be used to augment a single process flow or to drive separate heavy hydrocarbon extractions (e.g., separate wells) or other process applications, such as the extraction of heavy hydrocarbons from mined material.

The relative capital cost of the configuration shown in FIG. 8 may be the higher than previous configurations. However, the total process fluid and heat flow of this configuration may be more than double that of the previous configurations, e.g., the 2nd expander 602 may not have to drive a compressor. The second combustor/turbine/generator may be chosen to provide more electrical power than the first. The first expander 601 may also be configured with a generator to provide additional power. The capital cost of this configuration may be less than double that of the previous configurations (see, FIG. 2 and FIG. 3) since only 1 compressor and possibly only 1 generator may be used. Accordingly, the ratio of capital cost to process heat may be lower.

These parallel configurations may reduce capital cost for the extraction rate of heavy hydrocarbons. This configuration may provide more flexibility because the fuel, water and air flows into each combustor 151 and 152 may be adjusted separately. This may provide great flexibility in the amount of process heat and electrical power produced in a VAST GT configuration. The Diverted and Direct VAST GT configurations (see, FIG. 2 and FIG. 3) benefit from the greater capability of water as thermal diluent compared to air (especially liquid water, but also steam) to cool the combustion of fuel and allow for higher fuel flows than the corresponding air-cooled Brayton cycle combustion. VAST GT combustion is expected to provide substantially higher specific heat for each gas turbine, and more process heat per unit of capital expenditure than any air cooled configuration, or configuration with a small amount of inlet fogging or spray.

Referring to FIG. 9, another configuration may use a hybrid Diverted/Direct VAST GT. Compared with FIG. 8, no second expander 602 is provided. Rather, a mixer or direct contact heat exchanger 636 is provided to mix a portion of diluent fluid F45 with the hot reacted gas F11 exiting the second VAST combustor (Thermogenerator) 152 to form a pressurized process VASTgas F61. A generator 800 may be connected by shaft 852 to expander 600. The compressed oxidant F26 for the second combustor or Thermogenerator 152 may be provided by the same compressor 220 used to pressurize oxidant F24 (e.g., air or enhanced oxygen) for the first combustor 150.

The configuration of FIG. 9 may be modified (See, FIG. 8) to use a second fuel pressurizer 320 to pressurize a second fuel or reactant F300 and deliver pressurized reactant F311 to combustor 152. This configuration may be used to delivery and combust heavy hydrocarbons or "dirty" fuels" to form process VASTgas F61 where there are concerns about corrosive, erosive, or slagging properties of the fuel F311 being used in the second combustor (Thermogenerator) 152. The first fuel F33 may be used to start combustor F152 and to support full combustion and/or to provide a flame authority. The second fuel F311 may provide some or all of the heat from combustor 152 to form a high pressure process VASTgas F61. Combustion VASTgas F10 from combuster 150 may be expanded through expander 600 to form expanded fluid F16. This may be cooled by a portion F44 of water to form a low pressure process VASTgas F62. High pressure process VASTgas F61 may be delivered to a geological hydrocarbon resource. Low pressure process VASTgas F62 may be delivered to a vessel processing mined hydrocarbon.

EXAMPLE 8

Using VASTgas to Extract Heavy Hydrocarbons from Mined Material

In Alberta, most of bitumen extraction is by surface mining of oil sands followed by physical and chemical extraction methods. These commonly use hot water, caustic soda (NaOH) and macroscopic physical agitation (stirring) to separate the bitumen from the sand and clay mixture. The process typically utilizes NG to heat water in a boiler and mix it with bitumen in a bitumen separation tank. After processing, the residual hot water is contaminated with incompletely extracted bitumen and suspended sand/clay particulates. This water is typically directed to tailings ponds after post-production waste treatment with flocculent, e.g., crushed gypsum ($CaSO_4$), to promote settling of these suspended particulates.

Another application of VASTgas is to improve the thermal efficiency, extraction efficiency, and/or the environmental impact for the extraction of heavy hydrocarbons in the extraction of bitumen from surface mined oil sand. Examples of the configurations for such applications are shown in FIG. 10, FIG. 11 and FIG. 12. Referring to the first configuration (FIG. 10), VASTgas is adapted from the VAST diverted GT configuration of FIG. 2 as discussed above in examples 3-4. For configuration FIG. 10, heat from exhaust gas F16 is recovered into incoming diluent F41 using the economizer 710 to form heated diluent or water F762. Process VASTgas F61 may be directed to a bitumen separation vessel 660. There it may be injected near the bottom of or part way up the vessel 660 under pressure. This provides noncondensed gases in VASTgas (mostly $N_2$ and $CO_2$) gases to generate bubbles, froth, and convection currents in the separation vessel 660.

The high heat content of the VASTgas (primarily in the water vapor) creates further convection by condensing and heating the water at the bottom of the separation vessel. The heating from the bottom and/or the upward force of $N_2$ and $CO_2$ bubbles may provide more efficient agitation than mechanical stirring. The bubbles produce a froth which may be skimmed off for further separation, e.g., in a centrifuge. This is expected to significantly reduce the residual bitumen in the sand.

The less hydrophilic $CO_2$ bubbles may dissolve in the bitumen while providing distributed agitation, facilitating separation of bitumen from sand. This expected to reduce the energy requirements for bitumen extraction relative to macroscopic mechanical stirring. This VASTgas extraction process may proceed at lower temperatures relative to water extraction while achieving similar or better extraction with lower energy.

The relative efficiency for energy conversion to the delivered process VASTgas F61 in this configuration would be similar to that modeled in example 3 and FIG. 2 (i.e., greater than 90% for a 2 atm GT with diverted flow and air combustion, and greater than 81% for this configuration at 30 atm). Using hot water F430 from the economizer 710 in the bitumen separator 660 is expected to further increase the total system thermal efficiency of the (FIG. 10) configuration relative to that of FIG. 2. Enhanced $O_2$ may be used for combustion, (see FIG. 2) to further increase the thermal efficiency of this process and increase the power density of the configuration shown (excluding the $O_2$ enrichment energy).

Another configuration for enhancing extraction of heavy hydrocarbons is shown in FIG. 11. This VAST direct GT configuration may deliver very high system thermal efficiency (~98%). The $CO_2$ produced by combustion is delivered in the expanded process VASTgas F16 to the bitumen separation vessel or "Heavy Hydrocarbon Separator" 670. High and/or low pressure water F44 may be delivered from water delivery system 410 directly into the heavy hydrocarbon separator 670 without heating since nearly all of the combustion heat in flow F16 is delivered to the heavy hydrocarbon separator 670. The heavy hydrocarbon and alkali sulfate may be separated within the vessel 670. Waste sand, clay and gravel F59 may be removed from the lower portion or bottom of the heavy hydrocarbon separator 670.

Referring to FIG. 11, the convective method and $CO_2$ extraction may be used to provide distributed and macroscopic agitation to the heavy hydrocarbon or bitumen separator 670, to produce a bitumen froth and to enhance the bitumen recovery rate. Electricity to drive the pumps and other process equipment may be provided by the GT used to generate the VASTgas F61. Alternative fuels (e.g., coke) may be used for combustion in a VAST wet combustion turbine.

Referring to FIG. 11, another configuration may be formed for efficient processing of heavy hydrocarbons in mined materials which may use fuel F30 containing an acid-producing constituent, e.g., sulfur. The incoming bitumen stream F51 may be mixed with and/or comprise limestone and/or a limestone slurry sufficient to about neutralize the acidic products of combustion formed by combusting the acid producing constituent(s). There are abundant and inexpensive supplies of sulfur and/or sulfur-containing fuels available in most heavy hydrocarbon producing regions, e.g., millions of tons of surplus elemental sulfur are stockpiled in Alberta. This may be used as a very inexpensive fuel that would significantly reduce the use of expensive clean-burning NG fuel. Bitumen also contains about 5% sulfur by mass.

Such sulfur-containing fuels F30 may be burnt in pressurized oxidant fluid F24, e.g. air or oxygen, to form combustion VASTgas F10 comprising mixtures of gaseous $SO_2$ and $SO_3$. This configuration may control the combustion temperature in combuster 150 and the expansion ratio of expander 600 to maintain the temperature of the expanded process VASTgas F16 above the condensation point, i.e., above the boiling point of sulfuric acid at about 290° C. (554° F.). This may reduce or avoid corrosion of turbine blades and other gas path components upstream of the heavy hydrocarbon separator 670. The temperature of the combustion VASTgas F10 may similarly be maintained below a prescribed temperature to reduce or avoid hot corrosion.

Delivering the $SO_2/SO_3$-containing process VASTgas F16 into the separation vessel 670 comprising water and an alkali carbonate (such as limestone and/or dolomite) will cause an exothermic reaction forming sulfuric acid $H_2SO_4$ and then a sulfate salt, e.g., calcium sulfate $CaSO_4$, magnesium sulfate, or hydrated sulfates such as slurried gypsum, and $CO_2$. (See equations 1-5 below) The $CO_2$ produced will create microscopic and macroscopic agitation facilitating separation of bitumen from the sand grains. The heat produced by these exothermic reactions will contribute significantly to the overall heat requirements for the bitumen separation process, for example by burning sulfur or $H_2S$, solvating $SO_2$ and/or $SO_3$, and neutralizing $H_2SO_4$ to form an alkali sulfate, e.g., $CaSO_4$ or Mg $SO_4$, etc. The alkali sulfate formed acts as a flocculent helping to settle fine suspended solids from the resultant water. A portion of hydrocarbon F560 removed from an upper portion of the vessel. A portion of water contaminated with hydrocarbon F38 may be delivered to the combustor 150. A portion of separated hydrocarbon discharge 560 may be delivered as part of fuel fluid F30 delivered to combuster 150 via delivery system 310.

While limestone ($CaCO_3$) may be used, other alkali carbonate may similarly be used to neutralize the acidic sulfur components. Among these are carbonates or bicarbonates of sodium, potassium, calcium and/or magnesium such as $Na(CO_3)_2$, $K(CO_3)_2$, $NaHCO_3$, and $CaMg(CO_3)_2$). The alkali carbonates may similarly be pulverized and introduced into the heavy hydrocarbon separator vessel 670 with the process VASTgas F61 or as a separate stream. The fuel F30 may comprise other acid-forming components, e.g., comprising phosphorous chlorine, fluorine, bromine and iodine, to form corresponding salts.

Hybrid Dual Combustor Diverted/Direct VAST GT.

Referring to FIG. 12, in some configurations, the hybrid diverted/direct VAST gas turbine may be used with dual combustor, e.g., by applying the parallel combustor method such as shown in FIG. 8 and FIG. 9 to one or more configurations shown in FIG. 10 and FIG. 11. As before, a second combustor 152 may be provided with the first combustor 150. Both combustors may be fed by a common pressurizer 220 such as a blower or compressor depending on the design pressure. A separate fuel delivery system 320 may be used for the second fuel flow F300, e.g., comprising a fuel pressurizer or pump. In configurations using a heavy hydrocarbon fuel F300, the fuel delivery system 320 may comprise a method to heat and filter the fuel as desired to deliver it to combustor 152.

Some VAST cycle configurations are tolerant of contaminated water, e.g., such as configurations relating to FIG. 9 and FIG. 12, or as described in U.S. patent application Ser. No. 10/763,057 (Hagen et al.). This contaminated or "dirty" water may contain a portion of hydrocarbon, particulate, and/or dissolved materials. The contaminates may also include soluble and/or insoluble organic materials. In some configurations, waste water F38 may be recovered from the heavy hydrocarbon separator vessels 660 and/or 670. In some configurations, a portion of suspended solids may be separated out prior to use as cooling water for delivery to or downstream of the combustor, e.g., by a centrifuge or filter. In some configurations, contaminated water may be produced in the process of hydrocarbon extraction (e.g., from Tailing ponds), from a centrifuge (e.g., Rag layer), and/or in other processes with wastewater.

Referring to FIG. 24, in some configurations, recovered water or wastewater F400 containing bitumen and suspended solids may be delivered via diluent delivery system 412 as pressurized diluent F412 upstream of the outlet 136 of combustor 152 to control temperatures within and/or exiting the combustor, e.g., through a distributed delivery system 11 comprising multiple injectors or numerous orifices. Such water may be exposed during combustion to high temperatures, e.g., in excess of 700° C., or in excess of 1000° C. A major portion of hydrocarbons in waste water may be combusted or destroyed at such temperatures and may contribute to the fuel requirements of the process. Using wastewater in such VAST cycle configurations may greatly reduce processing waste water in settling ponds.

Further referring to FIG. 24, combustor 152 may be supplied by a pressurizer 220 configured to pressurize oxidant fluid F20 and deliver pressurized oxidant fluid F24, e.g., via a blower or compressor. In some configurations, pressurizer 220 may be driven by a motor as described in the configurations relating to FIG. 1. Similarly, pressurized oxidant fluid F24 may be directed by valve or splitter 633 with a first portion as oxidant flow F27 to combuster 150 and thence VASTgas F10 to expander 600 to drive pressurizer 220 via drive 850 and forming expanded fluid F16, similar to the configuration of FIG. 12. Fluid F16 may be cooled with a portion of water F410 to form low pressure process VASTgas F62. Similarly, a second oxidant flow portion F26 is delivered to combustor 152. Fuel F300 may be pressurized by fluid delivery system 320 and delivered to combustor 152 through injectors or distributed contactor 14. As in FIG. 12, fuel flow F30 may be delivered by fuel delivery system 310 as pressurized fuel flow F310 to combuster 150 along with thermal diluent F40 via diluent delivery system 410 as pressurized diluent flow F41 to combustor 150, e.g., as pressurized water.

Particulate separation: A particulate separator system 532 may be used to separate particulates and/or ash in the hot combustion VASTgas F11 formed by reaction in and/or downstream of a combustor 152. More specifically, the particulate separator system 532 may comprise one or more of a gravity separator 522 towards the bottom of the thermogenerator or combustor 152, a high performance cyclone 526 and/or electrostatic precipitators (not shown). In some configurations, the VAST combustor 152 may be used to treat wastewater F404 pressurized by wastewater delivery system 414 to delivery pressurized wastewater F414 into combustor 152 via suitable injectors, nozzles 11. In some configurations the water in F400 may be evaporated and the suspended solids may be dried during the combustion process. A portion of these solids may be gravity separated into solids flow F593 leaving the combustor.

Particulates in combustor VASTgas F11 leaving the combustor outlet 136 may be separated by cyclone 526 as solids flow F592. One or both of these solids flows F590 and F592 may be removed as flow F594 through a solids expeller 232. Pressurized water F410 may mixed with cleaned VASTgas F15 from the particulate separator 532 via mixer or direct contactor 636 to form process VASTgas F61. This may be delivered to treat mined heavy hydrocarbon and/or delivered underground to extract hydrocarbon from a hydrocarbon resource. In some configurations, the cleaned VASTgas F15 may be expanded through expander 600, or expanded through a second expander (not shown.)

For the configurations described relating to FIG. 10, FIG. 11, and FIG. 12, the vapor in the gaseous exhaust F596 from the separation vessel may be cooled to recover clean water using locally available cooling water. Such a configuration is shown in detail in FIG. 12. In FIG. 11, and FIG. 12, most of the water formed by combustion will condense in the respective heavy hydrocarbon separation vessel 640, 660 and/or 670.

In some configurations, the $CO_2$ may be recovered from gas exhaust F596 bubbling out of the froth recovered from the separation vessel and/or that which would be further concentrated after the condensation of water from the vapor exhaust, may be recovered using related art $CO_2$ separation methods. Given the large amounts of electrical power that may be produced by a VAST GT, some configurations may use some of this power in a refrigeration cycle to first condense clean water from the exhaust and then to condense $CO_2$. This highly concentrated $CO_2$ may be separated as dry ice or pressurized as liquid $CO_2$ for subsequent use, sale, or sequestration. Such processes may be utilized to reduce the additional $CO_2$ released from the bitumen separation process. It may also be used to significantly reduce the amount of $CO_2$ being emitted from existing separation methods.

Referring to FIG. 10, FIG. 11, and FIG. 12, in one or more configurations, the compressed VASTgas may be injected into a bitumen separation vessel 640 and/or 660 at a sufficient rate to locally boil the mixture. In some configurations, such boiling may be confined to a volume near the injection point of the VASTgas by balancing the heat delivery rate by the inflow of colder material, e.g., cold water slurry of heavy hydrocarbon and sand. By balancing the net flow of VASTgas heat into the separation fluid by heat removal, e.g., bitumen froth extraction, the delivery of cooling water and/or the delivery of cooler oil sand slurry, the average temperature of the separation fluid may be maintained within a prescribed temperature range, preferably, below the boiling point and above a the temperature at which the heavy hydrocarbon floats.

For this example, boiling fluids will condense within the separation fluid. Cooling within the fluid causes the bubbles to collapse. This will create violent local agitation to further enhance the separation process. In configurations providing a high concentration of $CO_2$ in the VASTgas and bubbles such agitation may facilitate $CO_2$ solvent extraction of the bitumen from minerals in the extracted hydrocarbon resource.

In some configurations, this local boiling caused by high temperature VASTgas injection into the separation vessel may be further enhanced by injecting $SO_2/SO_3$-containing VASTgas, or other acid forming gas, and delivering pulverized carbonate material, e.g. limestone or another carbonate salt, into the separation fluid. As in the configuration discussed regarding FIG. 11, this sulfuric acid/limestone reaction will enhance the $CO_2$ concentration and local heating and boiling by these strongly exothermic reactions.

Liquid carbon dioxide separation: In another configuration, the heavy hydrocarbon separation process may deliver VASTgas under pressure to facilitate separation with liquid $CO_2$. Carbon dioxide liquefies when pressurized above about 5 atm near room temperature. The bitumen extraction process may be conducted below the critical temperature, i.e., below 31.1° C., and above the condensation pressure of $CO_2$, 7.382 MPa, to provide liquid $CO_2$ to enhance the separation of hydrophobic bitumen from the oil sand sand/clay/bitumen mixture. With a density of 1.03 g/ml, bitumen/$CO_2$ may form a separate phase slightly denser than water.

$CO_2$ is somewhat soluble in water as carbonic acid, e.g., 0.01 g/l (Handbook of Chemistry and Physics, 57th Edition, Chemical Rubber Company Press, 1976-1977). Above that saturation point at high pressure $CO_2$ will form a separate layer apart from water. Heavy hydrocarbon (including bitumen) is expected to separate from the sand and segregate to the $CO_2$ layer.

In another configuration, supercritical $CO_2$ may be used at temperatures above 31.1° C. and pressures above 7.382 MPa where it has a density of about 468 kg/m$^3$. This higher pressure may increase the dissolution of $CO_2$ in the bitumen and the density of about half that of water may facilitate separation of bitumen from water. This may be used to facilitate $CO_2$ separation and/or sequestration after bitumen extraction.

EXAMPLE 9

VAST Wet Cycle GT vs. Brayton (Air or Oxygen Cooled) GT Combustion of NG in Air or Enhanced $O_2$ Referring to FIG. 18, the process heat flow L60 (MW) from a Direct VAST GT configuration is compared with the process heat L61 from a similar Brayton cycle GT configuration with the same total mass flow of fuel oxidant and diluent (water or air respectively) for air combustion of NG. Turbine Inlet Temperature (herein TIT) was nominally assumed to be 1453° C., and combustor outlet pressures were adjusted between 5 and 40 atm. Fuel flow was nominally 0.15 to 1.2 kg/s. For these configurations, the relative air to fuel ratio lambda was controlled to near stochiometric combustion (e.g., $\lambda$=1.05) for these Direct VAST GT configurations. The relative air/fuel ratio lambda X varied in the range of 3.0 for the Brayton GT. The fuel and water flows were adjusted to maintain a constant TIT at constant mass flow, while extra air was used to maintain constant temperature for the Brayton GT.

The Direct VAST GT process fluid enthalpy L60 shows an advantage L62 of 124% over the Direct Brayton GT process fluid enthalpy L61 at 40 atm. The extra nitrogen being compressed in the Brayton GT resulted in lower total energy available in the process fluid. Compressing the diluent nitrogen (about 3 times more) required to cool the Brayton GT combustion lowers the maximum fuel that can be combusted compared to a similar sized VAST GT.

FIG. 19 compares the delivered process fluid pressure L65 for a Direct VAST GT with the delivered process fluid pressure L66 for a Direct Brayton GT, for the model parameters and pressures used in FIG. 18. In such direct GT configurations the work to compress the oxidant fluid comes from expanding the combustion gases. The work required to compress the large amount of excess nitrogen diluent lowers the delivered pressure for Direct Brayton GT relative to Direct VAST GT configurations. This gives a pressure advantage L67 of 67% for the Direct VAST GT over the Direct Brayton GT for a combustor outlet pressure of 40 atm.

FIG. 20 graphs the process heat L70 (MW) from a Direct VAST GT configured to combust NG with 99% $O_2$ (1% $H_2O$) compared to the process heat L71 (MW) from a Direct Brayton cycle GT with the same size compressor. These configurations were modeled similarly to those for FIG. 18. The fuel burned and the water used to cool combustion were adjusted to maintain a Turbine Inlet Temperature of 1,453° C. for the Direct VAST GT L70. The quantity of fuel burned, and surplus 99% oxygen coolant was adjusted in the Direct Brayton GT L71 to maintain the same Turbine Inlet Temperature. Due to water cooling and more fuel being burned, the process heat in this 99% oxygen Direct VAST GT configuration L70 was about 701% higher L73 at 10 atm, and about 931% higher L72 at 40 atm, than the corresponding 99% oxygen Direct Brayton GT. In these configurations, the Direct VAST GT L70 had a $CO_2$ concentration of 9.4 v % to 12.5 v % compared to the Direct Brayton GT L71 of 4.4 v % to 6.0 v %, i.e., $CO_2$ concentrations of about 217% to 208% higher for VAST vs Brayton.

The delivered pressure L75 for the Direct VAST GT is shown in FIG. 21 compared to the delivered pressure L76 for the Brayton GT, for these configurations corresponding to FIG. 20. The Oxygen Direct VAST GT burns more fuel because water cools better than oxygen and requires less pumping work. The delivered process fluid pressure L75 is about 226% higher L77 at about 40 atm with the VAST direct GT than that of the Brayton direct GT, i.e., the delivered pressure is much closer to the compressor pressure with the Direct VAST GT than the Direct Brayton GT.

In the VAST cycle configurations modeled herein, almost all the heat produced by fuel combustion is delivered by the high water content VASTgas. Only a small portion of the combustion heat is lost through conduction, radiation and gas leaks, typically less than 3% for a modern combustion system. By contrast a boiler (or evaporator) with dry combustion produce steam alone, typically exhausts a substantial fraction of the heat, as much as 20-25%, and all of the $CO_2$, to the atmosphere. Even with combustion temperatures near material failure limits, substantial energy losses as much as 10-20% are incurred for water/fuel pressurization, fans or blowers to deliver air and fuel to the combustion chamber and particularly due to residual heat in the exhaust or flue gas. With climate control concerns, VAST configurations delivering the combustion $CO_2$ underground in the VASTgas may have advantages.

In some configurations, the produced heavy hydrocarbon fluid may be exposed to ambient pressure to release the $CO_2$ delivered underground with the VASTgas. This $CO_2$ may be recaptured and recycled for further heavy hydrocarbon extraction, using relevant art $CO_2$ separation technology (e.g., pressurization with cooling or absorption/desorption). This may provide environmental benefits while increasing the heavy hydrocarbon extraction efficiency with increased revenues.

Some VAST configurations may use high water to fuel ratios with air to fuel ratios close to the stoichiometric ratio. Most Brayton cycle or dry combustion systems operate with large ratios of surplus air; typically 2, 5, or 8 times the stoichiometric ratio, depending on the combustion temperature and technology (i.e., lambda $\lambda$=2, 5, 8). In high water ratio VAST wet combustion or wet cycle configurations, water or steam provide more effective cooling than air. The advantages of water or steam to control combustion are further described in U.S. patent application Ser. No. 10/763,057 (Hagen et al.).

Using VASTgas as a source gas for heavy hydrocarbon extraction may provide one or more of combustion temperature control, delivery temperature control, high $CO_2$ concentrations, enhanced heavy hydrocarbon extraction rate, higher extraction efficiency, and compositional control or flexibility in portions of steam and $CO_2$ in the VASTgas. In the configurations the examples above, a higher temperature or superheated process gas may be provided by controlling the total water mixed with the products of combustion.

In some configurations with water (or steam) thermal diluent F40 to cool combustion, the surplus oxidant containing fluid (e.g., air) F20 may be substantially reduced, e.g., from lambda ($\lambda$) of about 8 or 5 or 3, down to about 1.5, or down to about 1.05, or close to the stoichiometric ratio. This reduces the air compression work (particularly when elevated pressures are needed to deliver process fluid into a heavy hydrocarbon formation) and/or reduces the portion of $N_2$/Ar in the delivered process fluid or VASTgas F70.

Some relevant art systems use air to fuel ratios for combustion with water injection near the "Cheng point", as described in U.S. Pat. No. 5,233,016 (Cheng), herein incorporated by reference. The Cheng point offers efficiency advantages for generating electricity. Some VAST configurations may produce electricity and deliver process VASTgas using relative air to fuel ratios between 90% of the Cheng point and the stoichiometric point, i.e., lambda ($\lambda$) between 90% of Cheng to 1.0. This combination may provide improved combined heat and power (CHP). This may reduce the compression work of delivering process fluid for heavy hydrocarbon extraction comprising non-condensable gases.

In some configurations, the nitrogen/argon in VASTgas (e.g., 38.5%, see Table 2) may provide some benefits similar to the SAGP process, among them insulating the heated cavity, reducing heat losses to the over-burden or surrounding formations, and reducing the condensation of steam in the delivery path, per Jiang, et al., "Development of the Steam and Gas Push (SAGP) Process", GravDrain, Paper No. 1998.59, pp. 1-18 (1998), and U.S. Pat. No. 5,607,016 (Butler, et al.). The lower steam fraction and condensation with VASTgas may facilitate use for deep well extraction or laterally extended SAGD well extraction. VASTgas with higher $CO_2$ (e.g., 3-4.6%) may promote dissolution in heavy hydrocarbons and improve extraction by increasing mobility. See, U.S. Pat. No. 5,056,596 (McKay, et al.). The higher heat content of VASTgas than conventional flue gas may improve heat transfer to and mobilization of underground heavy hydrocarbons.

VAST wet combustion configurations may use combustion across a wide temperature range with diluent delivered upstream of the combustor outlet to form combustion VASTgas, e.g., from about 400° C. to 1500° C. as desired, by using water and/or steam diluent.

The temperature of the delivered process VASTgas may be similarly controlled from about 50° C. to 1450° C. by mixing with water/steam upstream of the process VASTgas delivery. For example, combustion at about 1035° C. as shown in example 1 for VASTgas delivered at about 482° C., and similarly delivering VASTgas at temperatures down to 100° C., by adding more diluent water. Such configurations may be used to provide VASTgas with high portions of steam in the VASTgas, e.g., >50%.

In such configurations, the diluent delivery before/after combustion may be adjusted across a wide range as desired, while maintaining the temperature, pressure, $CO_2$ content and heat content of the delivered VASTgas at prescribed conditions.

In some configurations, VASTgas may be pressurized to the fracture design limit, to improve heat transfer to the resource and/or to increase $CO_2$ solubility in heavy hydrocarbons and their extraction efficiency. See, Deo, et al. Industrial Eng. Chem. Res., Vol. 30, no. 3, p 532-536 (1991). This may use gas turbine air compression, e.g., see examples 3 and 4 above.

One configuration of a pressurized wet cycle combustor or Thermogenerator is shown in FIG. 1. Table 3 shows configurations of wet combustion process fluid (VASTgas) v. pressure. FIG. 13 shows thermoeconomic (Thermoflex) modeling for such configurations of the relative overall efficiency for a wet combustion VAST burner, line L21, v. that for a dry combustion "flue gas", line L22, compared to steam generation in a boiler, line L20. In the VAST burner configuration line L21, compressed air as oxidant fluid is assumed provided by an air turbine compressor, with pressurized fuel and water from fuel and water pumps, at various air compressor and combustion pressures. The system thermal efficiency to process fluid delivered assumes shaft power driving the compressors was supplied at 40% conversion efficiency from fuel to shaft power. The atmospheric pressure point is taken from the example described in Table 2.

In FIG. 13, line L20 (squares) shows comparable relative system thermal efficiency for dry combustion boilers (or evaporators) producing 100% steam at 100° C. (or higher at higher pressure to prevent condensation) assuming a dry combustion temperature of 1035° C. The air flow of the dry combustion comparison is modeled at 17.3 kg/s while the fuel flow is kept constant at 0.45 kg/s (equivalent to the wet combustion model). This fuel and air flow is equivalent to $\lambda$=2.2. The flue gas from the dry combustion is considered to be vented into the air and its heat content lost to the system. A higher lambda (more air cooling) and lower combustion efficiency would have been necessary to provide an equivalent combustion temperature to that of the wet combustion case.

There is a more significant decline with pressure in overall thermal efficiency for the case of wet combustion, line L21 (diamonds) compared to the steam boiler, line L20, due to the energy losses (at 40% electrical efficiency) of air compression for wet combustion. The cross-over point for relative efficiency between the wet combustion model which includes a considerable amount of lost efficiency to compress the air used in combustion and the dry combustion comparison is at approximately 2.5 atm (~250 kPa). The injection of VAST cycle VASTgas for heavy hydrocarbon extraction at any pressure below 2.5 atm produces VASTgas with greater overall thermal efficiency. At pressures above 2.5 atm, a VAST cycle burner has lower overall thermal efficiency but still produces VASTgas containing substantial amounts of $CO_2$ (typically>4 mole %). In addition, the VAST cycle VASTgas also contains non-combustible gas (e.g., N2) which should contribute to insulation of the cavity from the overburden as is found for SAGP technology.

FIG. 14 compares the system thermal efficiency of process VASTgas for a VAST combustor, Diverted VAST GT, Direct VAST GT, vs a steam boiler. Line L25 shows the simulated efficiency data for the steam boiler and line L26 for the VAST combustor VASTgas as shown in FIG. 3. Line L24 shows simulation data for the diverted VASTgas from a Diverted VAST GT "VAST GT-diverted" (see the configuration shown in FIG. 2). Line L23 shows the performance of VASTgas delivered from a Direct VAST GT ("VAST GT-direct") (see the configurations shown in FIG. 3). The VAST GT-direct VASTgas L23 has been expanded in a turbine resulting in a lower delivered pressure (2-3 times lower).

FIG. 15 shows further configurations from NG combustion with a thermoeconomic models comparing wet combustion (VASTgas) line L28, with a steam boiler, line L30, and a Direct VAST turbine exhaust (Direct VAST GT) line L27 in terms of the total heat delivered from the combustion system. The data shown in FIG. 15 was calculated using the same model parameters (e.g., 0.45 kg/s of fuel flow for both, 1035° C. Turbine Inlet Temperature for the wet combustion temperature and 1035° C. for the dry combustion boiler steam temperature) as that used to generate the data for FIG. 13 and FIG. 14. These show the amount of heat (enthalpy) in the gas delivered from the respective combustion systems. The amount of heat actually transferred to a heavy hydrocarbon formation must include losses in the delivery system, to the overburden, to the shaft upstream of the desired delivery location, and sensible heat transfer limits, must also be considered when considering the conditions for extracting heavy hydrocarbons from a heavy hydrocarbon containing formation.

The starting point for these calculations is the heat delivered from the combustion system. The overall heat delivered in VASTgas, line L21, by wet combustion is greater than the amount of heat delivered by dry combustion flue gas, line L22, for all of the pressures shown in FIG. 13. This is because in the case of dry combustion, some heat (and water vapor/steam and $CO_2$) is always lost in the exhaust. in VAST systems, all of these combustion products that would otherwise be lost, are delivered to the formation through the use of wet combustion VAST gases (VASTgas). The amount of heat that would reach a heavy hydrocarbon formation would be dependent on the depth of the formation and the porosity characteristics of the formation. However, losses to the delivery system and in the well would be expected to be lower in the case of the VASTgas because of lower levels of condensation due to the lower concentration of steam present in the VASTgas (i.e., 50-70% instead of 100% as in the case of a boiler).

FIG. 13 shows the system thermal efficiency of a VAST thermogenerator or combustor configuration vs. a standard boiler. These are configured for 0.45 kg/s (1 lb/s) natural gas fuel, air oxidant, and a combustor outlet temperature of 1035° C. Line L20 shows the thermal efficiency of a boiler raising steam versus steam pressure (atm). Line L21 shows the system thermal efficiency % of a VAST thermogenerator delivering VASTgas with 4.6% $CO_2$ versus combustor pressure. Line L22 shows the system thermal efficiency of dry combustion flue gas delivered with 1.9 v % $CO_2$.

FIG. 14 shows the system thermal efficiency of a Diverted VAST Gas Turbine on 0.45 kg/s (1 lb/s) natural gas delivering process VASTgas at 1035° C., compared to a standard boiler. Line L25 (squares) shows the system thermal efficiency of a boiler raising steam versus pressure (atm). Line L26 shows the system thermal efficiency (%) of a VAST thermogenerator delivering VASTgas with 4.6% $CO_2$. Line L24 shows the system thermal efficiency of VASTgas from a Diverted VAST gas turbine with 1035° C. TIT. Line 23 shows the system thermal efficiency of VASTgas from a Direct VAST gas turbine with process fluid reduced 46% to 67% from the combustion pressure for air, and 8% to 31% reduction from combustor pressure for oxygen combustion. The Diverted VAST GT and Direct VAST GT configurations show higher efficiencies than the other system, up to the point of gas delivery.

FIG. 15 shows the heat delivered (MW) via process VASTgas L29 from a Diverted VAST Gas Turbine configuration on 0.45 kg/s (1 lb/s) natural gas delivering process VASTgas at 1035° C., compared to steam line L30 from a standard boiler versus combustion pressure or steam pressure (atm). Line L28 shows the process heat (MW) of a VAST thermogenerator configuration delivering VASTgas. Line L27 shows the process heat (MW) of VASTgas from a Direct VAST gas turbine with process fluid reduced 46% to 67% from the combustion pressure for air, and 8% to 31% reduction from combustor pressure for oxygen combustion. The Diverted VAST GT and Direct VAST GT configurations show higher efficiencies than the other systems, up to the point of gas delivery.

FIG. 16 summarizes the process heat delivered (MW) from the combustion systems at a constant fuel flow of 0.45 kg/s (1 lb/s), (boiler, VAST combustor, VAST GT-diverted, VAST GT-direct), relative to the volume % of $CO_2$ created by natural gas and coke combustion as shown in Tables 1, 2, 3, 4 and 5. VASTgas is shown with a Turbine Inlet Temperature of 1035° C. at a near stoichiometric relative air/fuel ratio lambda of 1.05. A higher process heat flow provides more heat in the process VASTgas delivered to the hydrocarbon formation in question. This is expected to provide a higher rate of heavy hydrocarbon recovery.

Referring to FIG. 16, higher carbon dioxide volume is expected to better mobilize heavy hydrocarbon and increase the total fraction extracted. L40 shows the current SAGD paradigm with a boiler on natural gas or coke. L41 shows an air blown VAST thermogenerator on coke has about twice the carbon dioxide concentration of an air blown Diverted VAST GT on natural gas L44. L42 shows a similar air blown VAST thermogenerator on natural gas. L43 shows a air blown Direct VAST GT NG.

FIG. 17 summarizes the process heat delivered (MW) from the combustion systems (boiler, VAST combustor, VAST GT-diverted, VAST GT-direct), relative to the volume % of $CO_2$ created by combustion in those configurations for NG combustion and for the combustion of coke (with the composition as specified in Table 3).

The Y-axis of FIG. 17 shows the process heat (MW) delivered from the configuration or system with fuel adjusted for constant mass flow (relative to 0.45 kg/s (1 lb/s) of natural gas fuel in a boiler is combusted to deliver VASTgas with a Turbine Inlet Temperature of 1035° C. at a near stoichiometric relative air/fuel ratio lambda of 1.05. A higher process heat flow provides more heat in the process VASTgas delivered to the hydrocarbon formation in question. This is expected to provide a higher rate of heavy hydrocarbon recovery. Point L45 shows the current SAGD paradigm with a boiler on natural gas or coke. Point L46 shows an air blown VAST thermogenerator configuration burning coke which gives about twice the carbon dioxide concentration of an air blown Diverted VAST GT on natural gas L49. Point L47 shows a similar air blown VAST thermogenerator configuration burning natural gas. Point L48 shows an air blown Direct VAST GT configuration burning NG. By contrast, a 99% oxygen blown Direct VAST gas turbine configuration burning natural gas is shown as L50 with about five times the process heat for the same total mass flow.

A higher $CO_2$ content in the process flow is expected to increase the rate of heavy hydrocarbon recovery and/or increase the total fraction of heavy hydrocarbon recovery because of the substantial solubility of $CO_2$ in hydrocarbons. The use of VASTgas from NG combustion instead of pure steam raises the $CO_2$ level from zero to about 3-4 v % (depending on the amount of water added to the VASTgas and its temperature). Burning coke raises the $CO_2$ content to the 6-7 v % range. Burning bitumen would raise the $CO_2$ content to the 4-6 v % range because of the higher carbon content of bitumen compared to natural gas. VAST wet combustion has been shown to be stable over a wide range of fuels types and combustion conditions, e.g., U.S. patent application Ser. No. 10/763,057 (Hagen, et al.). Heated bitumen may be used as a fuel in some configurations.

Large steam pipes used in SAGD (or SAGP) hydrocarbon extraction occupy large areas and lose substantial heat to the air. These pipes require expensive insulation (especially in the winter), and are costly. Wet combustion with $CO_2$ injection reduces the need for large central high pressure boilers and steam pipes to individual wells. Lower pressure can be used with the enhanced extraction rate of the $CO_2$-containing VASTgas. Bitumen extracted in place may be used as fuel in some embodiments. Water for controlling process VASTgas temperature may be obtained from surface waters or from groundwater. The use of in situ fuel source reduces the need for piping and disturbance of the landscape. Multiple modular wet combustors or VAST GTs may be distributed to deliver energetic fluid to local wells (or to well "pads" feeding closely spaced group of wells). This reduces heat transmission losses and reduces requirements for expensive steam pressure piping.

In some configurations, the concentration and pressure of $CO_2$ in VASTgas may be increased relative to steam or dry combustion. This may increase the dissolution rate of $CO_2$ in heavy hydrocarbon, thereby decreasing its viscosity and increasing its mobility. This may further reduce the heat required to mobilize the heavy hydrocarbons and/or increase the hydrocarbon extraction efficiency from a given formation. Several methods and sources may be used to add $CO_2$ to a gas stream.

Burning coke to enhance carbon dioxide: In some configurations, high carbon content fuel (e.g., coke, coal or bitumen) may be used for combustion (see Table 2). Coke is one of the byproducts of bitumen upgrading to synthetic crude oil which is available in large quantities in Canada's oil sand regions. Finely pulverized coke may be mixed together with another liquid fuel, with aqueous diluent, and/or with oxidant fluid when delivering it to the VAST combustor.

Burning sulfur to enhance carbon dioxide: In some configurations, an acid (particularly sulfuric acid, $H_2SO_4$) or acidic material may be reacted with a carbonate salt (e.g. with limestone, $CaCO_3$), according to the following (generalized) reaction:

$$CaCO_3(s)+H_2SO_4(g \text{ or } aq) \Rightarrow H_2)(g \text{ or } l)+CaSO_4(s)+CO_2(g) \quad \text{Eq. 1}$$

The states shown in Eq. 1 are generalized. The carbonate or limestone for the reaction with $H_2SO_4$ or $SO_3$ may be provided as a powdered carbonate/water slurry injected into a VAST cycle wet combustor. The water may provide thermal diluent to control the combustion temperature of the wet combustion, i.e., it may conduct the reaction of $SO_3$ in the gaseous state and convert water to steam. Pulverized limestone may be mixed with a high temperature products of combustion and calcined. The $CO_2$ produced by calcining the limestone and/or carbonate/sulfuric acid reaction may be mixed with the process fluid and delivered to contact the heavy hydrocarbon material in an underground formation and/or mined hydrocarbon material.

In some configurations further water may be used to control the temperature from the heat released from water reacting with sulfur combustion reaction products. Some configurations may deliver pulverized carbonate to react with $SO_2$ and/or $SO_3$ to form products of reaction comprising carbon dioxide, sulfite salts, sulfate salts (Eq. 1), calcium oxide (lime) and/or calcium hydroxide.

Particulate separation: Referring to FIG. 24 as described above, the diluent or water flow F400 may comprise carbonate salts in solution or as a slurry to be delivered in into combustor 152 together with fuel F30 comprising sulfur or other acid forming components. The particulate separator 532 may be used to separate such salts formed by reaction in and/or downstream of a combustion chamber. In particular, the particulate separator 532 may comprise one or more of gravity separation to the bottom of the thermogenerator 152, a high performance cyclone 526 and/or electrostatic precipitators (not shown). In some configurations, a major portion of the salts and particulates may be separated out by the particulate separator 532.

In a pressurized configuration a pressurized extractor 232 may be used to withdraw particulates and/or salts such as formed by the acid/limestone reaction (Eq. 1), for example, in configurations using a wet combustor, a Direct VAST GT and/or a Diverted VAST gas turbine, or hybrid combinations thereof. These use pressurized fuel supply 320, pressurized diluent supply 412, and oxidant pressurizer 220, to perform pressurized combustion in reactor 152. The pressurized extractor 232 may include, for example, screw extractors and lock hoppers. The cleaned pressurized combustion VASTgas F61 may then be delivered to heavy hydrocarbon material located in an underground geological formation or in a pressurized or unpressurized heavy hydrocarbon (e.g., bitumen) separation vessel.

Sulfuric acid may be formed by combustion of elemental sulfur, of which there is such an abundance in Western Canada, according to the following (generalized) reactions:

$$S(s)+O_2(g) \Rightarrow SO_2(g)-(\text{heat of combustion}=4.6\ \text{MJ/kg of S}) \quad \text{Eq. 2}$$

$$SO_2(g)+\tfrac{1}{2}\,O_2(g) \Rightarrow SO_3(g)\ (\text{heat of combustion}\sim 1.5\ \text{MJ/kg of S}) \quad \text{Eq. 3}$$

$$SO_3(g)+H_2O(g) \Rightarrow H_2SO_4(g)\ (\text{heat of reaction}\sim 1.1\ \text{MJ/kg of S}) \quad \text{Eq. 4}$$

$$H_2SO_4(g)+2H_2O(1) \Rightarrow SO_4^{2-}(aq)+2H_3O^+(aq)\ (\text{heat of hydration}=27.5\ \text{MJ/kg}) \quad \text{Eq. 5}$$

Mixing coke (~20 MJ/kg) or another high BTU content fuel (e.g., bitumen, or natural gas) with sulfur (S) may be used to increase the combustion temperature of the relatively low heat content sulfur. The subsequent reactions of $SO_2$ and $SO_3$ with water to form aqueous sulfurous acid or sulfuric acid respectively are highly exothermic. The reaction of sulfuric acid with limestone to form $CO_2$ and $CaSO_4$ (or the reaction of sulfurous acid with limestone to $CO_2$ and $CaSO_3$) is also exothermic (Eq. 1). One or more of these reactions may occur to some degree and increase the heat released for the overall wet combustion reaction more than that of coke or NG alone. This process may be used to produce excess $CO_2$ by these reactions to enhance heavy hydrocarbon production as described previously.

These byproducts of the overall sulfur carbonate reaction, may be sold for commercial applications. e.g., cement production, or as a flocculant to consolidate wastewater tailings for surface mined bitumen production. The combustion of solid sulfur forms $SO_2$ and then $SO_3$. The reaction of $SO_2$ and/or $SO_3$ with limestone or Calcium Oxide forming anhydrous calcium sulfite or sulfate produces considerable amounts of heat. The total reaction energy for Eq. 2-5 and Eq. 1=56.25 MJ/kg of S, or about 280% of that of coke.

Similarly, the reaction of $SO_2$ and/or $SO_3$, with water and/or limestone in lower temperature gaseous fluids or in aqueous solution or water slurry form $CO_2$ and $CaSO_4 2H_2O(s)$. At about 177° C. (350° F.) endothermic hydration of anhydrous calcium sulfate forms calcium sulfate hemi-hydrate ($CaSO_4*0.5H_2O(s)$—plaster of Paris) with a heat of reaction of about 2.2 kJ/mol. At about 149° C. (300° F.) exothermic hydration of plaster of Paris forms calcium sulfate dihydrate ($CaSO_4*2H_2O(s)$—gypsum) with a heat of reaction of −17.2 kJ/mol. These reactions together may provide further heat that may be recovered, and/or delivered to heavy hydrocarbon processing or extraction.

In other configurations, fuel comprising sulfur may be combusted, e.g., bitumen (typically ~4.8% sulfur content) or "sour gas" (which contains high quantities of $H_2S$). The total free reaction energy liberated by the combustion of $H_2S$ to $SO_2$ and $SO_3$ and its subsequent reaction with limestone is greater than 56.25 MJ/kg of S. In some configurations, a limestone or lime and water slurry may be mixed with the acidic gases produced by the combustion of such high sulfur fuels, to produce additional $CO_2$ in a wet combustion cycle. Some configurations may use a VAST combustor or thermogenerator for direct delivery. Similar configurations may use a diverted VAST gas turbine. Other configurations may use a direct VAST gas turbine, with acceptable corrosion rates, e.g., by maintaining the combustion gases above the boiling point while in contact with downstream turbine blades, to hinder the condensation of liquid corrosive acids such as sulfuric acid.

The reaction of elemental sulfur or $H_2S$ to form sulfur oxides may form $SO_2$, especially in low temperature combustion reactions or with inadequate oxygen to facilitate the oxidation of $SO_2$. The subsequent oxidation of $SO_2$ to form $SO_3$ has been performed successfully for many years in the commercial production of sulfuric acid. This reaction is commonly driven to completion by using a vanadium catalyst. In some configurations, high reaction temperatures with surplus oxygen may be used to oxidize $SO_2$ to form $SO_3$, e.g., typically above 800° C. Some configurations may use the range of 900° C. to 1150° C., or the temperature range between 1000° C. and 1050° C. in the presence of surplus oxygen.

Sulfur dioxide oxidation may be facilitated by using relatively long residence times in configuring wet combustion systems. Producing high levels of $SO_3$ in the reaction of fuels containing S (e.g., Eq. 3 above), may be used to increase the amount of reaction heat and the reactivity of the subsequent acid/carbonate salt reaction.

In some configurations, the reaction may be configured to react $SO_2$ with water and a carbonate salt to produce primarily sulfite salts (instead of sulphate salts). This may be used to reduce corrosion rates and/or to produce low temperature VASTgas. Sulfurous acid is a weaker acid than sulfuric acid and may be less corrosive for some components.

These methods describe multi-step exothermic chemical processes to use combustion or reaction energy of low cost elemental sulfur or sulfur compounds and their reaction products with carbonate salts (especially limestone) to produce heat, $CO_2$, and sulphate and/or sulfite salts. The $CO_2$ and heat produced by these reactions may be used to increase the thermoeconomic extraction efficiency of heavy hydrocarbons by delivering or injecting the combustion products to process heavy hydrocarbon materials.

In some configurations, these methods may be used to deliver process VASTgas F61 to mining and extraction processes for heavy hydrocarbons in a heavy hydrocarbon resource 886 below overburden 882 as shown schematically in FIG. 22. This in situ process is herein called by the acronym "S.O.I.L.C.A.P." for "Sulfur Oxide Injection into Limestone for Carbon dioxide Assisted Push". Process VASTgas F61 may be delivered through wellhead 620 into the injection well 625 which may be near or in a limestone resource 888 or limestone bedrock 896. In particular, combustion may have Water/Fuel (W/F—omega (ω))>1:1. In some configurations the injected process VASTgas F61 may be generalized to include superheated VASTgas and/or enhanced $CO_2$ process VASTgas F61. This may be desirable if there are substantial amounts of liquid water present near the injection well 625 and/or if the acid/limestone reaction can provide a substantial portion of the $CO_2$ required for the mobilization of heavy hydrocarbons, e.g., near the bottom of a geological hydrocarbon resource.

The SOILCAP method may increase the EROEI of heavy hydrocarbons and especially for currently uneconomical heavy hydrocarbons. Most of the reaction heat provided by the acid/limestone reaction in the SOILCAP reduces the amount of combustion energy conventionally required for SAGD. The heat generated by the acid/limestone reaction substitutes for the energy normally required to generate steam in a SAGD (or SAGP) process. This acid/limestone reaction energy and solvation of $CO_2$ both benefit hydrocarbon extraction.

Many oil sand deposits, especially those in Western Canada, are near limestone deposits or bedrock. Such limestone is commonly associated with or near substantial quantities of liquid or absorbed water. In some configurations, a well may be drilled into the limestone resource, layer, or bedrock in areas underlying, near, or within bitumen containing oil sand. More specifically, this may be a horizontal well approximately parallel to the limestone/sand boundary layer. Such a well may be used to access the sub-surface limestone with injected gases or liquids. Pressurized combustion gases (e.g., VASTgas) may be produced in a wet combustor and contain significant quantities of sulfur oxides and steam to inject a well drilled into and/or near such limestone resource or bedrock. In particular, this may use one of greater than 1:1 water to fuel ratio by mass, and greater than 4:1 by mass.

In some configurations, condensation of steam from combustion gases and/or the reaction of sulfur oxides with water in or near the upper layers of the limestone, may be used to facilitate the reaction of such sulfur oxides with the limestone to produce heat, $CO_2$ and sulfate salts near the heavy hydrocarbon resource, e.g., acid/limestone reaction inside and/or near the well. Given the relatively high heat of reaction for the acid/limestone reaction, such configurations may use in situ reaction to provide high heat transfer to areas accessible from the injection well and to produce significant quantities of pressurized $CO_2$ from limestone. Such configurations may be used to provide heat and pressurized $CO_2$ near bitumen (or other heavy hydrocarbon) containing resource. This helps mobilize the heavy hydrocarbon by reducing its viscosity by heating and/or solvation by $CO_2$. i.e., in methods similar to process described herein for injecting VASTgas into buried heavy hydrocarbon formations.

An extraction well or wells may be drilled in the vicinity of the injection well to access and extract this mobilized bitumen in some configurations. Such extraction wells may be displaced laterally or vertically from the injection well to facilitate efficient removal of the bitumen mobilized the heat and $CO_2$ from the acid/limestone reaction described above. Given its relatively high heat of reaction, the acid/limestone reaction may be used to heat the bitumen and create high pressure by releasing $CO_2$. This may dissolve in and form "live" bitumen.

Such configurations may use gas lift of "live" heavy hydrocarbon, and/or pump technology similar to that used to recover bitumen mobilized in the SAGD or SAGP processes. Dissolved $CO_2$ may reduce and/or provide the pumping energy required to extract the bitumen through the extraction well.

Some configurations may use the above-mentioned multi-step sulfur reaction method to increase the heat energy and $CO_2$ available for bitumen extraction. These may use a combination of the VASTgas generated using the various methods described above with said acid/limestone reaction. The percentage and flow rates of injected sulfur-containing gases and/or VASTgas temperature and pressures may be controlled to increase or maximize extraction rates and/or extraction efficiency. These may be controlled depending on the limestone available near the bitumen resource and/or the changes desired during the extraction process. For example, in some configurations, the initial phase of extraction for the bitumen may use a high rate of sulfur oxide injection and acid/limestone reaction. After this initial phase and mobilization of proximate bitumen, lower rates and/or percentages of sulfur oxide may be delivered while increasing the pressure and/or temperature and/or concentration of $CO_2$ in the process fluid delivered to the extraction site through the injection well.

In some configurations, the number and location of injection and extraction wells may be varied to increase or optimize the overall efficiency and/or rate of bitumen extraction. They may compensate for variations in oil sand porosity and limestone permeability and/or the amount of sulfur oxides and $CO_2$ delivered. In locations with low concentrations of bitumen in the oil sand, configurations may use lesser amounts of $CO_2$ (both injected and generated in situ by the acid/limestone reaction). Depending on the economics, higher levels of $CO_2$ may be utilized to increase the rate of extraction from a low level bitumen formation.

Referring to FIG. 23, in another embodiment, a multi-step SOILCAP method may be used, e.g., slurried limestone in F63 used in the acid/limestone reaction may be delivered from above surface 880 into wellhead 620 through overburden 882 to the oil sand resource 886 or to a cavity or well 620 drilled into the oil sand from heel end 94 to toe end 95, prior to injecting sulfur oxide containing gases F61. This method may provide independent control of the amount of slurried limestone F63 and sulfur oxide gases in process VASTgas F61 and/or improve the extraction efficiency. In some configurations, the amount of limestone delivered during a "charging phase" (initial injection of limestone or like carbonate material) through the injection well 624 (and/or nearby limestone injection well) may be adjusted independently of the amount of sulfur oxides delivered through the same (and/or nearby) injection well(s) at a later time.

Referring to FIG. 23, limestone injection may be alternated with injection of sulfur oxides via VASTgas F61. Powdered limestone slurry may be injected through one horizontal injection well 624 into hydrocarbon resource or oil sand 886. Then sulfur oxide containing gases (preferably mixed with steam and $CO_2$ from a wet combustion process) may be injected into an adjacent horizontal well drilled into the oil sand. The pressure and temperature of the sulfur oxide containing gases in the second well may be controlled to manage the delivery of those gases into the first horizontal well containing the powdered limestone slurry to facilitate the acid/limestone reaction. That reaction may controlled by further injection of limestone slurry and sulfur oxide gases into the two respective wells.

In some configurations, the two step injection of limestone slurry and sulfur oxide containing gases may be conducted by drilling wells with two (or more) shafts with deliberate cross-over or overlap between each well. This may provide a greater volume for the subsequent injection and reaction of a limestone slurry and sulfur oxide gases. This arrangement is similar to that mentioned above (example 8) for facilitating the acid/limestone reaction in bitumen separation vessels containing mined oil sand. In the case of sub-surface process(es) with overlapping or cross-over wells drilled to facilitate the reaction, limestone may be injected into a lower well(s) and sulfur oxide gases injected into an upper well(s).

In some configurations, one or more long horizontal wells 624 or overlapping wells may be used to facilitate the acid/limestone reaction, e.g., to increase the volume available for limestone slurry injection and reaction. Such a horizontal well 624 may be penetrated by either vertical well 620 or horizontal wells drilled to the provide injection of sulfur oxide containing gases to contact and react with the limestone slurry. Limestone slurry and sulfur oxide containing process VASTgas F61 may be injected continuously at a rate sufficient to create heat and $CO_2$, to mobilize proximate bitumen, e.g., by injecting powdered limestone slurry in one well, while at the same time or soon thereafter, injecting sulfur oxide containing gases into one or more other injection wells, i.e., into lower well 524 and upper well 624 respectively.

Such a continuous process might accumulate calcium sulfate or sulfite salts as a product of the acid/limestone reaction in and around the reaction sites. In some configurations, this may be avoided or alleviated by drilling additional wells overlapping or crossing-over the injection wells for sulfur oxide gases for further limestone injection. In another configuration, water and $CO_2$-containing gases may be injected into the original limestone slurry injection wells under pressure to dissolve the sulfate (or sulfite) salts and move them into the surround heavy hydrocarbon containing oil sand.

A potential restriction on the amount of limestone that may be reacted with acid or sulfur oxide containing gases in either of the SOILCAP methods described above is the accumulation of sulfate or sulfite salts on the surface of the limestone particles as the reaction proceeds. Such reaction limitations are encountered during desulfurization processes for coal exhaust. However, the higher solubility of calcium sulfate (or sulfite) salts compared to carbonate salts may ameliorate such sulfate passivation in aqueous solution. The solubility of $CaSO_4$ in water at 25° C. is 0.24 (small but significant) while that of $CaCO_3$ is lower at 0.01 g/l at 25° C. See, Handbook of Chemistry and Physics, Chemical Rubber Company, 75th Edition, 1977-1978. As these sulfate salts are created by the acid/limestone reaction in aqueous solution, they will tend to dissolve and allow for a new limestone surface ready for reaction with more acid.

In some configurations, the above mentioned method may be performed by suspending small limestone particles in gaseous flow with injecting high temperature sulfur oxide gases. Such mixtures may be injected directly into an injection well drilled into the target oil sand. This may provide for sulfur oxide reactions with limestone during passage of the reaction gases through to the target bitumen (or other heavy hydrocarbon) locations. The reaction may produce more $CO_2$ and heat during the time of passage, further facilitating the mobilization of heavy hydrocarbons in the target region.

In some configurations, wet combustion VASTgas for hydrocarbon extraction may be used with additional VASTgas producing electricity and clean water. Such additional VASTgas may be produced in the same system. For example, economic model results described above assumed producing electricity at 40% thermal efficiency. A high pressure gas turbine system with excess capacity may be used to divert excess high pressure VASTgas to heavy hydrocarbon extraction and/or producing electricity via a power turbine.

Converting a Brayton cycle to a VAST wet cycle, e.g., as in U.S. patent application Ser. No. 10/763,057 (Hagen et al.), produces considerable additional capacity because of the higher cooling capacity of water versus air. Additional fuel may be used to increase the heat produced by a given combustion system. This additional capacity may be used to provide additional VASTgas for heavy hydrocarbon extraction and/or production of electricity and/or clean water. Clean water may be condensed as a by-product of the wet combustion of hydrocarbons. Such combustion may produce 3 times as much clean water as dry combustion of a similar amount of fuel.

These inventive methods for increasing the extraction rate or efficiency for mining or extracting bitumen may be generalized and applied to other heavy hydrocarbons, e.g., to heavy oil or kerogen (shale oil). Most efforts to extract kerogen from shale oil have consumed more energy than the heat recoverable by combusting the extracted kerogen. In some configurations, $CO_2$ may be delivered to mobilize kerogen in a similar manner to the bitumen in oil sand. Processing of mined oil shale with combustion gases in a separation vessel may use methods similar to those described above. It is expected that higher thermal efficiency and specific power of VAST wet combustion methods may significantly reduce the energy requirements and costs for processing shale oil. Configurations may inject sulfur, phosphorus, or nitrogen oxides into a separation vessel containing water, shale oil and limestone to deliver heat to drive the extraction process.

In one embodiment, a multi-step exothermic chemical process may be used to form an energetic fluid with elevated temperature and/or pressure. In one configuration, a fuel fluid comprising sulfur may be reacted with one or more oxidant fluids. Individually or collectively, these oxidant fluids may comprise two or more of an oxygen fluid, fluid water, and a calcium oxidant (or salt). The oxygen fluid may comprise air, enriched air or oxygen. The calcium oxidant may include one or more anhydrous or hydrated forms of oxygenated calcium, e.g., calcium carbonate, calcium bicarbonate, calcium oxide, and calcium hydroxide, and anhydrous, half-hydrates, dihydrates or other hydrated forms thereof.

Sulfur oxidation: In one example of this multi-step exothermic chemical process, a fuel fluid comprising sulfur may be combusted in a combustor with a first oxidant fluid comprising oxygen to form a heated energetic fluid including first products of combustion comprising one of sulfur dioxide, disulfur dioxide, and sulfur trioxide. One or both of the fuel fluid or sulfur fuel and the first oxidant fluid or oxygen fluid may be controlled to provide a relative oxidant to fuel ratio Lambda greater than a first ratio (LambdaOx1) sufficient to provide at least stoichiometric oxidant to combust the sulfur to sulfur dioxide. More preferably, oxygen fluid is delivered with a relative oxidant to fuel ratio greater than a second ratio (LambdaOx2) sufficient to react sulfur to sulfur trioxide.

Aqueous oxidation: In one configuration of this sulfurous embodiment, a second oxidant fluid comprising fluid water may be delivered upstream of a downstream combustor outlet and mixed with fluid within the combustor, e.g., the second oxidant fluid or aqueous fluid may be delivered and mixed in with one or more of the first products of combustion, the combusting fluid, the fuel fluid, and the first oxidant fluid or oxygen fluid.

One or both of the fuel fluid and the aqueous fluid are preferably controlled to provide a relative oxidant to fuel ratio Lambda greater than a first ratio (LambdaWa1) sufficient to provide at least stoichiometric oxidant to react the sulfur dioxide to sulfurous acid ($H_2SO_3$). More preferably, oxidant fluid is delivered with a relative oxidant to fuel ratio greater than a second ratio (LambdaWa2) sufficient to react the sulfur trioxide to sulfuric acid ($H_2SO_4$). This acid energetic fluid may comprise gaseous, fumed, or liquid sulfurous and/or sulfuric acid depending on the delivery rates of fuel fluid and oxidant fluid. This configuration releases the exothermic reaction energy of aqueous oxidation by forming the respective sulfurous and/or sulfuric acid from the partially oxidized sulfur dioxide and/or sulfur trioxide.

Calcium oxidant delivery: In a further configuration of this sulfurous embodiment, the second oxidant fluid delivered upstream of the combustor outlet may comprise a calcium oxidant, e.g., comprising one or more of calcium carbonate (limestone), calcium bicarbonate, calcium oxide, calcium hydroxide, ranging from anhydrous salt, to partially or fully hydrated salts, to dissolved and/or slurried salts.

Calcium sulfation: In delivering calcium fluid into the combustor, the calcium oxidant reacts with the sulfur dioxide and/or sulfur trioxide in the first products of combustion to form second products of reaction comprising sulfur salts of calcium, e.g., including calcium sulfite and/or calcium sulfate. Sufficient reaction residence time may be provided to achieve a prescribed degree of reaction or sulfation.

Oxidant comminution: Where the calcium fluid comprises solid calcium oxidant, it is preferably finely comminuted or powdered. In particular, the calcium oxidant may be less than one of 100 microns, 20 microns, 5 microns, or 2 microns in mean diameter. Generally, the more finely this oxidant salt is comminuted, the greater the effective surface area provided, and the faster the reaction. The calcium oxidant may be processed to increase the reactivity based on the effective surface area including internal pores.

Degree of sulfation: The combination of the combustor, the fluid delivery rates, calcium oxidant effective surface area, and/or the residence time may be configured and controlled to achieve a degree of sulfation that may be greater than one of 30%, 50%, or 70%.

Aqueous and calcium oxidant delivery: In further configurations, both aqueous oxidant comprising fluid water, and calcium oxidant comprising oxygenated calcium may be delivered upstream of the combustor outlet to combust or react with the fuel fluid or sulfur fluid. These may be configured as first delivering oxidant fluid, then aqueous fluid and then calcium fluid. The aqueous fluid may be delivered with one or more of the sulfur fluid, oxidant fluid and calcium fluid. In some configurations, oxidant fluid may be delivered with calcium fluid.

Diluent temperature control: Excess fuel fluid, oxygen fluid, and/or calcium fluid above the stoichiometric proportions will form a thermal diluent fluid that affects the temperature of the reacting fluids and/or the energetic fluid formed. The delivery of such excess fluid, herein termed diluent fluid, may be controlled to maintain the energetic fluid to one of below a prescribed upper temperature level, and above a prescribed lower temperature level.

High temperature corrosion control: The diluent fluid delivery may be controlled to prevent high temperature or Type II corrosion of the combustor and/or corrosion of an energetic fluid delivery system downstream of the combustor outlet. The energetic temperature may be controlled to below a prescribed temperature level for an expander downstream of the combustor configured to recover mechanical energy from the energetic fluid, e.g., to below one of 1100° C., 1300° C., or 1500° C. depending on the level of expander technology used and/or thermal efficiency desired.

High temperature NOx control: In some configurations, the upper temperature level may be controlled to avoid formation of substantial quantities of reaction byproducts, e.g., to below one of 1500° C. and 1200° C. to avoid substantial reaction between nitrogen and oxygen in one or more of the fuel fluid and/or oxidant fluid to form oxides of nitrogen or NOx. Similar temperature control may be provided to avoid formation of products of sulfur and nitrogen, comprising tetrasulfur dinitride, tetrasulfur tetranitride, and trisulfur dinitride dioxide.

Low temperature oxidation control: In some configurations, the lower temperature level may be controlled to avoid formation of substantial quantities of unreacted fuel fluid, e.g., to avoid substantial formation of sulfur oxide, and/or carbon monoxide, depending on the composition of fuel present.

Low temperature condensation control: In some configurations, the temperature of the energetic fluid may be controlled above a first prescribed lower temperature level near or upstream of the combustor outlet, e.g., this prescribed lower temperature level is set to avoid or reduce the probability of forming one or more of sulfurous acid, fumed sulfuric acid, sulfuric acid mist, liquid sulfuric acid upstream of the combustor outlet. The combustor outlet temperature may be controlled above a first prescribed lower temperature level to maintain the temperature of the energetic fluid above a second prescribed temperature level at a downstream location in the energetic fluid delivery system.

Hydrogenated fuels: In one embodiment, the fuel fluid comprising a hydrogenated compound is reacted. In one configuration, the fluid fuel may comprise one of hydrogen sulfide or hydrogen polysulfide. Some desulfurizing processes form hydrogen sulfide and then oxidize the hydrogen sulfide to sulfur. In such configurations, the hydrogen sulfide is preferably recovered or separated and delivered as part of the fuel fluid.

The hydrogenated sulfur fuel is preferably reacted with an oxidizing fluid comprising oxygen to form an energetic fluid comprising one of sulfur dioxide, disulfur dioxide, and/or sulfur trioxide. The oxygen fluid is preferably delivered with a relative oxidant ratio (Lambda) greater a prescribed ratio (LambdaHS1) sufficient to oxidize the hydrogenated sulfur fuel to a desired degree. In some configurations, the hydrogenated sulfur fuel is preferably reacted with an oxidant fluid comprising a calcium oxidant to form one of calcium sulfite, calcium dihydrogen sulfite, and calcium sulfate.

In other configurations, one or more combinations of oxygen oxidant, calcium oxidant and the aqueous oxidant may be reacted with the hydrogenated sulfur fuel in one or more sequences or fluid mixtures to form an oxide of sulfur and/or a sulfur salt of calcium.

Mixed Fuels: In some embodiments the fuel fluid may comprise a combination of hydrogenated sulfur and sulfur. In some configurations, the fuel fluid may comprise a combination of a carbonaceous fuel with one or more sulfur fuels, e.g., one of bitumen, kerogen, shale oil, heavy oil, powdered coke, powdered coal, methane or similar carbonaceous fuel may be mixed with one or both of sulfur and/or hydrogen sulfide. The carbonaceous fuel may also comprise sulfur. Partial gasification of a carbonaceous fuel comprising sulfur may result in a syngas or producer gas comprising sulfur. Such mixtures of carbonaceous and sulfur compounds may be processed or oxidized with two or more of the oxidant fluids as described above for some configurations. The resulting energetic fluid preferably comprises combinations of carbon dioxide, sulfur dioxide, sulfur trioxide and steam.

Control for Calcination: In some configurations delivering a calcium oxidant, the excess fluid or collectively diluent fluid delivery may be controlled to control the temperature of the energetic fluid in one of before or after the addition of calcium fluid, sufficient to raise the temperature of the calcium oxidant and to obtain a desired degree of calcination or dissociation to Calcium oxide CaO), preferably above the dissociation temperature of calcium carbonate near about 825° C. In other configurations, the energetic fluid may be mixed with a calcium oxidant slurry to form sulfated calcium salt and an energetic fluid comprising enhanced carbon dioxide, fluid water with residual nitrogen, oxygen and argon from the oxidant fluid.

Sulfation temperature control: In some configurations, the temperature of the energetic fluid may be controlled to within a prescribed temperature range to achieve sulfation or to react a calcium oxidant with a sulfur compound, e.g., to react calcium oxide (calcined calcium carbonate) with sulfur dioxide to form a sulfur salt of calcium. The sulfur salt is preferably calcium sulfate or a hydrated form thereof such as calcium sulfate half-hydrate, and calcium sulfate dihydrate (gypsum). The calcium sulfur salt may comprise calcium sulfite, and calcium dihydrogen sulfite, or similarly hydrated versions thereof. For high temperature sulfation, this sulfation reaction temperature range may be one of between about 900° C. and 1150° C., and between about 1000° C. to 1050° C., depending on the effective surface area and residence time.

Salt Separation: In some configurations, the calcium salt formed by sulfation may be separated from the energetic fluid formed. E.g., referring to FIG. 24, a major portion of dry calcium salts comprising one or more of anhydrous calcium sulfite, anhydrous calcium sulfate, calcium carbonate, and calcium oxide, may be separated from the energetic fluid comprising sulfur dioxide, carbon dioxide and steam. This may be performed by hot gas separator 532. This separator may comprise one or more high performance cyclones 526, and/or electrostatic precipitators (not shown). This may leave a small portion of the calcium salt to be delivered with the rest of the energetic fluid.

Pressurized separation: Referring to FIG. 24, in pressurized configurations, a pressurized extractor 232 may be used to withdraw the calcium salt F594 from the combustor or reactor 152, e.g., by using an extractor such as a screw extractor or lock hopper. The cleaned pressurized energetic fluid F15 may then be delivered to treat a heavy hydrocarbon or carbonaceous fluid to improve its recovery, e.g., in an underground geological formation, or in pressurized tanks.

Hydrated delivery: In some configurations, the energetic fluid with calcium salt may be hydrated to form a hot fluid comprising carbon dioxide and a calcium salt solution or slurry. The salt may be separated by a cyclone or centrifuge, leaving a hot fluid comprising carbon dioxide, water, and/or water vapor. This hot liquid may be delivered to treat heavy hydrocarbon or carbonaceous fluid, e.g., in surface mined carbonaceous materials, and/or an underground geological formation.

Heating Fuel: In some configurations fuel fluid may be heated to reduce viscosity and improve its delivery into the combustor. Solids such as sulfur may be heated above their melting point, i.e., above about 115° C. for sulfur. Carbonaceous fuels such as bitumen or heavy oils may be heated with hot water, e.g., to above about 35° C., or even above about 80° C. or higher. In other configurations, they may be heated with steam or other hot fluids to about 105° C., or to about 200° C. or to higher temperatures by pressurized energetic fluid, or pressurized steam.

Microwave RF Heating: The use of RF (including microwave) excitation for the in situ delivery of energy to hydrocarbon formations is known in the relevant art. However, the use of such techniques to heat the VASTgas of high water to fuel ratio combustion may offer additional advantages. Among these, the water content of VASTgas such as described in Table 2 is typically >50% and the $CO_2$ content of the VASTgas may be >4% in some configurations. In some configurations, microwave excitation of such VASTgas may be tuned to specific wavelengths of $CO_2$ and/or water. Similarly and the composition of the VAST gases may be adjusted to deliver improved effect to a given location.

Microwave excitation may be directionally specific. In some configurations, the microwave excitor may be cooled by a coolant or thermal diluent fluid, e.g., comprising one of water, steam, and $CO_2$. The heated coolant may then be further heated by the microwave excitation. Such heated coolant fluid may then be delivered to a heavy hydrocarbon resource. In some configurations, the microwave generator may be positioned inside the VASTgas stream to recover heat losses from microwave emission into the flue stream itself. Recovering such "energy loss" contributes to the delivery of heat to the heavy hydrocarbon formation.

In some configurations, microwave excitation may be provided down a well inside a heavy hydrocarbon formation together with VASTgas delivery. This may deliver additional energy at or near the formation in question to raise the temperature of formation to within a prescribed temperature range. This may provide one or more of: an insulating layer of gas between the hydrocarbon resource and the overburden (e.g., $N_2$/Ar); and reductions in the temperature of the gas delivered to the exciter. This method may extend the depth from which heavy hydrocarbons could be extracted.

The use of steam and $CO_2$ as major constituents of the VASTgas delivered to the heavy hydrocarbon formation, allows the use of microwave radiation tuned to a frequency of water and/or $CO_2$ which have broad microwave absorption bands. See, e.g., Rosenkranz, "Water Vapor microwave continuum absorption: A comparison of measurements and models", Radio Science, Vol. 33, No. 4, pp. 919-928, July-August 1998. Such microwave emitters are readily available and relatively inexpensive because of the use of this technology in microwave ovens.

In some configurations, one or more of the frequency and direction of microwave emission may be used to heat VASTgas and provide additional flexibility and control of the extraction process. Compositional control of the VASTgas may be combined with microwave frequency/direction changes during the extraction process for heavy hydrocarbons, i.e., changing the water/fuel ratio and the corresponding amount of water in the VASTgas.

In some configurations, the frequency of the microwave excitation may be changed away from the absorption bands of water and/or $CO_2$ to increase the penetration depth of the radiation into a formation saturated with water or $CO_2$. Some applications may tune the microwave excitation to frequencies absorbed by the heavy hydrocarbon.

In some applications, the microwave frequencies are adjusted as production develops. More specifically, the microwaves may initially be tuned to the strongest absorption bands would likely be desirable for the initial phase of heavy hydrocarbon extraction from a formation when the concentration of extractable material is high. Thereafter, as the heavy hydrocarbons are heated and extracted, excitation frequencies may be tuned away from the water or $CO_2$ absorption bands and directing them to hydrocarbon absorption frequencies may provide heat penetration further into the formation. This method may improve the total quantity of heavy hydrocarbon extracted.

In some configurations, resistive heating may be used to heat the process fluid, e.g, by heating of the process fluid with a resistor such as a resistive conductor within a well, and/or the well pipe itself near a targeted heavy hydrocarbon formation, including for deep formations. The high amounts of water vapor in the VASTgas and the compositional control of the process fluid may offer superior efficiency for applying this technology to in situ heavy hydrocarbon heating.

The composite effect of two or more of the processes mentioned above may reduce the economic and/or environmental costs for heavy hydrocarbon recovery. The heat and fuel required to extract a given heavy hydrocarbon may be reduced. The total amount of heavy hydrocarbons extractable from a given formation may be increased. Marginal or difficult to extract heavy hydrocarbons, such as shale oil, may have their EROEI increased. Combinations of such processes may increase the economic and environmental viability of many types of heavy hydrocarbon extraction, e.g., by increasing the EROEIs to substantially greater than 1.0.

Generalization of the inventive method to other process applications.

The use of combustion gases and combustion by-products (particularly $CO_2$) generated by high water to fuel ratio combustion has other applications outside of heavy hydrocarbon extraction. Another application is the use of such VASTgas, whether generated from a combustor directly or as the exhaust from a gas turbine/combustor combination as detailed above, for the remediation of brown field chemical spills. Many such spills are associated with petroleum refining and storage. These chemicals tend to be non-polar chemicals such as aliphatic or aromatic hydrocarbons, e.g., pentane, benzene and even carbon tetrachloride, that are relatively insoluble in water. Carbon dioxide is an excellent solvent for such non-polar molecules. It is expected that a high enthalpy VASTgas stream would be more effective and efficient in the mobilization of such spilled chemicals than steam alone, thereby aiding in the removal (or reburning) process for these materials. Such methods may be similar to that described above for the mobilization of heavy hydrocarbons in heavy hydrocarbon formations and/or mined material.

The configurations and methods discussed above may be used directly to enhance the clean-up or extraction of hydrocarbon and other chemical spills, e.g., wet combustion with air or enhanced oxygen, the use of wet combustion in gas turbines with diverted or direct configurations, and the use of various chemical and fuel choice methods to enhance the $CO_2$ concentration in VASTgas. Such methods may be effective where the chemical that requires clean-up or extraction is more soluble in $CO_2$ than in water. The high concentration of $CO_2$ in VASTgas may enhance the clean-up degree and/or extraction rate and/or thermal efficiency.

Other applications for such VASTgas containing $CO_2$ may include large scale cleaning of materials such a fabrics and plastics. Carbon dioxide can also be used to foam polymers because of the high solubility of the gas in non-polar polymers, and especially those plastics that require heating. In such applications, the $CO_2$ may dissolve into a polymer and provide pressurized dissolved gas to foam the polymer. The heat carried in the water may provide the heat to raise the temperature of the polymer above its glass transition temperature. This may provide an efficient method of delivering heat and controlling the dimensions of the foam bubbles formed in the lowered viscosity polymer material, e.g., to control some material properties of such polymers.

While certain embodiments of the invention have been shown and described, it will be clear to those skilled in the art that many changes and modifications can be made and other uses will become apparent to those skilled in the art without departing from the invention in its broader aspects as set forth in the claims provided hereinafter.

What is claimed is:

1. A method of extracting hydrocarbon from a hydrocarbon material comprising hydrocarbon including heavy hydrocarbon, petroleum, or other carbonaceous materials, the method comprising:

a) delivering a first fuel fluid comprising carbon or sulfur, an oxidant fluid comprising molecular oxygen, and a first aqueous diluent fluid comprising fluid water to a combustion system comprising a first combustor;

b) combusting a fuel mixture comprising a portion of the first fuel fluid, a portion of the oxidant fluid, and a first portion of the first aqueous diluent fluid in the first combustor, wherein producing a first combustion VASTgas, prior to contacting the hydrocarbon material, comprising products of combustion, fluid water, and carbon dioxide, having a temperature greater than 400 degrees Celsius;

c) diluting a first portion of the first combustion VASTgas with a first portion of a second aqueous diluent fluid, thereby increasing the volume percent of diluent fluid in the VASTgas, to form a first process VASTgas comprising fluid water and carbon dioxide, having a temperature between 50° C. and the temperature of the combustion VASTgas;

wherein one of the first portion of the first aqueous fluid and the first portion of the second aqueous diluent fluid, comprises one of a particulate material and a dissolved material;

d) separating a portion of evaporated solids from one of the combustion VASTgas or the process VASTgas formed by evaporating one of a particulate material and a dissolved material of the first or second aqueous fluid;

e) delivering the first process VASTgas to a first portion of the hydrocarbon material, wherein the hydrocarbon has a first viscosity, and the first process VASTgas is delivered in sufficient amount to reduce the viscosity of the hydrocarbon to obtain a second viscosity; and f) extracting a portion of the hydrocarbon from the first portion of the hydrocarbon material.

2. The method of claim 1, further delivering the first process VASTgas to the hydrocarbon material within a separation vessel, and separating the heated hydrocarbon material into a heavy hydrocarbon portion and a non-heavy hydrocarbon portion.

3. The method of claim 1, wherein, as extraction increases, increasing the ox en content of the process VASTgas, or decreasing the nitrogen content of the process VASTgas, thereby changing the composition of the VASTgas delivered to the hydrocarbon material.

4. The method of claim 1, wherein the process VASTgas comprises at least thirty three percent fluid water by volume (33v %).

5. The method of claim 1, wherein the delivered water to fuel ratio (omega) in the first aqueous diluent fluid and the first fuel fluid delivered to the first combustor is controlled to greater than about 10:1 by mass.

6. The method of claim 1, wherein delivering VASTgas to the hydrocarbon material further comprises the step of mixing together the first process VASTgas and the hydrocarbon material whereby mobilizing hydrocarbon.

7. The method of claim 1, wherein the process VASTgas comprises greater than 51.5% fluid water by mass.

8. The method of claim 1, further comprising the step of mixing comminuted alkali carbonate and the first combustion VASTgas fluid, wherein calcining a portion of the alkali carbonate, thereby forming alkali oxide, and separating out portion of the alkali oxide, thereby adding carbon dioxide $CO_2$ to the first combustion VASTgas fluid to improve the recovery of the hydrocarbon when delivering a portion of process VASTgas fluid to the hydrocarbon material.

9. The method of claim 1, wherein the hydrocarbon material comprises heavy hydrocarbon consisting of one of, shale oil, heavy oil, bitumen, and kerogen.

10. The method of claim 1, further comprising recapturing and separating a portion of carbon dioxide from the hydrocarbon being extracted, and delivering a portion of the recovered carbon dioxide in the first process VASTgas fluid being delivered to the hydrocarbon material.

11. The method of claim 1, further comprising the step of cooling the process VASTgas fluid and recovering condensed liquids therefrom.

12. The method of claim 1, wherein the first fuel fluid comprises a slagging fuel, whereby forming non-fuel materials; the method further comprising separating the portion of evaporated solids and a portion of non-fuel materials from the first combustion VASTgas or the first process VASTgas, using gravity separation and one of cyclonic separation and electrostatic separation.

13. The method of claim 12, wherein one of the first portion of first aqueous fluid and the first portion of the second aqueous fluid has a dissolved or suspended calcium or magnesium salt, the method comprising delivering sufficient aqueous fluid to cool one of the combustion fluid and the process fluid below a water condensation temperature, thereby forming a respective steam saturated fluid with carbon dioxide; separating out unevaporated aqueous fluid, and removing solids therefrom; and delivering a portion of the remaining unevaporated aqueous fluid with one of the first aqueous fluid and the second aqueous fluid.

14. The method of claim 1, further comprising electric resistive heating of the process fluid.

15. The method of claim 1, further comprising delivering the process VASTgas to local wells in a first well pad and in a second well pad.

16. The method of claim 1, further comprising the step of expanding through an expander one of a second portion of the first combustion VASTgas, and a first portion of a second combustion VASTgas formed by combusting, in a second combustor, a first portion of a second fuel fluid, a second portion of the oxidant fluid, and a first portion of a second aqueous fluid comprising fluid water, wherein controlling the respective combustion VASTgas upstream of the expander to less than a prescribed turbine inlet temperature, thereby forming an expanded VASTgas, and producing at least one of shaft power and electricity.

17. The method of claim 16, further comprising delivering a portion of the expanded VASTgas to a second portion of the hydrocarbon material, thereby enhancing the extraction of the hydrocarbon.

18. The method of claim 16, further comprising expanding the first portion of the first combustion VASTgas through a second expander before forming the first process VASTgas and delivering it to the hydrocarbon material.

19. The method of claim 16, further comprising recovering heat from the expanded VASTgas to heat aqueous diluent fluid, and delivering heated aqueous diluent fluid to the first process VASTgas.

20. The method of claim 16, further comprising diluting a portion of the expanded VASTgas with a second portion of the first aqueous fluid and delivering the diluted expanded VASTgas fluid to the hydrocarbon material.

21. The method of claim 16, wherein delivering the first process VASTgas or the expanded VASTgas with sufficient pressure to extract the hydrocarbon fluid, the method further comprising separating a fluid comprising carbon dioxide from the extracted hydrocarbon fluid and mixing it with one of the combustion VASTgas and the process VASTgas.

22. The method of claim 21, wherein the VASTgas is expanded with an expansion ratio less than the compression ratio in pressurizing the oxidant fluid, to deliver the process VASTgas to the first portion of the hydrocarbon material.

23. The method of claim 1, wherein the portion of first fuel fluid delivered to the first combustor has greater than 5% sulfur by mass of one of elemental sulfur, hydrogen sulfide, and hydrogen polysulfide, the method further comprising mixing and reacting with one of aqueous fluid and alkali carbonate, the products of combustion comprising sulfur in the first combustion VASTgas to generate one of heat and carbon dioxide.

24. The method of claim 23, wherein the first combustion VASTgas comprises an oxide of sulfur consisting of one of sulfur dioxide, disulfur dioxide, and sulfur trioxide, the method further comprising controlling the temperature of the first combustion VASTgas to avoid condensation of a fluid comprising a sulfur compound at a prescribed location downstream of the combustor.

25. The method of claim 1, further comprising heating one of the process VASTgas and the hydrocarbon material with radio-frequency electromagnetic radiation near the hydrocarbon material using an RF excitor.

26. The method of claim 25, further comprising cooling the radio-frequency excitor by a cooling fluid comprising one of water, steam, and carbon dioxide, and delivering the heated cooling fluid to the hydrocarbon resource.

27. The method of claim 25, further comprising one of directionally heating the hydrocarbon resource, and controlling the frequency of the radio-frequency heating to heat one of water, carbon dioxide, and hydrocarbon.

28. A method of enhancing hydrocarbon recovery, the method comprising:

a) delivering, mixing, and combusting a fuel fluid having carbonaceous fuel, and an oxidant fluid having molecular oxygen, thereby forming a combustion fluid comprising $CO_2$;

wherein a relative stoichiometric ratio of oxidant fluid to fuel fluid is controlled in the range from 1.0 to 1.5, and the combustion fluid comprises greater than 3% $CO_2$ by volume;

b) mixing and heating comminuted or pulverized alkali carbonate with a portion of the combustion fluid, wherein calcining a portion of the alkali carbonate, thereby generating carbon dioxide, forming solids comprising an alkali oxide, and forming a process fluid;

c) delivering and mixing an aqueous fluid comprising water with one or more of fuel fluid, oxidant fluid, the combustion fluid, and the process fluid with a ratio of total delivered water to fuel, thereby evaporating a portion of the water;

d) controlling the ratio of total delivered water to fuel to control a delivery temperature of the process fluid to less than a prescribed temperature;

wherein the ratio of total delivered water to fuel is greater than four to one by mass and less than twenty to one by mass;

e) removing a portion of the solids from one of the combustion fluid and the process fluid;

f) delivering the process fluid to a hydrocarbon containing material, thereby increasing the temperature of the hydrocarbon and the $CO_2$ concentration in the hydrocarbon; and g) extracting a portion of hydrocarbon from said hydrocarbon containing material after delivering the process fluid.

29. The method of claim 28, further comprising adding, to one of the combustion fluid and the process fluid, carbon dioxide produced by combusting a high carbon fuel consisting of coal, bitumen, or a derivative of coal or bitumen, or by chemical reaction of an acidic material with the carbonate.

30. The method of claim 28, further comprising expanding a second portion of the combustion fluid through an expander, and delivering additional $CO_2$ to the hydrocarbon material from one of the second portion of the combustion fluid, and carbon dioxide recovered from the extracted hydrocarbon fluid comprising $CO_2$.

31. The method of claim 28, wherein the process fluid contains at least about three point two percent carbon dioxide by volume (3.2v %), thereby decreasing the viscosity of the heavy hydrocarbon.

32. The method of claim 28, wherein delivering comminuted limestone in an aqueous slurry to one of the combustion fluid, the process fluid, and the hydrocarbon resource.

33. The method of claim 28, wherein the fuel fluid comprises sulfur and the combustion fluid has at least two percent (2%) sulfur by mass, thereby forming a sulfur salt in the combustion fluid, the process fluid, or in carbonate proximate to the hydrocarbon containing material.

34. The method of claim 28, wherein the fuel comprises greater than five percent (5%) by mass of elemental sulfur, hydrogen sulfide or hydrogen polysulfide.

35. The method of claim 28, wherein a portion of the aqueous fluid delivered upstream of the process fluid comprises a portion of hydrocarbon extracted from the hydrocarbon containing material.

36. The method of claim 28, wherein mixing sufficient aqueous fluid with one of calcium oxide and a sulfur salt of calcium to form one of calcium hydroxide and a hydrated salt of calcium.

37. The method of claim 28, further comprising pressurizing and separating a portion of CO2 from the extracted fluid, and delivering a portion of the CO2 to one of the combustion fluid, the process fluid, enhanced oil recovery, and sequestration.

38. The method of claim 28, wherein the combustion fluid comprises an oxide of sulfur consisting of one of sulfur dioxide, disulfur dioxide, and sulfur trioxide, and wherein the step of forming the process fluid comprises mixing the combustion fluid comprising sulfur oxide with alkali carbonate containing material at a temperature greater than eight hundred and twenty five Celsius (825° C.), thereby forming $CO_2$ and an alkali solid comprising sulfur and one of calcium and magnesium.

39. The method of claim 28, further comprising controlling the delivered water to fuel ratio to control the delivery temperature of the process fluid to within the range of about 50° C. to about 482° C.

40. The method of claim 28, wherein the aqueous water comprises a portion of contaminated water, waste water, or recovered water obtained from the hydrocarbon containing material, and comprises one of a particulate material and a dissolved material, thereby forming evaporated solids.

41. The method of claim 40, wherein removing the portion of the solids from the combustion fluid or the process fluid comprises using one of gravity, cyclonic, and electrostatic separation.

42. The method of claim 38, further comprising separating a portion of the alkali solid from one of the combustion fluid and the process fluid.

43. A method of extracting hydrocarbon from a hydrocarbon material resource comprising heavy hydrocarbon or petroleum proximate to alkali carbonate material, the method comprising:

a) combusting a fuel fluid comprising sulfur with an oxidant fluid comprising molecular oxygen in a combustion system, thereby forming products of combustion comprising oxidized sulfur compounds;

b) mixing aqueous fluid with the products of combustion, thereby forming a combustion fluid;

c) contacting together the combustion fluid and a portion of the alkali carbonate to form a process fluid comprising carbon dioxide;

d) contacting together the hydrocarbon material and the process fluid, thereby forming mobilized hydrocarbon; and e) extracting a portion of the mobilized hydrocarbon;

wherein the fuel comprises at least five percent of the fuel by mass (5 mass %) sulfur in the form of one or more of elemental sulfur, hydrogen sulfide, and hydrogen polysulfide; and wherein the sulfur is substantially oxidized to oxidized sulfur, consisting substantially of one or more of sulfur dioxide, disulfur dioxide, and sulfur trioxide.

44. The method of claim 43, further comprising mixing the hydrocarbon material with an aqueous slurry comprising a portion of the alkali carbonate material.

45. The method of claim 43, further comprising extracting hydrocarbon material from the resource; delivering the hydrocarbon material and the process fluid to a vessel; and contacting the hydrocarbon material and the process fluid within the vessel, wherein mobilizing hydrocarbon.

46. The method of claim 45, wherein delivering a portion of the alkali carbonate material and the sulfur oxide to the vessel and reacting them within the vessel, whereby forming the process fluid comprising $CO_2$ and heating the aqueous fluid and hydrocarbon material within the vessel.

47. The method of claim 45, wherein the process fluid locally boils water and agitates the mixture of hydrocarbon material and aqueous fluid in the vessel.

48. The method of claim 46, further comprising delivering an aqueous fluid to the vessel; and controlling the delivery rate of hydrocarbon material and aqueous fluid, wherein boiling a portion of the aqueous fluid within the vessel and controlling the temperature of the aqueous fluid and hydrocarbon fluid mixture to above a flotation temperature of bitumen, and below the aqueous fluid boiling point.

49. The method of claim 43, wherein mixing with in situ heaving hydrocarbon material an aqueous alkali fluid comprising a portion of the alkali carbonate material used to generate carbon dioxide.

50. The method of claim 49, wherein the step of delivering the process fluid comprises mixing the oxide of sulfur with an aqueous fluid and delivering the process fluid to the portion of the alkali carbonate material, thereby forming $CO_2$ and a salt comprising sulfur and heating the hydrocarbon.

51. The method of claim 43, wherein a portion of the oxide of sulfur reacts with a portion of the alkali carbonate material to form $CO_2$ and a salt comprising sulfur.

52. The method of claim 51, further comprising separating the salt comprising sulfur from the hydrocarbon.

53. A method of enhancing hydrocarbon extraction from hydrocarbon material proximate to alkali carbonate, the method comprising:

a) pressurizing and combusting a fuel fluid that has carbon and sulfur, with an oxidant fluid comprising molecular oxygen, whereby forming products of combustion including oxidized sulfur;

b) contacting together a portion of the products of combustion and a portion of the alkali carbonate, wherein generating carbon dioxide by one of calcining the alkali carbonate to form an alkali oxide, and reacting the oxidized sulfur with the alkali carbonate to form an alkali salt, c) pressurizing and mixing an aqueous fluid comprising fluid water with one or more of the portion of the products of combustion, a portion of the alkali oxide, and a portion of the alkali salt, wherein hydrating a portion of the alkali oxide or alkali salt and forming a mobilizing fluid comprising carbon dioxide and heated aqueous fluid ;

d) contacting together the hydrocarbon material and the mobilizing fluid, thereby increasing the mobility of hydrocarbon in the hydrocarbon material;

wherein the fuel fluid is formed by mixing a carbonaceous fluid with a sulfur fluid comprising one of elemental sulfur, hydrogen sulfide, and hydrogen disulfide, or the fuel fluid on a dry basis has more sulfur by mass than the meal sulfur in regionally available coal or bitumen;

wherein the mobilizing fluid comprises more than three percent carbon dioxide by volume (3 v %); and wherein the mobilizing fluid has a temperature greater than 50 degrees Celsius and less than 600 degrees Celsius.

54. The method of claim 53, wherein the products of combustion comprises greater than 5% by mass of one of sulfur, phosphorus, nitrogen, and a halogen.

55. The method of claim 53, wherein a major portion of the fuel fluid consists of one of methane, natural gas, sour gas, producer gas, syngas, powdered coke or combinations thereof.

56. The method of claim 53, wherein forming the mobilizing fluid to contact with the hydrocarbon in the hydrocarbon material, comprises contacting a portion of the products of combustion comprising oxidized sulfur in a gaseous state, with portion of the alkali carbonate, thereby forming an alkali sulfur salt.

57. The method of claim 53, wherein the step of forming the mobilizing fluid with the portion of the alkali carbonate, further comprises separating a portion of the alkali oxide or a portion of the alkali salt from the mobilizing fluid.

58. The method of claim 53, wherein the step of reacting the oxidized sulfur comprises mixing a diluent fluid comprising carbon dioxide with at least one of the fuel fluid, the oxidant fluid, and the products of reaction upstream of contacting together the mobilizing fluid and the hydrocarbon material.

59. The method of claim 53, wherein the step of reacting the oxidized sulfur with alkali carbonate is performed in an aqueous fluid comprising a portion of the hydrocarbon material.

60. The method of claim 53, wherein the step of contacting the hydrocarbon material comprises delivering the mobilizing fluid having carbon dioxide to an underground hydrocarbon material.

61. The method of claim 53, wherein the step of reacting the oxidized sulfur comprises delivering alkali carbonate in an aqueous slurry to an underground hydrocarbon material.

62. The method of claim 53, wherein reacting oxidized sulfur with alkali carbonate comprises alternatively delivering products of combustion and an aqueous alkali carbonate slurry to an underground hydrocarbon bearing material, wherein delivering oxidized sulfur and carbonate in a ratio sufficient to generate carbon dioxide.

63. The method of claim 53, wherein the mixed carbonaceous fuel comprises greater than 5% by mass of one of elemental sulfur, hydrogen sulfide, or hydrogen polysulfide.

64. The method of claim 63, wherein controlling the oxidation of sulfur material within the temperature range between nine hundred degrees Celsius (900° C.) and one thousand one hundred and fifty degrees Celsius (1150° C.).

65. A calcining method of extracting hydrocarbon from a hydrocarbon material including heavy hydrocarbon, petroleum, or other carbonaceous materials, the method comprising:

a) delivering a first fuel fluid comprising carbon, a first portion of an oxidant fluid comprising molecular oxygen, and a comminuted or pulverized alkali carbonate comprising calcium or magnesium, to a combustion system comprising a first combustor;

b) combusting a fuel mixture, comprising a portion of the first fuel fluid, a portion of the oxidant fluid, and calcining a portion of the alkali carbonate, in the first combustor; thereby producing a first combustion fluid comprising carbon dioxide and an alkali oxide;

c) delivering and mixing a first aqueous fluid with one or more of the first fuel fluid, the first portion of oxidant fluid, the alkali carbonate, and a first portion of the first combustion fluid, thereby forming a first process fluid comprising fluid water, carbon dioxide, and solids;

wherein the first process fluid temperature is controlled to less than 600 degrees Celsius, and wherein hydrating a portion of alkali oxide to an alkali hydroxide;

d) separating a portion of the solids, comprising a portion of one of the alkali oxide and a portion of the alkali hydroxide, from one of the first combustion fluid and the first process fluid, using one of gravity and cyclonic separation;

e) delivering the first process fluid to the hydrocarbon material;

f) producing an aqueous hydrocarbon fluid from the hydrocarbon material;

g) separating the aqueous hydrocarbon fluid into a recovered hydrocarbon fluid and a h) delivering a portion of the recovered aqueous fluid with a portion of the first aqueous fluid.

66. The method of claim 65, wherein the portion of the recovered aqueous fluid delivered upstream of the first process fluid comprises one of a soluble part, an organic part, and a hydrocarbon part of the produced aqueous hydrocarbon fluid.

67. The method of claim 65, further comprising varying the concentration of molecular oxygen in the process fluid during the hydrocarbon extraction process by varying one of the concentration of molecular oxygen in the oxidant fluid, and the relative oxidant ratio lambda.

68. The method of claim 65, further comprising cooling and pressurizing one of the process VASTgas, carbon dioxide separated from process VASTgas, and carbon dioxide recovered from the aqueous hydrocarbon fluid, sufficiently to form an enhancing fluid comprising liquid carbon dioxide, and delivering the cooled enhancing fluid to the hydrocarbon material, to market, or to sequestration.

69. The method of claim 65, further comprising forming a VASTgas by combusting, in a second combustor, a second fuel fluid, a second portion of the oxidant fluid, and a second aqueous fluid comprising fluid water;

expanding the VASTgas through an expander to generate power, thereby forming an expanded VASTgas;

using a portion of the power generated to deliver one of the oxidant fluid, the first or second fuel fluids, or the first or second aqueous fluid, or to produce the aqueous hydrocarbon fluid;

wherein controlling the second portion of oxidant fluid and second fuel fluid in the range from a relative stoichiometric ratio (lambda) of 1.0 to 90% of the Cheng point.

70. The method of claim 65, further comprising generating power, using the power for one of delivering a fluid, producing the aqueous hydrocarbon fluid, or pulverizing or recovered aqueous fluid, and comminuting the alkali carbonate; recovering heat from the power generator exhaust; and using the recovered heat to heat one of the oxidant fluid, the fuel fluid, the aqueous fluid, and the alkali carbonate.

* * * * *

UNITED STATES PATENT AND TRADEMARK OFFICE

CERTIFICATE OF CORRECTION

PATENT NO. : 8,561,702 B2
APPLICATION NO. : 12/526392
DATED : October 22, 2013
INVENTOR(S) : Wylie et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 399 days.

Signed and Sealed this
Fifteenth Day of September, 2015

Michelle K. Lee

Michelle K. Lee
*Director of the United States Patent and Trademark Office*